United States Patent [19]

Sasaki et al.

[11] Patent Number: 4,795,696

[45] Date of Patent: Jan. 3, 1989

[54] LIGHT-SENSITIVE SILVER HALIDE PHOTOGRAPHIC MATERIAL

[75] Inventors: Masao Sasaki; Kaoru Onodera, both of Odawara, Japan

[73] Assignee: Konishiroku Photo Industry Co., Ltd., Tokyo, Japan

[21] Appl. No.: 185,293

[22] Filed: Apr. 19, 1988

Related U.S. Application Data

[63] Continuation of Ser. No. 860,549, May 7, 1986, abandoned.

[30] Foreign Application Priority Data

May 11, 1985 [JP] Japan ..... 60-100176
May 30, 1985 [JP] Japan ..... 60-117493

[51] Int. Cl.[4] ..... G03C 1/34; G03C 7/38

[52] U.S. Cl. ..... 430/512; 430/523; 430/546; 430/551; 430/558

[58] Field of Search ..... 430/551, 558, 512, 931, 430/523, 546

[56] References Cited

U.S. PATENT DOCUMENTS

| | | | |
|---|---|---|---|
| 4,268,593 | 5/1981 | Leppard et al. | 430/17 |
| 4,517,283 | 5/1985 | Leppard et al. | 430/512 |
| 4,590,153 | 5/1986 | Kawagishi | 430/551 |
| 4,622,287 | 11/1986 | Umemoto et al. | 430/505 |
| 4,623,617 | 11/1986 | Kaneko et al. | 430/551 |
| 4,639,415 | 1/1987 | Kaneko et al. | 430/558 |
| 4,675,280 | 6/1987 | Kaneko et al. | 430/558 |
| 4,748,100 | 5/1988 | Umemoto et al. | 430/505 |

FOREIGN PATENT DOCUMENTS

| | | | |
|---|---|---|---|
| 0113124 | 7/1984 | European Pat. Off. . | |
| 0119741 | 9/1984 | European Pat. Off. . | |
| 0164130 | 12/1985 | European Pat. Off. | 430/551 |
| 0178789 | 4/1986 | European Pat. Off. | 430/558 |
| 0178165 | 4/1986 | European Pat. Off. . | |
| 0182486 | 5/1986 | European Pat. Off. . | |
| 3605279 | 8/1986 | Fed. Rep. of Germany . | |
| 2022274 | 12/1979 | United Kingdom . | |
| 2135788 | 9/1984 | United Kingdom . | |

OTHER PUBLICATIONS

Patent Abstracts of Japan, Kanji Kashiwagi- Silver Halide Photosensitive Material, Aug. 15, 1986, vol. 10, No. 237 (P-487)[2293], JP-A-61-67852 (Konishiroku Photo Ind. Co. Ltd.).

*Primary Examiner*—Roland E. Martin

*Assistant Examiner*—Lee C. Wright

*Attorney, Agent, or Firm*—Frishauf, Holtz Goodman & Woodward

[57] ABSTRACT

Disclosed is a light-sensitive silver halide photographic material, comprising a plural number of photographic constituent layers on a support, wherein at least one of the layers is a silver halide emulsion layer containing a magenta coupler represented by Formula (I) shown below, and at least one of the photographic constituent layers excluding at least the above silver halide emulsion layer contains at least one of the compounds represented by Formula (a) and Formula (b) shown below:

Formula (I):

Formula (a)

Formula (b)

The light-sensitive silver halide photographic material according to this invention have excellent color reproducibility, and is remarkably improved in both the fastness to light of magenta dye images and the resistance to the yellowing thereof to be generated by light (light stain).

22 Claims, No Drawings

LIGHT-SENSITIVE SILVER HALIDE PHOTOGRAPHIC MATERIAL

This application is a continuation of application Ser. No. 860,549, filed May 7, 1986, now abandoned.

BACKGROUND OF THE INVENTION

This invention relates to a light-sensitive silver halide photographic material. More particularly, it relates to a light-sensitive silver halide photographic material improved in the color reproducibility and also improved in the resistance to both of the discoloration of dye images through light and the yellowing thereof to be generated by light.

It has been well known that dye images are produced by subjecting a light-sensitive silver halide photographic material to imagewise exposure to light to effect color development, whereby an oxidized product of an aromatic primary amine series color developing agent couples with a coupler to form dyes including, for example, indophenol, indoaniline, indamine, azomethine, phenoxadine, phenadine and other dyes similar to these. In such a photographic process, generally employed is a color reproduction system utilizing the subtractive color process, in which used is a light-sensitive silver halide color photographic material comprising blue-sensitive, green-sensitive and red-sensitive silver halide emulsion layers containing couplers each having the relationship of complementary color, namely, couplers which color-develop in yellow, magenta and cyan, respectively.

The coupler used for formation of yellow color images includes, for example, acylacetoanilide series couplers, and, as the coupler for formation of magenta color images) for example, pyrazolone, pyrazolobenzimidazole, pyrazolotriazole or indazolone series couplers are known, and further, as the coupler for formation of cyan color images, for example, phenol or naphthol series couplers are generally used.

The coupler widely used for formation of magenta dye includes, for example, 1,2-pyrazolo-5-on type couplers.

It has been a serious problem that the magenta couplers of 1,2-pyrazol-5-on type have a secondary absorption at the vicinity of 430 nm in addition to a primary absorption at the vicinity of 550 nm, and therefore various studies have been made to solve such a problem.

A magenta coupler having an anilino group at the 3-position of the 1,2-pyrazolo-5-on type coupler, which is small in the above-mentioned secondary absorption, is useful for obtaining, in particular, a color image for printing. This art is disclosed, for example, in U.S. Pat. No. 2,343,703, British Pat. No. 1,059,994, etc.

As a means for further decreasing the secondary absorption at the vicinity of 430 nm of the above magenta coupler, there have been proposed magenta couplers including, for example, pyrazolobenzimidazoles disclosed in British Pat. No. 1,047,612, indazolones disclosed in U.S. Pat. No. 3,770,447, and pyrazolotriazoles disclosed in U.S. Pat. No. 3,725,067, British Pat. No. 1,252,418 and No. 1,334,515, Japanese Unexamined Patent Publications Nos. 162548/1984 and No. 171956/1984, etc. The dyes formed through these couplers shows extremely smaller secondary absorption at the vicinity of 430 nm than the dyed formed through the 1,2-pyrazolo-5-on type coupler do, and thus, they are desirable from the viewpoint of the color reproducibility, and also they are advantageous in that they are desirably very little liable to generation of yellow stains at an undeveloped portion against heat and humidity.

However, in general, the azomethine dye images to be formed through the magenta couplers of pyrazolotriazole type have very low fastness to light.

The disadvantage like this may result in loss of "image recording/storage properties" which are performances necessary for a light-sensitive material, in particular, for a light-sensitive material for direct appreciation. Especially in recent years, this is a problem still more serious because photographs hve become stored in various states such that they are displayed rather than merely stored. Thus, a drastic improvement has been strongly desired.

As a technique to improve the above-mentioned fastness to light, Japanese Unexamined Patent Publication No. 125732/1984, for instance, discloses a method in which 1H-pyrazolo-[3,2-C]-s-triazole type magenta coupler is used in combination with a phenol series or phenyl ether series compound. However, the effect obtainable therefrom has been still at an insufficient level.

Also, as a technique to improve the fastness to light by changing the structure of the above magenta coupler, Japanese Unexamined Patent Publication No. 43659/1985, for instance, proposes to use a 1H-pyrazolo-[1,5-b]-pyrazole series compound as a magenta coupler. However, there occurs a problem in the spectral absorption characteristics, for example, a problem that the absorption maximum turns to be a long wave.

As mentioned above, in the present state of the art, the fastness to light which can be achieved when the above couplers of pyrazolotriazole type and the like are used has not been improved to such a level that they may be applied to a photographic material for printing.

Further, as a means for improving the fastness to light of the magenta couplers of the above pyrazolotriazole type, the present inventors have ever proposed to add a particular compound to a layer other than the layers containing such couplers. The method proposed has achieved better improvement in the fastness to light. However, along with the progress in photographic techniques, demands for the fastness to light of photographic products had been estimated to become higher, and thus the present inventors have made further studies in order to achieve higher fastness to light, during the course of which the present invention has been accomplished.

SUMMARY OF THE INVENTION

An object of this invention is to provide a light-sensitive silver halide photographic material having excellent color reproducibility, and having remarkably improved in both the fastness to light of magenta dye images and the resistance to the yellowing thereof to be generated by light (hereinafter referred to as "light stain").

The above object of this invention can be achieved by a light-sensitive silver halide photographic material having a plural number of photographic constituent layers on a support, wherein at least one of said layers is a silver halide emulsion layer containing a compound (a magenta coupler) represented by Formula (I) shown below, and at least one of the photographic constituent layers excluding at least the above light-sensitive silver halide emulsion layer contains at least one of the compounds represented by Formula (a) and Formula (b) shown below:

Formula (I):

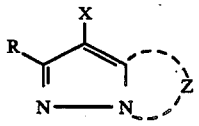

wherein Z represents a group of nonmetal atoms necessary for formation of a nitrogen-containing heterocyclic ring; said ring formed by Z may have a substituent; X represents a hydrogen atom or a substituent eliminable through the reaction with an oxidized product of a color developing agent; and R represents a hydrogen atom or a substituent.

Formula (a)

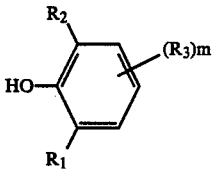

wherein $R^1$ and $R^2$ each represent an alkyl group; $R^3$ represents an alkyl group, an —NR'R" group, an —SR' group (R' represents a monovalent organic group), or a —COOR" group (R" represents a hydrogen atom or a monovalent organic group); and m represents an integer of 0 to 3.

Formula (b)

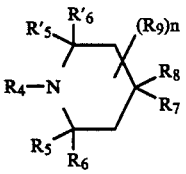

wherein $R^4$ represents a hydrogen atom, a hydroxyl group, an oxyradical group (an —O group), an —SOR' group, and —$SO_2R'$ group (R' represents a monovalent organic group), an alkyl group, an alkenyl group, an alkynyl group or a —COR" group (R" represents a hydrogen atom or a monovalent organic group); $R^5$, $R^6$, $R^{5'}$, and $R^{6'}$, and $R^9$ each represent an alkyl group; $R^7$ and $R^8$ each represent a hydrogen atom or an —O-$COR^{10}$ group ($R^{10}$ represents a monovalent organic group), or $R^7$ and $R^8$ may be associated to form a heterocyclic group; and n represents an integer of 0 to 4.

In another embodiment of this invention, the above light-sensitive silver halide emulsion layer containing the magenta coupler represented by Formula (I) may further contain at least one kind of a discoloration preventive agent.

DESCRIPTION OF THE PREFERRED EMBODIMENTS

This invention will be described below in detail.

In the magenta coupler according to this invention, represented by Formula (I), Z represents a group of nonmetal atoms necessary for formation of a nitrogen-containing heterocyclic ring; said ring formed by Z may have a substituent.

X represents a hydrogen atom or a substituent eliminable through the reaction with an oxidized product of a color developing agent.

And, R represents a hydrogen atom or a substituent.

The substituent represented by the above R may include, for example, a halogen atom, an alkyl group, a cycloalkyl group, an alkenyl group, a cycloalkenyl group, an alkynyl group, an aryl group, a heterocyclic group, a acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The halogen atom may include, for example, a chlorine atom and a bromine atom. Particularly preferred is a chlorine atom.

The alkyl group represented by R may preferably have those having 1 to 32 carbon atoms; the alkenyl group and the alkynyl group, each having 2 to 32 carbon atoms; the cycloalkyl group and the cycloalkenyl group, each having 3 to 12 carbon atoms, particularly preferably 5 to 7 carbon atoms. The alkyl group, the alkenyl group and the alkynyl group each may be of straight chain structure or branched structure.

Also, these alkyl group, alkenyl group, alkynyl group, cycloalkyl group and cycloalkenyl group each may have a substituent including, for example, an aryl, a cyano, a halogen atom, a hetero ring, a cycloalkyl, a cycloalkenyl, a spiro compound residual group, a bridged hydrocarbon compound residual group, and besides these, those which are substituted through a carbonyl group such as an acyl, a carboxyl, a carbamoyl, an alkoxycarbonyl and an aryloxycarbonyl, and those which are substituted through a hetero atom {specifically, those which are substituted through an oxygen atom such as a hydroxyl, an alkoxy, an aryloxy, a heterocyclic oxy, a siloxy, an acyloxy and a carbamoyloxy, those which are substituted through a nitrogen atom such as a nitro, an amino (including a dialkylamino, etc.), a sulfamoylamino, an alkoxycarbonylamino, an aryloxycarbonylamino, an acylamino, a sulfonamide, an imide and a ureido, those which are substituted through a sulfur atom such as an alkylthio, an arylthio, a heterocyclic thio, a sulfonyl, a sulfinyl and a sulfamoyl and those which are substituted through a phosphorus atom such as a phosphonyl, etc}.

More specifically, they include, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a tri-fluoromethyl group, a 1-ethoxytridecyl group, a 1-methoxyisopropyl group, an ethyl methanesulfonyl group, a methyl 2,4-di-t-amylphenoxy group, an anilino group, a 1-phenylisopropyl group, a 3-m-butanesulfonaminophenoxypropyl group, a 3-4'-{α-[4"(p-hydroxybenzenesulfonyl)phenoxy]-dodecanoylamino}phenylpropyl group, a 3-{4'-[α-(2",4"-di-t-amylphenoxy)butanamide]phenyl}propyl group, a 4-[α-(o-chlorophenoxy)tetradecanamidophenoxy]propyl group, an allyl group, a cyclopenyl group, a cyclohexyl group, etc.

The aryl group represented by R is preferably a phenyl group, and may have a substituent (for example, an alkyl group, an alkoxy group, an acylamino group, etc.). More specifically, it may include a phenyl group, a 4-t-butylphenyl group, a 2,4-di-t-amylphenyl group, a 4-tetradecanamidophenyl group, a hexadecyloxyphenyl group, a 4'-[α-(4''-t-butylphenoxy)tetradecanamido)-phenyl group, etc.

The heterocyclic group represented by R is preferably one having 5- to 7-members, which may be substituted or condensated. More specifically, it may include a 2-furyl group, a 2-thienyl group, a 2-pyrimidinyl group, a 2-benzothiazolyl group, etc.

The acyl group represented by R may include, for example, alkylcarbonyl groups such as an acetyl group, a phenyl acetyl group, a dodecanoyl group and an α-2,4-di-t-amylphenoxybutanoyl group; arylcarbonyl groups such as a benzoyl group, a 3-pentadecyloxybenzoyl group and a p-chlorobenzoyl group; etc.

The sulfonyl group represented by R may include alkylsulfonyl groups such as a methylsulfonyl group and a dodecylsulfonyl group; arylsufonyl groups such as a benzenesulfonyl group and a p-toluenesulfonyl group; etc.

The sulfinyl group represented by R may include alkylsulfinyl groups such as an ethylsulfinyl group, an octylsulfinyl group and a 3-phenoxybutylsulfinyl group; arylsulfinyl groups such as a phenylsulfinyl group, a m-pentadecylphenylsulfinyl group; etc.

The phosphonyl group represented by R may include alkylphosfonyl groups such as a butyloctylphosphonyl group, alkoxyphosphonyl groups such as an octyloxyphosphonyl group, an aryloxyphosphonyl groups such as a phenoxyphosphonyl group, an arylphosphonyl groups such as a phenylphosphonyl group, etc.

The carbamoyl group represented by R may be substituted with an alkyl group, an aryl group (preferably, a phenyl group), etc., and may include, for example, an N-methylcarbamoyl group, an N,N-dibutylcarbamoyl group, an N-(ethyl 2-pentadecyloctyl)carbamoyl group, an N-ethyl-N-dodecylcarbamoyl group, an N-{3-(2,4-di-t-amylphenoxy)propyl)}carbamoyl group, etc.

The sulfamoyl group represented by R may be substituted with an alkyl group, an aryl group (preferably a phenyl group), etc., and may include, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group, etc.

The spiro compound residual group represented by R may include, for example, spiro[3.3]heptan-1-yl, etc.

The bridged hydrocarbon compound residual group represented by R may include, for example, bicyclo[2.2.1]heptan-1-yl, tricyclo[3.3.1.1$^{3,7}$]decan-1-yl, 7,7-dimethylbicyclo[2.2.2]heptan-1yl, etc.

The alkoxy group represented by R may be further substituted with those mentioned as the substituents for the above alkyl group, and may include, for example, a methoxy group, a propoxy group, a 2-ethoxyethoxy group, a pentadecyloxy group, a 2-dodecyloxyethoxy group, a phenethyloxyethoxy group, etc.

The aryloxy group represented by R is preferably a phenyloxy, wherein the aryl nucleus my be further substituted with those mentioned as the substituents for the above aryl group, and may include, for example, a phenoxy group, a p-t-butylphenoxy group, an m-pentadecylphenoxy group, etc.

The heterocyclic oxy group represented by R is preferably one having 5- to 7-members, wherein the heterocyclic ring may further have a substituent, and may include, for example, a 3,4,5,6-tetrahydropyranyl-2-oxy group, a 1-phenyltetrazole-5-oxy group, etc.

The siloxy group represented by R may further be substituted with an alkyl group, etc., and may include, for example, a trimethylsiloxy group, a triethylsiloxy group, a dimethylbutylsiloxy group, etc.

The acyloxy group represented by R may include, for example, an alkylcarbonyloxy group, an arylcarbonyloxy group, etc., and may further have a substitutent to include, specifically, an acetyloxy group, an α-chloroacetyloxy group, a benzoyloxy group, etc.

The carbamoyloxy group represented by R may be substituted with an alkyl group, an aryl group, etc., and may include, for example, an N-ethylcarbamoyloxy group, an N,N-diethylcarbamoyloxy group, an N-phenylcarbamoyloxy group, etc.

The amino group represented by R may be substituted with an alkyl group, an aryl group (preferably, a phenyl group), and may include, for example, an ethylamino group, an anilino group, an m-chloroanilino group, a 3-pentadecyloxycarbonylanilino group, a 2-chloro-5-hexadecanamidoanilino group, etc.

The acylamino group represented by R may include an alkylcarbonylamino group, an arylcarbonylamino group (preferably, a phenylcarbonylamino group), etc., and may further have a substituent to include, specifically, an acetoamide group, an α-ethylpropaneamide group, an N-phenylacetoamide group, a dodecanamide group, a 2,4-di-t-amylphenoxyacetoamide group, an α-3-t-butyl-4-hydroxyphenoxybutaneamide group, etc.

The sulfonamide group represented by R may include an alkylsulfonylamino group, an arylsulfonylamino group, and may further have a substituent. It specifically may include, a methylsulfonylamino group, a pentadecylsulfonylamino group, a benzenesulfonamide group, a p-toluenesulfonamide group, a 2-methoxy-5-t-amylbenzensulfonamide group, etc.

The imide group represented by R may be of open chain structure or cyclic structure, or may have a substituent to include, for example, a succinimide group, a 3-heptadecylsuccinimide, a phthalimide group, a glutalimide group, etc.

The ureido group represented by R may be substituted with an alkyl group, an aryl group (preferably, a phenyl group), etc., and may include, for example, an N-ethylureido group, an N-ethyl-N-decylureido group, an N-phenylureido group, an N-p-tolylureido group, etc.

The sulfamoylamino group represented by R may be substituted with an alkyl group or an aryl group (preferably, a phenyl group), etc., and may include, for example, an N,N-dibutylsulfamoylamino group, an N-methylsulfamoylamino group, an N-phenylsulfamoylamino group, etc.

The alkoxycarbonylamino group represented by R may further have a substituent, and may include, for example, a methoxycarbonylamino group, a methoxyethoxycarbonylamino group, an octadecyloxycarbonylamino group, etc.

The aryloxycarbonylamino group represented by R may have a substituent, and may include, for example, a phenoxycarbonylamino group, a 4-methylphenoxycarbonylamino group, etc.

The alkoxycarbonyl group represented by R may further have a substituent, and may include, for example, a methoxycarbonyl group, a butyloxycarbonyl group, a dodecyloxycarbonyl group, an octadecyloxycarbonyl group, an ethoxymethoxycarbonyloxy group, a benzyloxycarbonyl group, etc.

The aryloxycarbonyl group represented by R may further have a substituent, and may include, for example, a phenoxycarbonyl group, a p-chlorophenoxycarbonyl group, an m-pentadecyloxyphenoxycarbonyl group, etc.

The alkylthio group represented by R may further have a substituent, and may include, for example, an ethylthio group, a dodecylthio group, an octadecylthio group, a phenethylthio group, a 3-phenoxypropylthio group, etc.

The arylthio group represented by R is preferably a phenylthio group which may further have a substituent, and may include, for example, a phenylthio group, a p-methoxyphenylthio group, a 2-t-octylphenylthio group, a 3-octadecylphenylthio group, a 2-carboxyphenylthio group, a p-acetoaminophenylthio group, etc.

The heterocyclic thio group represented by R is preferably a heterocyclic thio group of 5 to 7 members, and may further have a condensed ring or may have a substituent. It may include, for example, a 2-pyridylthio group, a 2-benzothiazolylthio group, a 2,4-diphenoxy-1,3,5-triazole-6-thio group, etc.

The substituent represented by X, which is eliminable through the reaction with an oxidized product of a color developing agent, may include, for example, a halogen atom (such as a chlorine atom, a bromine atom and a fluorine atom), and also groups which are substituted through a carbon atom, an oxygen atom, a sulfur atom or a nitrogen atom.

The groups which are substituted through a carbon atom may include a carboxyl group, and also, for example, a group represented by the general formula:

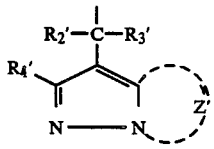

wherein $R^{1'}$ is as defined above, Z' is same as defined for the above Z; and $R^{2'}$ and $R^{3'}$ each represent a hydrogen atom, an aryl group, an alkyl group or a heterocyclic group, a hydroxymethyl group and a triphenylmethyl group.

The groups which are substituted through an oxygen atom may include, for example, an alkoxy group, an aryloxy group, a heterocyclic oxy group, an acyloxy group, a sulfonyloxy group, an alkoxycarbonyloxy group, an aryloxycarbonyloxy group, an alkyloxyaryloxy group, an alkoxyoxaryloxy group, etc.

The above alkoxy group may further have a substituent including, for example, an ethoxy group, a 2-phenoxyethoxy group, 2-cyanoethoxy group, a phenethyloxy group, a p-chlorobenzyloxy group, etc.

The above aryloxy group is preferably a phenoxy group, and the aryl group may further have a substituent. More specifically, it may include a phenoxy group, a 3-methylphenoxy group, a 3-dodecylphenoxy group, a 4-methanesulfonamidephenoxy group, a 4-[α-(3'-pentadecylphenoxy)butanamido]phenoxy group, a hexadecylcarbamoylmethoxy group, a 4-cyanophenoxy group, a 4-methanesulfonylphenoxy group, a 1-naphthyloxy group, a p-methoxyphenoxy group, etc.

The above heterocyclic oxy group is preferably a heterocyclic oxy group of 5 to 7 members, or may be of condensed ring, or may have a substituent. Specifically, it may include a 1-phenyltetrazolyloxy group, a 2-benzothiazolyloxy group, etc.

The above acyloxy group may include, for example, alkylcarbonyloxy groups such as an acetoxy group and a butanoloxy group, and alkenylcarbonyloxy groups such as a cinnamoyloxy group, and arylcarbonyloxy groups such as a benzoyloxy group.

The above sulfonyloxy group may include, for example, a butanesulfonyloxy group and methanesulfonyloxy group.

The above alkoxycarbonyloxy group may include, for example, an ethoxycarbonyloxy group and a benzyloxycarbonyloxy group.

The above aryloxycarbonyloxy group may include a phenoxycarbonyloxy group, etc.

The above alkyloxalyloxy group may include, for example, a methyloxalyloxy group.

The above alkoxyoxalyloxy group may include an ethoxyoxalyloxy group, etc.

The group which is substituted through a sulfur atom may include, for example, an alkylthio group, an arylthio group, a heterocyclic thio group and an alkyloxythiocarbonylthio group.

The above alkylthio group may include a butylthio group, a 2-cyanoethylthio group, a phenethylthio group, a benzylthio group, etc.

The above arylthio group may include a phenylthio group, a 4-methanesulfonamidephenylthio group, a 4-dodecylphenethylthio group, a 4-nonafluoropentanamidephenethylthio group, a 4-carboxyphenylthio group, a 2-ethoxy-5-t-butylphenylthio group, etc.

The above heterocyclic thio group may include, for example, a 1-phenyl-1,2,3,4-tetrazolyl-5-thio group, a 2-benzothiazolylthio group, etc.

The above alkyloxythiocarbonylthio group may include a dodecyloxythiocarbonylthio group, etc.

The group which is substituted through a nitrogen atom may include, for example, a group represented by the general formula:

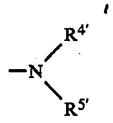

In this formula, $R^{4'}$ and $R^{5'}$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group, and $R^{4'}$ and $R^{5'}$ may be bonded to each other to form a hetero ring, provided that $R^{4'}$ and $R^{5'}$ each are not a hydrogen atom at the same time.

The above alkyl group may be of straight chain or branched one, and is preferably one having 1 to 22 carbon atoms. Also, this alkyl group may have a substituent which may include, for example, an aryl group, an alkoxy group, an aryloxy group, an alkylthio group, an arylthio group, an alkylamino group, arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryoxycarbonylamino group, a hydroxyl group, a carboxyl group, a cyano group and a halogen atom. The alkyl group may specifically include, for example, an ethyl group, an octyl group, a 2-ethylhexyl group and 2-chloroethyl group.

The aryl group represented by $R^{4'}$ or $R^{5'}$ is preferably one having 6 to 32 carbon atoms, in particular, a phenyl group and a naphthyl group, wherein the aryl group may have a substituent which may include those mentioned as the substituents for the alkyl group represented by the above $R^{4'}$ or $R^{5'}$. This aryl group may specifically include, for example, a phenyl group, a 1-naphthyl group and a 4-methylsulfonylphenyl group.

The heterocyclic group represented by $R^{4'}$ or $R^{5'}$ is preferably of 5 to 6 members, or may be of condensed ring, or may have a substituent. Specifically, it may include a 2-furyl group, a 2-quinolyl group, a 2-pyrimidyl group, a 2-benzothiazolyl group, a 2-pyridyl group, etc.

The sulfamoyl group represented by $R^{4'}$ or $R^{5'}$ may include an N-alkylsulfamoyl group, an N,N-dialkylsulfamoyl group, an N-arylsulfamoyl group, an N,N-diarylsufamoyl group, etc., and the alkyl group and the aryl group of these may have the substituent mentioned for the above alkyl group and aryl group. The sulfamoyl group may specifically include, for example, an N,N-diehtylsulfamoyl group, an N-methylsulfamoyl group, an N-dodecylsulfamoyl group and an N-p-tolylsulfamoyl group.

The carbamoyl group represented by $R^{4'}$ or $R^{5'}$ may include an N-alkylcarbamoyl group, an N,N-dialkylcarbamoyl group, an N-arylcarbamoyl group, an N,N-diarylcarbamoyl group, etc., and the alkyl group and the aryl group of these may have the substituent mentioned for the above alkyl group and aryl group. The carbamoyl group may specifically include, for example, an N,N-diethylcarbamoyl group, an N-methylcarbamoyl group, an N-dodecylcarbamoyl group, an N-p-cyanophenylcarbamoyl group and an N-p-tolylcarbamoyl group.

The acyl group represented by $R^{4'}$ or $R^{5'}$ may include, for example, an alkylcarbonyl group, an arylcarbonyl group and a heterocyclic carbonyl group, and the alkyl group, the aryl group and the heterocyclic group each may have a substituent. The acyl group may specifically include, for example, a hexafluorobutanoyl group, 2,3,4,5,6-pentafluorobenzoyl group, an acetyl group, a benzoyl group, a naphthoel group, a 2-furylcarbonyl group, etc.

The sulfonyl group represented by $R^{4'}$ or $R^{5'}$ may include an alkylsulfonyl group, an arylsulfonyl group and a heterocyclic sulfonyl group, and may have a substituent. Specifically, it may include, for example, an ethanesulfonyl group, a benzenesulfonyl group, an octanesulfonyl group, a naphthalenesulfonyl group, a p-chlorobenzenesulfonyl group, etc.

The aryloxycarbonyl group represented by $R^{4'}$ or $R^{5'}$ may have as a substituent those mentioned for the above aryl group. Specifically, it may include a phenoxycarbonyl group, etc.

The alkoxycarbonyl group represented by $R^{4'}$ or $R^{5'}$ may have the substituent mentioned for the above alkyl group, and specifically may include a methoxycarbonyl group, a dodecyloxycarbonyl group, a benzyloxycarbonyl group, etc.

The hetero ring to be formed by bonding of $R^{4'}$ and $R^{5'}$ is preferably of 5 to 6 members, and may be saturated or unsaturated, may be aromatic or non-aromatic, or may be of a condensed ring. This hetero ring may include, for example, an N-phthalimide group, an N-succinimide group, a 4-N-urazolyl group, a 1-N-hydantoinyl group, 3-N-2,4-dioxooxazolydinyl group, a 2-N-1,1-dioxo-3-(2H)-oxo-1,2-benzthiazolyl group, a 1-pyrolyl group, a 1-pyrolidinyl group, a 1-pyrazolyl group, a 1-pyrazolydinyl group, a 1-pipelidinyl group, a 1-pyrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pylidone group, a phthaladione group, a 2-oxo-1-piperidinyl group, etc., and these heterocyclic groups each may be substituted with an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, a ureido group, an alkoxycarbonyl group, an aryloxycarbonyl group, an imide group, a nitro group, a cyano group, a carboxyl group, a halogen atom, etc.

The nitrogen-containing hetero ring to be formed by Z or Z' may include a pyrazole ring, an imidazole ring, a triazole ring, a tetrazole ring, etc., and the substituent which the above rings each may have include those mentioned for the above R.

When the substituents (for example, R, $R^1$ to $R^8$) on the heterocyclic rings in the Formula (I) and the Formulas (II) to (VIII) shown hereinbelow have a moiety of:

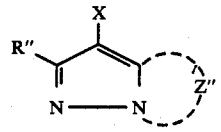

wherein R'', X and Z'' each have the same meaning as R, X, and Z in Formula (I), a so-called bis-body type coupler is formed, which may be included in this invention as a matter of course. Also, on the rings formed by Z, Z', Z'' and the later-mentioned $Z^1$, other rings (for example, a cycloalkene of 5 to 7 members) may be further condensed. For instance, in Formula (V), $R^5$ and $R^6$ may be, and, in Formula (VI), $R^7$ and $R^8$ may be bonded to each other to form a ring (for example, a cycloalkene of 5 to 7 members, benzene).

The coupler represented by Formula (I) may, more specifically, represented, for example, by Formulas (II) to (VII) shown below:

Formula (II)

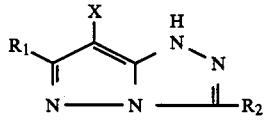

Formula (III)

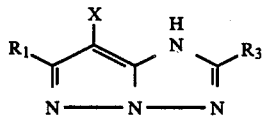

Formula (IV)

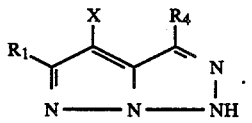

Formula (V)

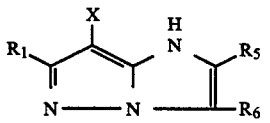

Formula (VI)

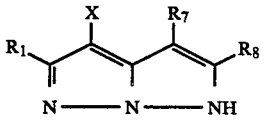

Formula (VII)

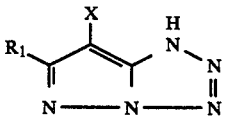

In the above Formulas (II) to (VII), $R^1$ to $R^8$ and X each have the same meaning as R and X mentioned before.

Also, what is most preferable in Formula (I) is one represented by Formula (VIII) shown below:

Formula (VIII)

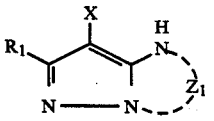

wherein $R^1$, X and $Z^1$ each have the same meaning as R, X and Z in Formula (I).

Of the magenta couplers represented by the above Formulas (II) to (VII), particularly preferred is the magenta coupler represented by Formula (II).

As for the substituents on the heterocyclic rings in Formula (I) to (VIII), it is preferable for R, in the case of Formula (I), and for $R^1$, in the cases of Formulas (II) to (VIII), to each satisfy the condition 1 shown below, and it is further preferable to satify the conditions 1 and 2 shown below, and it is particularly preferable to satisfy the conditions 1, 2 and 3 shown below:

Condition 1: A root atom directly bonded to the heterocyclic ring is a carbon atom.

Condition 2: Only one hydrogen atom is bonded to the above carbon atom, or not bonded thereto at all.

Condition 3: All of the bonds between the carbon atom and atoms adjoining thereto are in single bonding.

Substituents most preferable as the substituents R and $R^1$ in the above heterocyclic rings include those represented by Formula (IX) shown below:

Formula (IX)

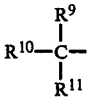

In the above formula, $R^9$, $R^{10}$ and $R^{11}$ each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclic thio group; and at least two of $R^9$, $R^{10}$ and $R^{11}$ are not hydrogen atoms.

Two substituents in the above $R^9$, $R^{10}$ and $R^{11}$, for example, $R^9$ and $R^{10}$, may be bonded to form a saturated or unsaturated ring (for example, a cycloalkane, a cycloalkene, a heterocyclic ring), or $R^{11}$ may be further bonded to this ring to form a residue of a bridged hydrocarbon compound.

The groups represented by $R^9$ to $R^{11}$ may have a substituent, and examples of the groups represented by $R^9$ to $R^{11}$ and the substituents these groups may have, may include the specific examples and the substituents mentioned for the group represented by R in Formula (I).

Also, examples of the ring to be formed by bonding, for instance, of $R^9$ and $R^{10}$ and the residue of bridged hydrocarbon compound to be formed by $R^9$ to $R^{11}$, and also the substituents which this ring may have, may include the specific examples and the substituents mentioned for the cycloalkyl, the cycloalkenyl and the residue of heterocyclic bridged hydrocarbon compound which are represented by R in the above Formula (I).

In Formula (IX), preferable are;

(i) the case where two of $R^9$ to $R^{11}$ are each an alkyl group; and (ii) the case where one of $R^9$ to $R^{11}$, for example, $R^{11}$ is a hydrogen atom, and the other two, $R^9$ and $R^{10}$ are bonded to form a cycloalkyl group together with the root carbon atoms.

Further preferable in the case (i) is the case where two of $R^9$ to $R^{11}$ are each an alkyl group, and the other one is a hydrogen atom or an alkyl group.

Here, the alkyl and the cycloalkyl each may further have a substituent, and examples of the alkyl, the cycloalkyl and the substituents of these may include those for the alkyl, the cycloalkyl and the substituents of these which are represented by R in the above Formula (I).

The substituents which the ring to be formed by Z in Formula (I) and the ring to be formed by $Z^1$ in Formula (VIII) may have, and the substituents $R^2$ to $R^8$ in Formulas (II) to (VI), are preferably those represented by Formula (X) shown below:

Formula (X)

$$-R^1-SO_2-R^2$$

wherein $R^1$ represents an alkylene group, $R^2$ represents an alkyl group, a cycloalkyl group or an aryl group.

The alkylene represented by $R^1$ preferably has 2 or more, and more preferably 3 to 6 carbon atoms at the straight chain portion, and may be of straight chain or branched structure. Also, this alkylene may have a substituent.

Examples of such substituent may include those shown as the substituents which the alkyl group when R in Formula (I) may have.

Preferable substituents may include a phenyl.

Preferable examples for the alkylene represented by $R^1$ are shown below:

$$-CH_2CH_2CH_2-,\ -\underset{\underset{CH_3}{|}}{C}HCH_2CH_2-,\ -\underset{\underset{C_2H_5}{|}}{C}HCH_2CH_2-,$$

$$-CH_2CH_2\underset{\underset{C_7H_{15}}{|}}{C}H-,\ -CH_2CH_2\underset{\underset{C_2H_5}{|}}{C}H-,\ -CH_2CH_2CH_2CH_2-,$$

-continued $$-CH_2CH_2CH_2\underset{\underset{C_6H_{13}}{|}}{C}H-,\ -\underset{\underset{\text{Ph}}{|}}{C}HCH_2CH_2-,\ -\overset{\overset{CH_3}{|}}{\underset{\underset{CH_3}{|}}{C}}-CH_2CH_2-$$

The alkyl group represented by $R^2$ may be of straight chain or branched structure. Specifically, it may include methyl, ethyl, propyl, iso-propyl, butyl, 2-ethylhexyl, octyl, dodecyl, tetradecyl, hexadecyl, octadecyl, 2-hexyldecyl, etc.

The cycloalkyl group represented by $R^2$ is preferably of 5 to 6 members, and may include, for example, a cyclohexyl group.

The alkyl group and the cycloalkyl group represented by $R^2$ may each have a substituent including, for example, those exemplified as the substituents for the above $R^1$.

The aryl group represented by $R^2$ may specifically include a phenyl group and a naphthyl group. The aryl group may have a substituent. Such a substituent may include, for example, a straight chain or branched alkyl group, and besides, those exemplified as the substituents for the above $R^1$.

Also, when there are two or more substituents, they may be the same or different substituents.

Particularly preferable in the compounds represented by Formula (I) are those represented by Formula (XI) shown below:

Formula (XI)

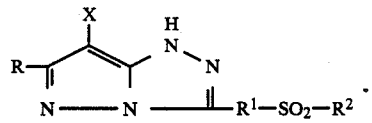

wherein R and X each have the same meaning as R and X in Formula (I), and $R^1$ and $R^2$ each have the same meaning as $R^1$ and $R^2$ in Formula (X).

Exemplary magenta couplers of the magenta coupler represented by Formula (I) are shown below:

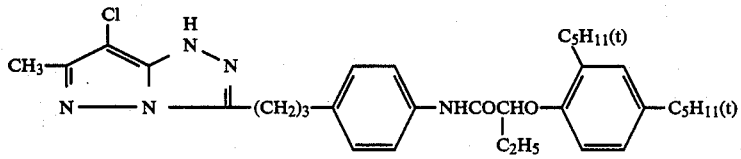

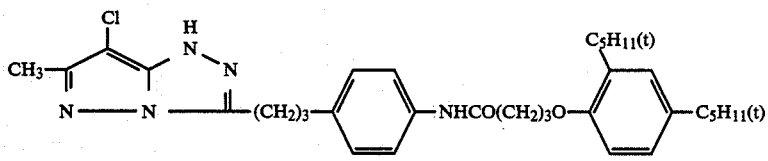

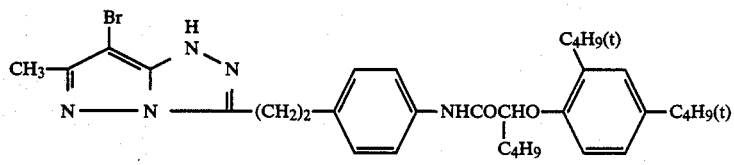

-continued
4
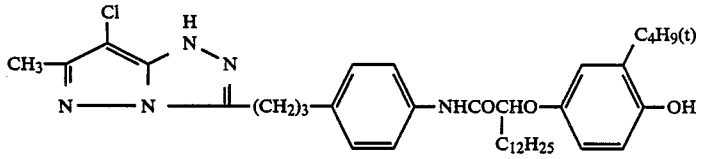
5
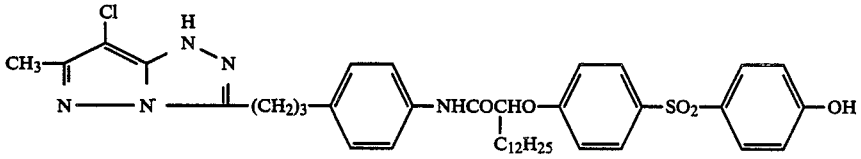
6
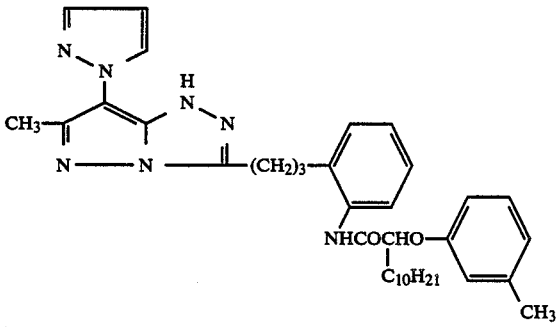
7
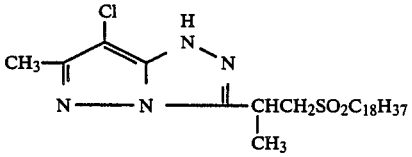
8
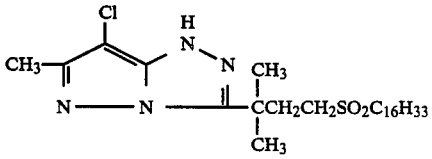
9
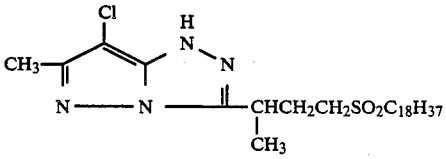
10
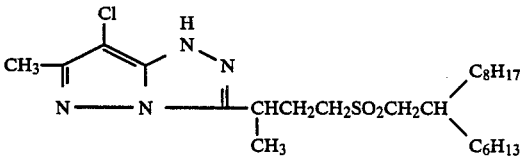
11
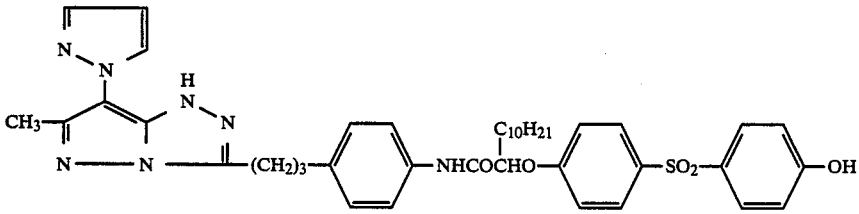
12
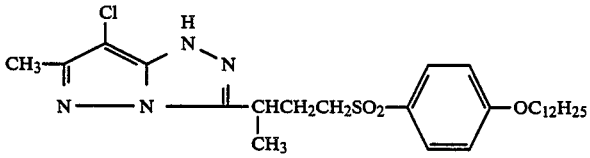
13
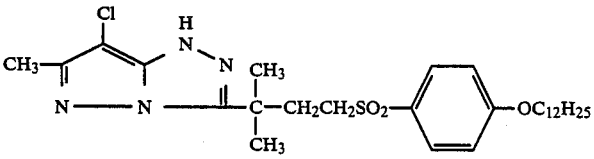

-continued
14
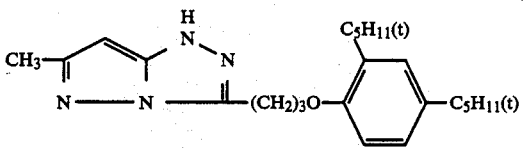
15
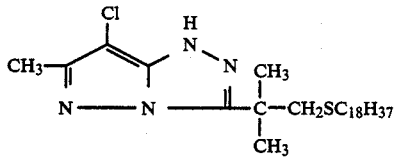
16
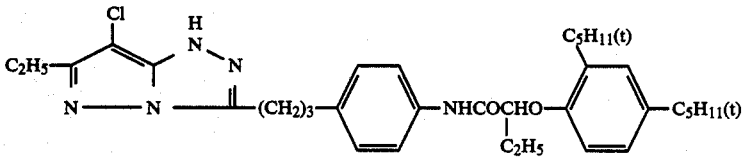
17
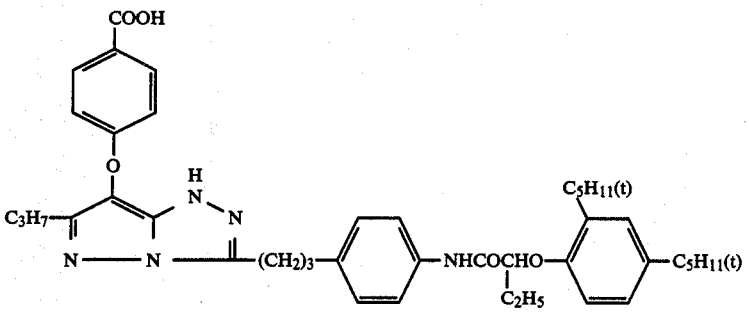
18
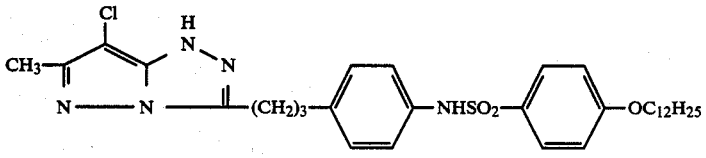
19
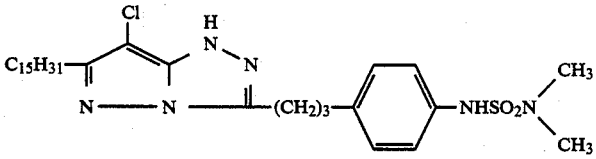
20
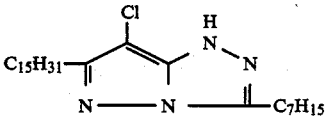
21
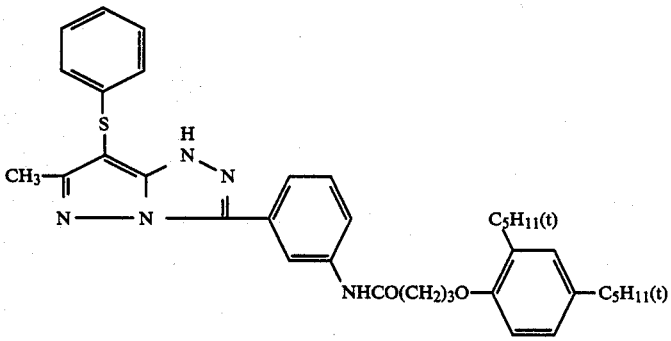
22
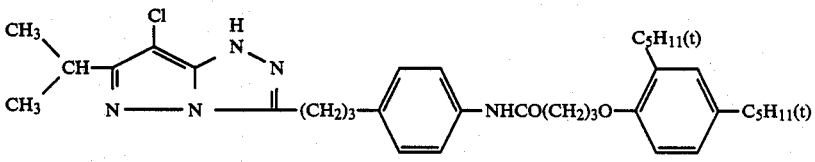

-continued
23
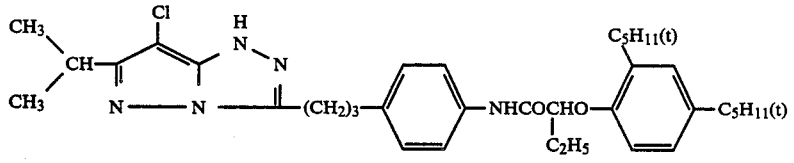
24
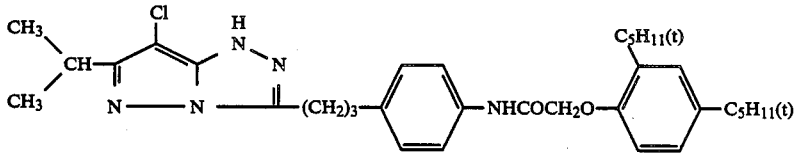
25
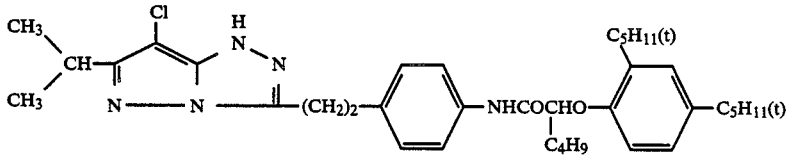
26
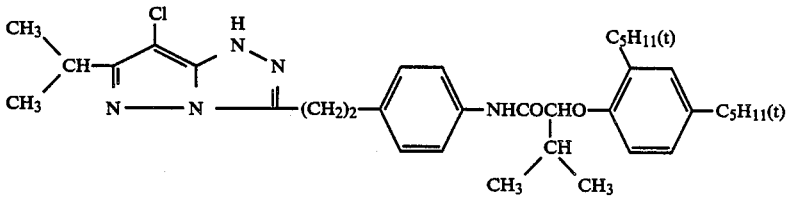
27
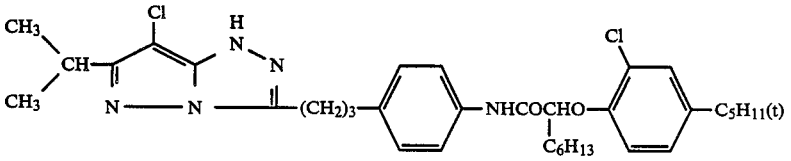
28
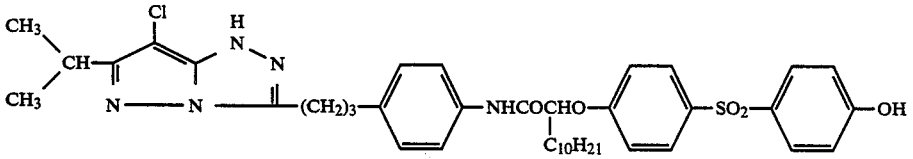
29
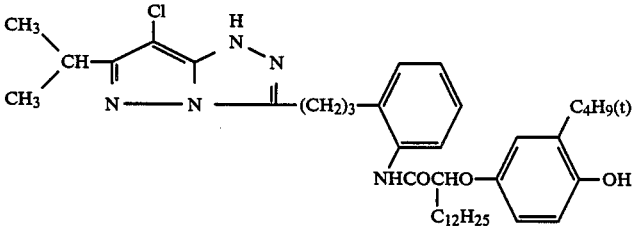
30
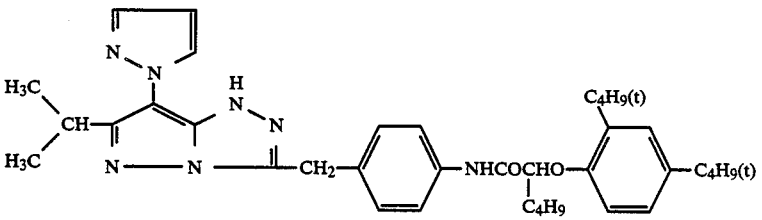
31
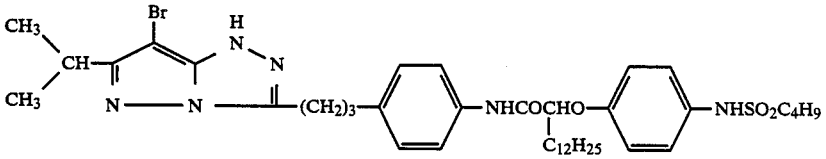

-continued
32
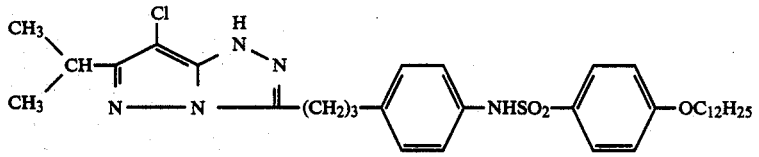
33
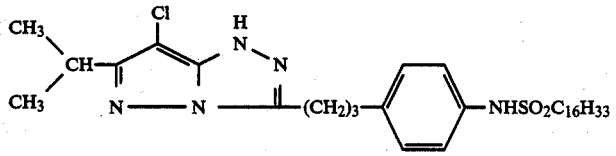
34
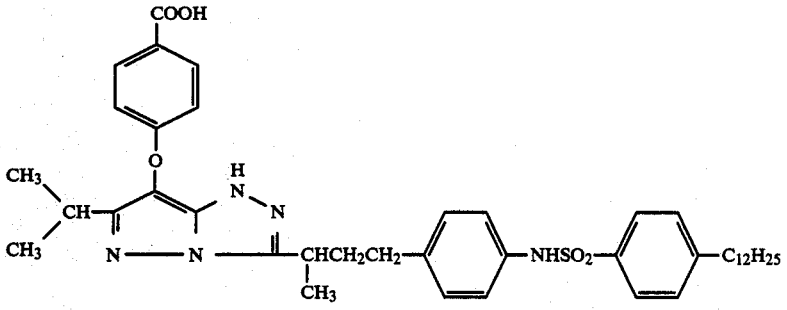
35
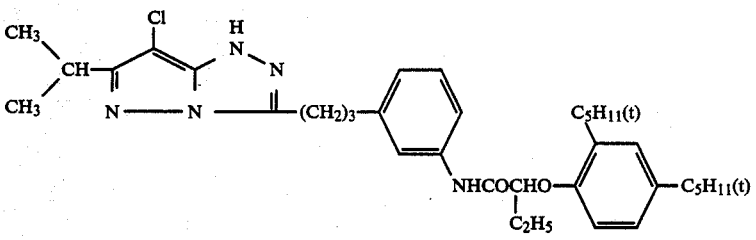
36
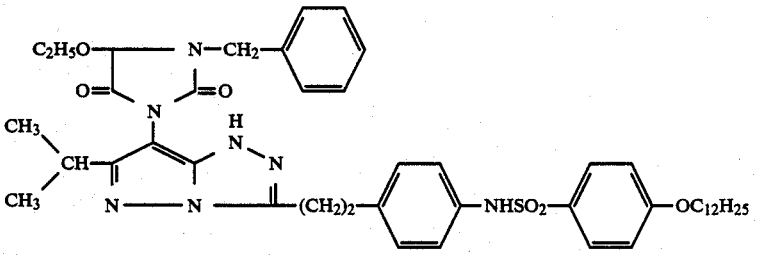
37
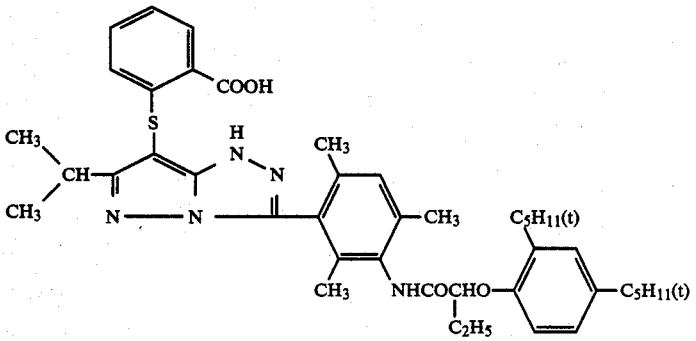

-continued
38
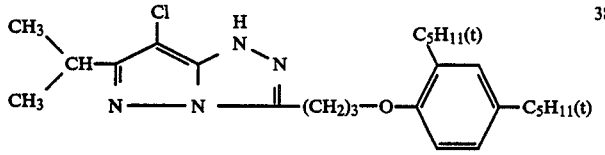
39
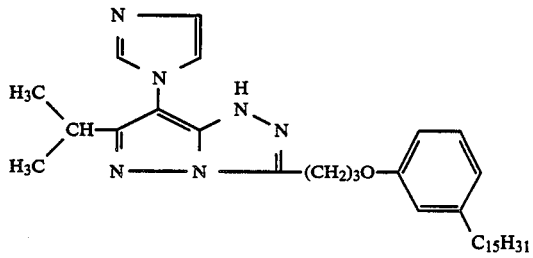
40
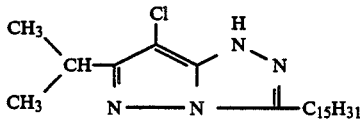
41
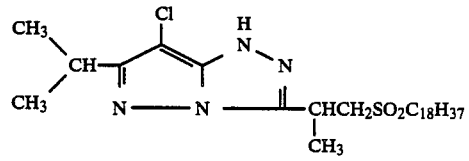
42
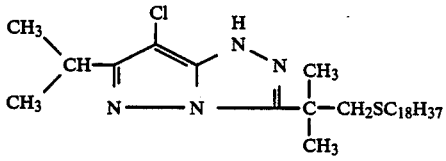
43
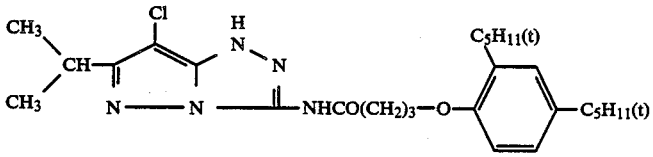
44
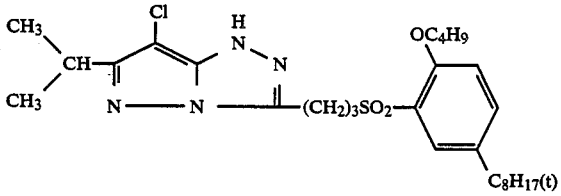
45
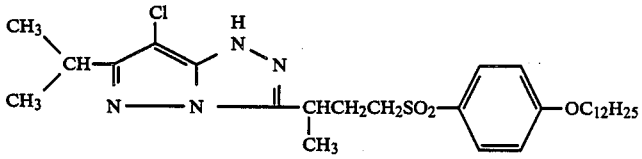
46
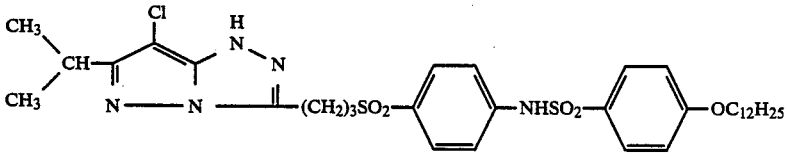
47
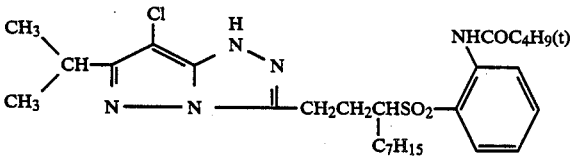
48
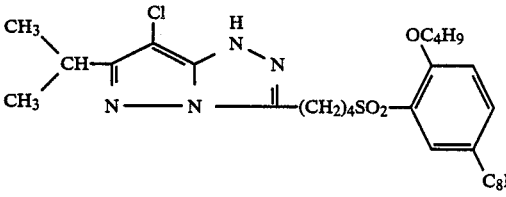
49
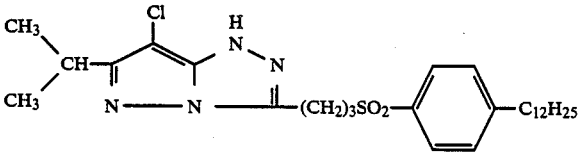

-continued
50
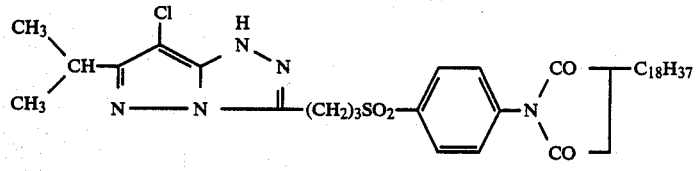
51
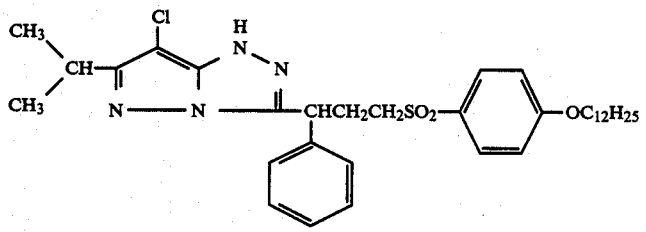
52
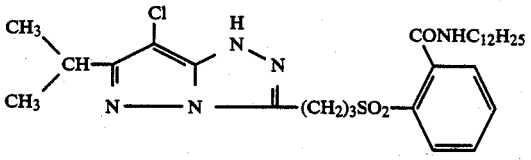
53
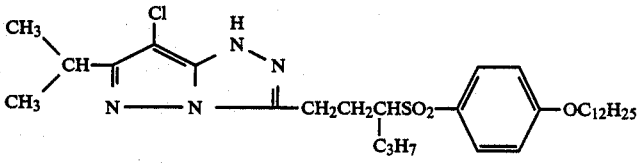
54
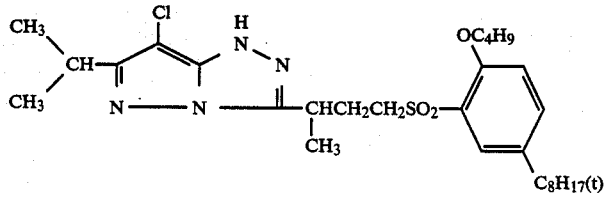
55
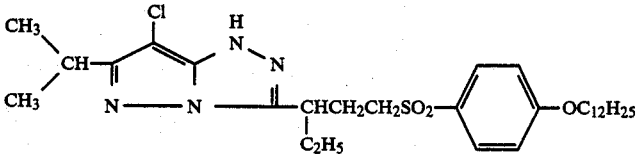
56
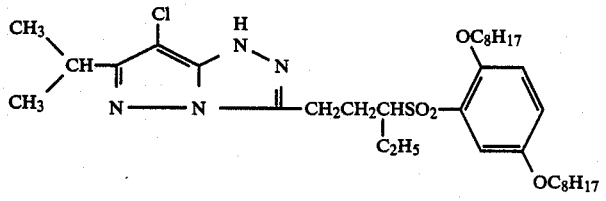
57
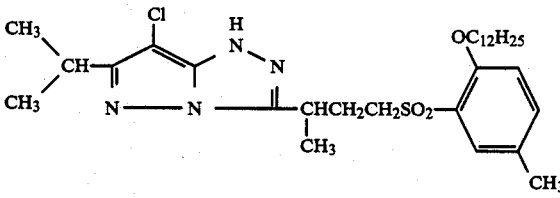
58
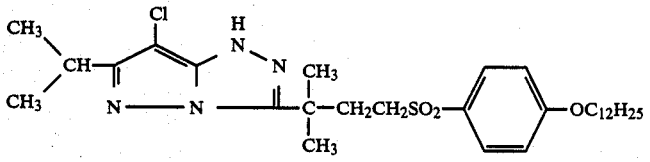

-continued
59
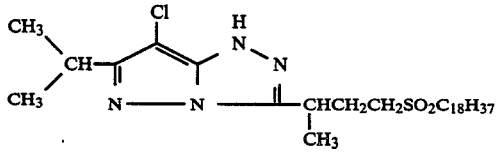
60
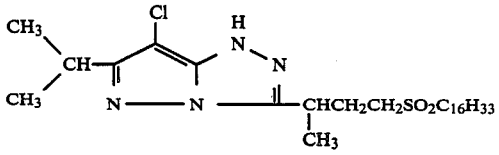
61
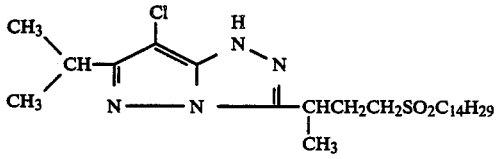
62
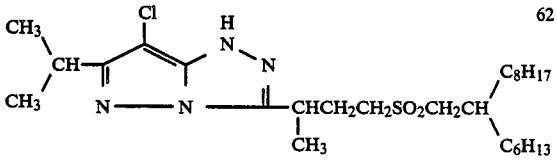
63
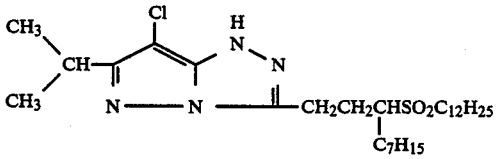
64
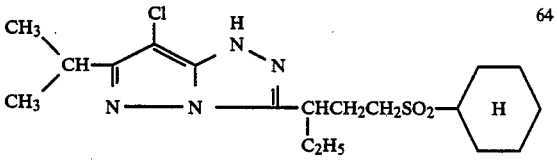
65
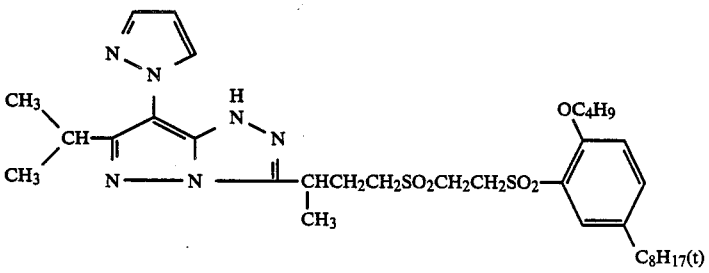
66
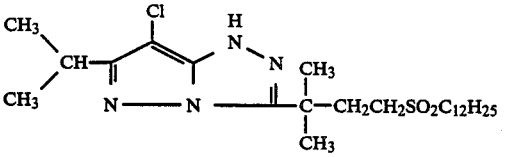
67
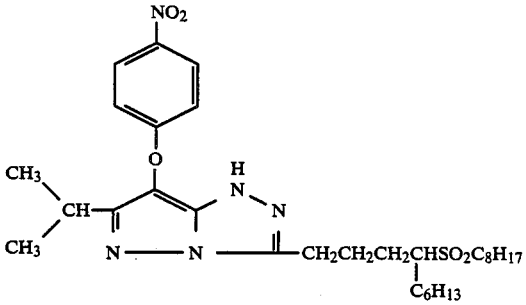
68
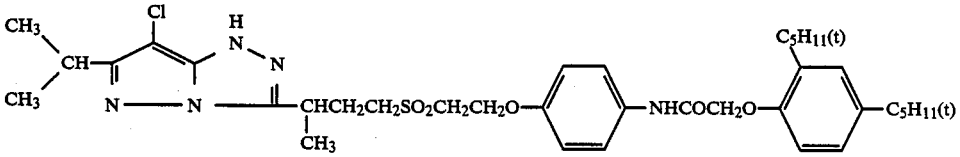
69
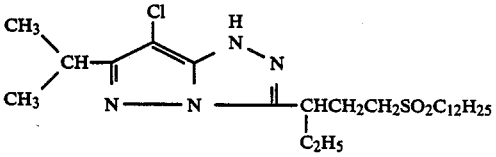
70
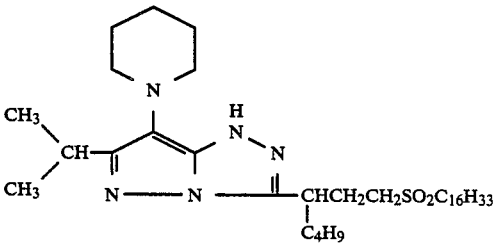

-continued
71
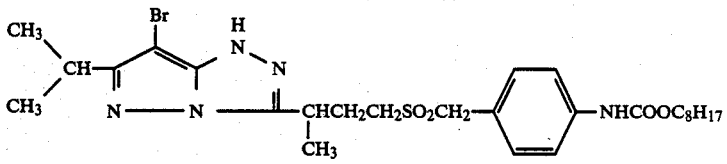
72
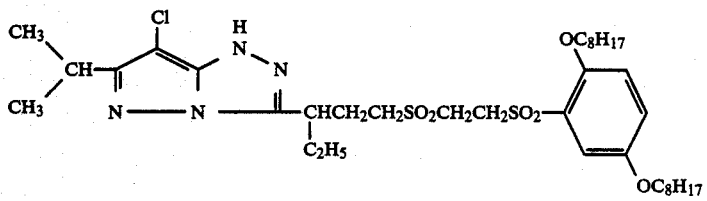
73
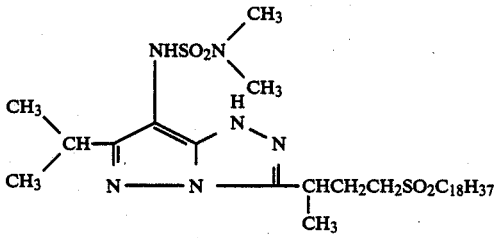
74
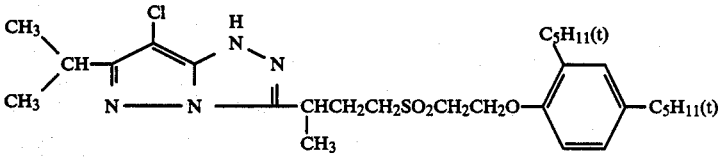
75
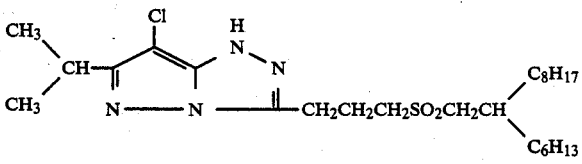
76
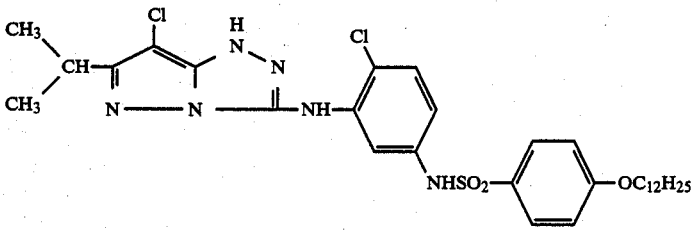
77
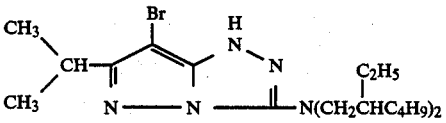
78
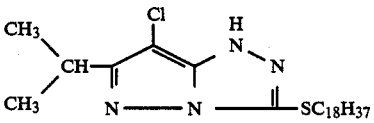
79
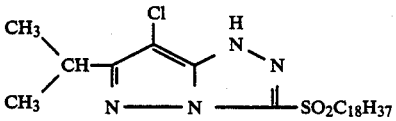
80
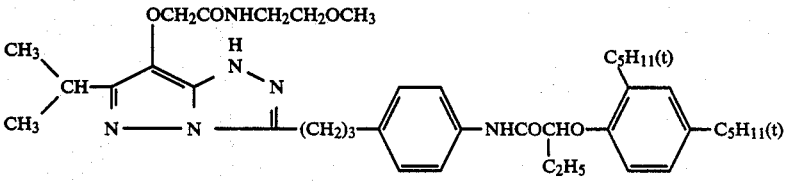

-continued
81
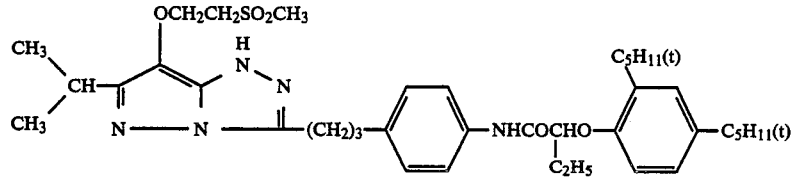
82
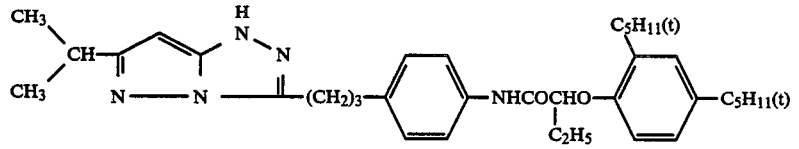
83
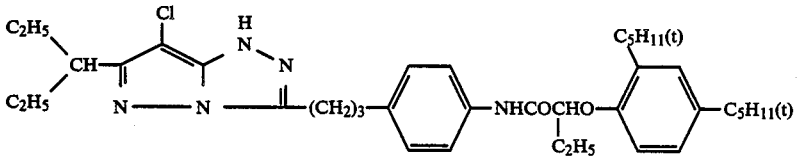
84
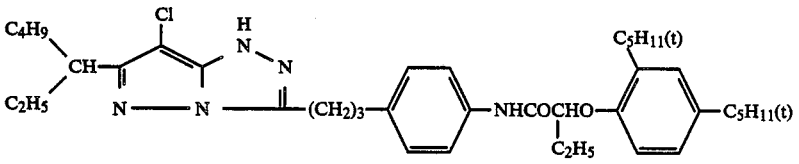
85
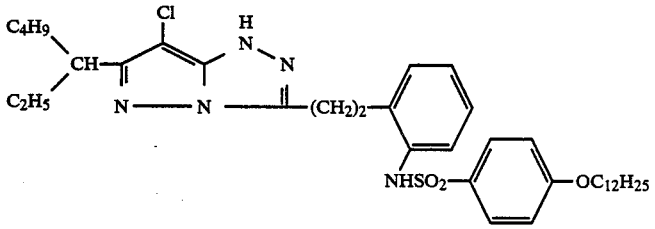
86
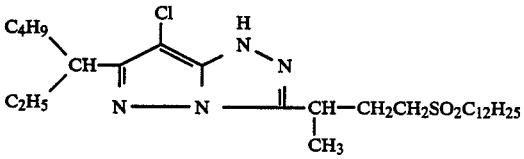
87
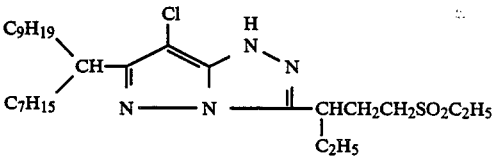
88
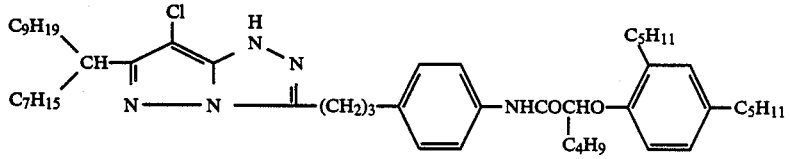
89
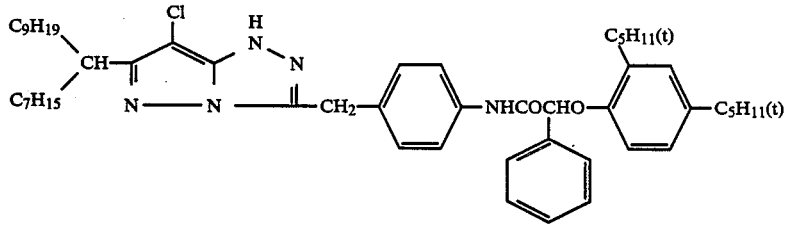
90
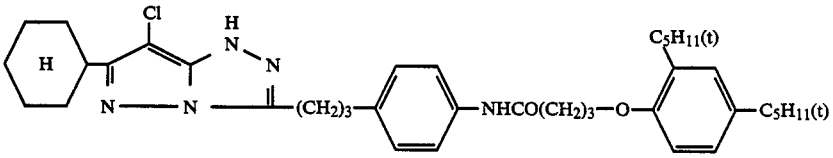

-continued
91
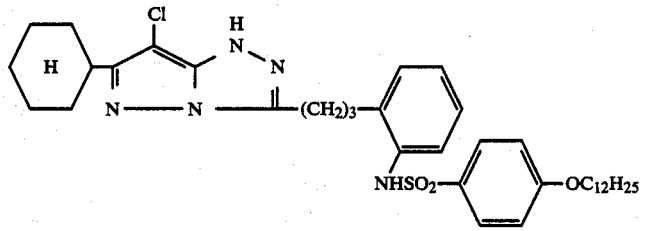
92
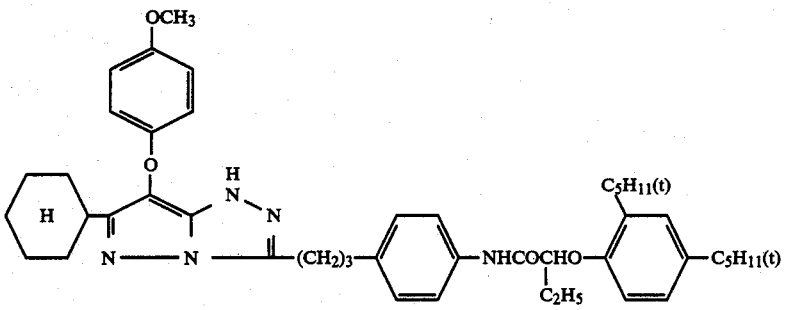
93
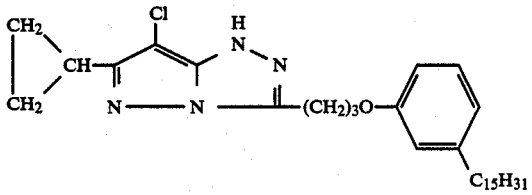
94
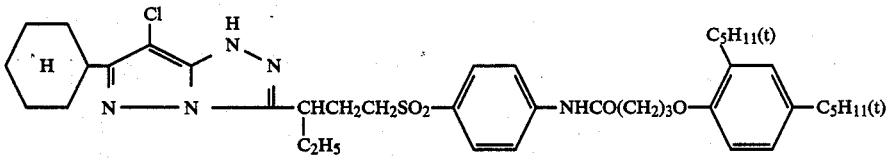
95
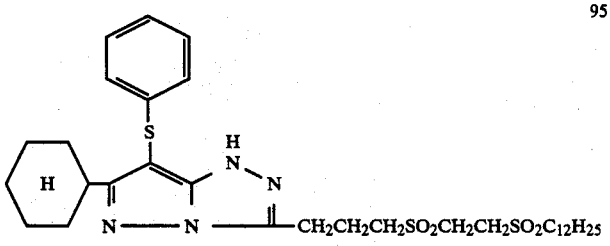
96
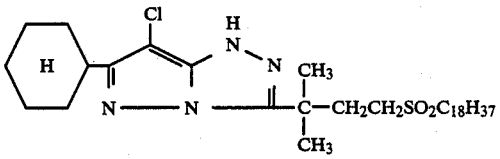
97
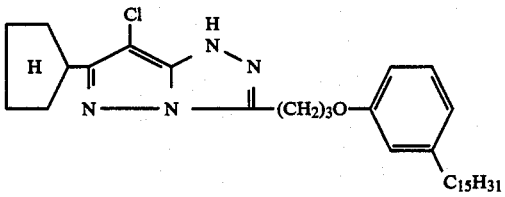
98
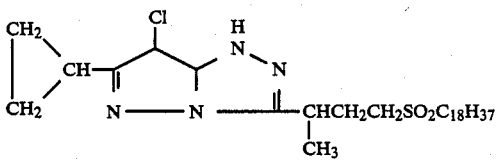
99
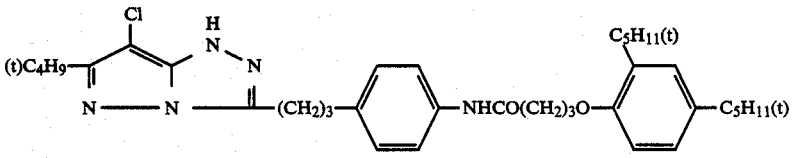

-continued
100
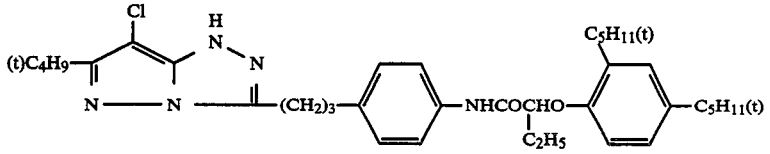
101
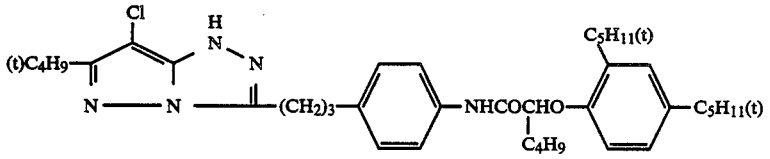
102
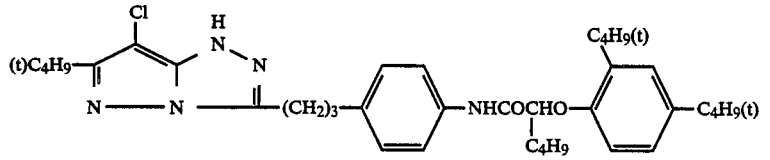
103
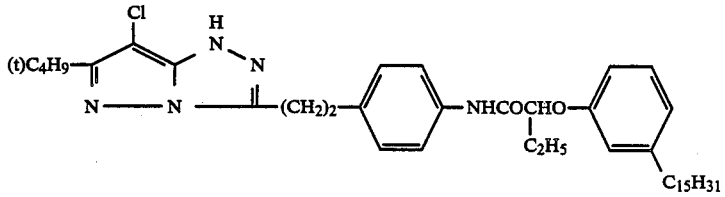
104
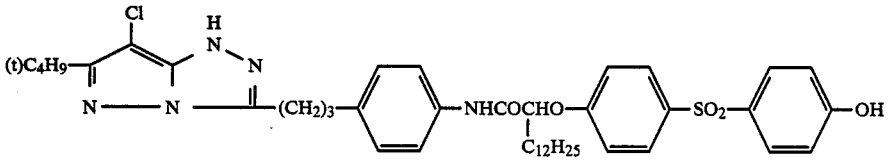
105
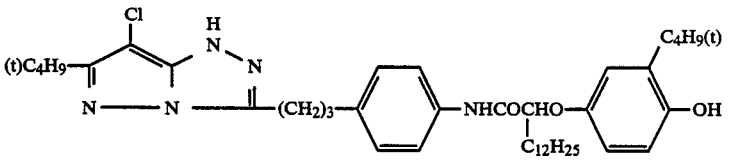
106
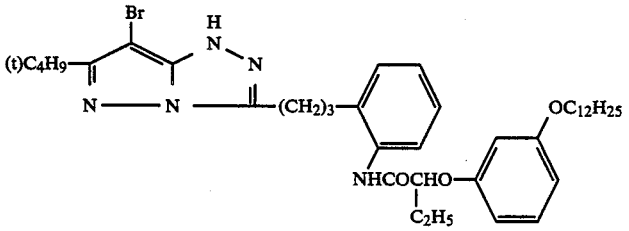
107
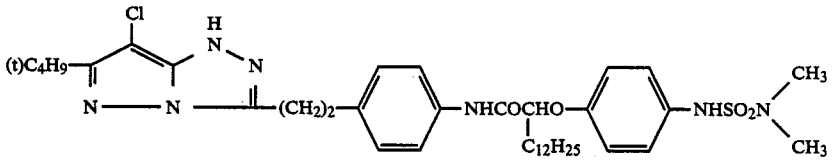
108
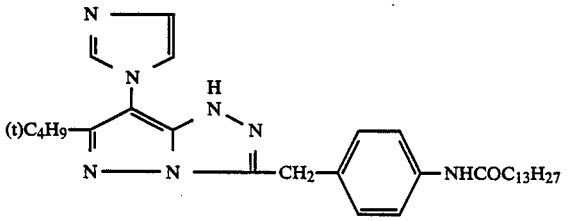

-continued
109
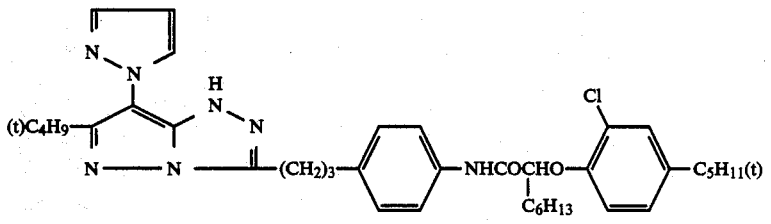
110
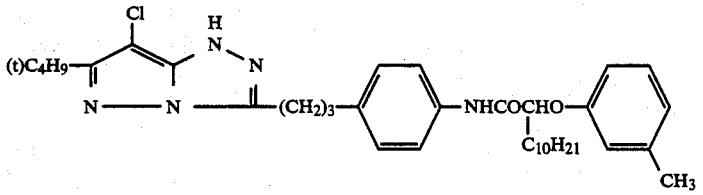
111
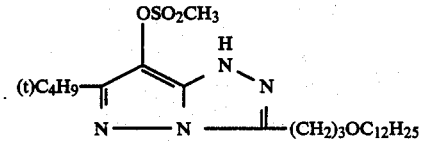
112
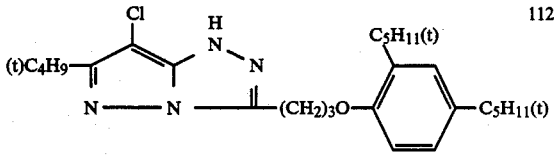
113
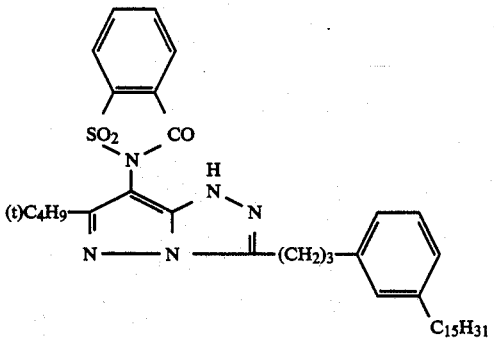
114
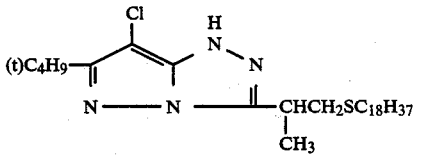
115
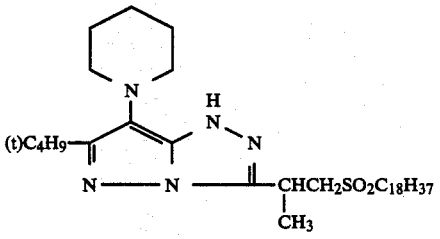
116
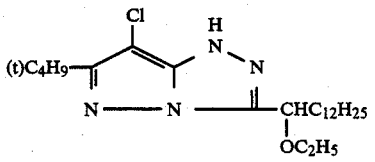
117
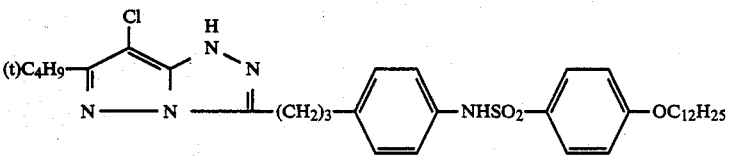

-continued
118
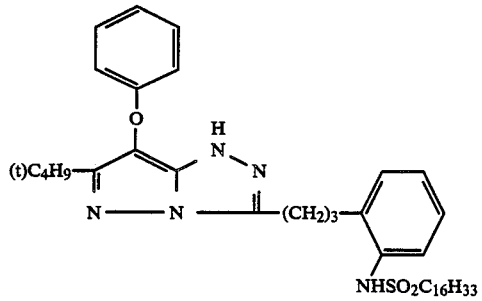
119
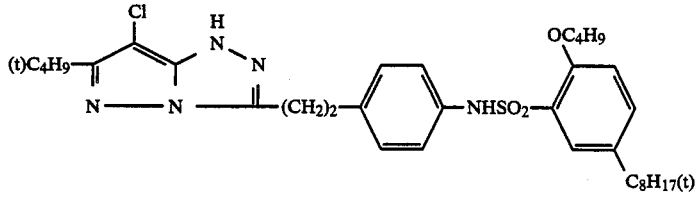
120
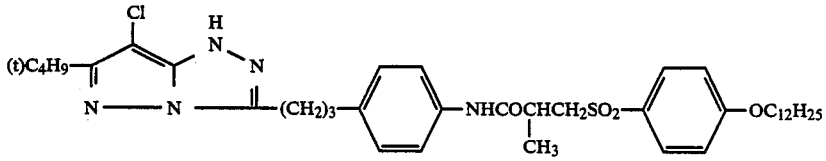
121
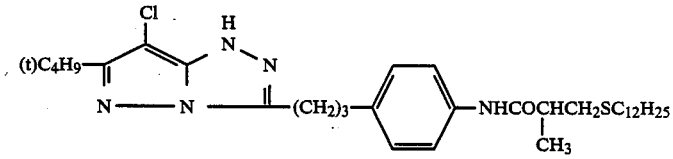
122
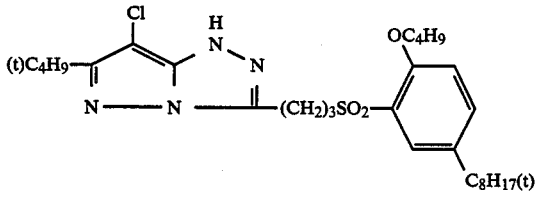
123
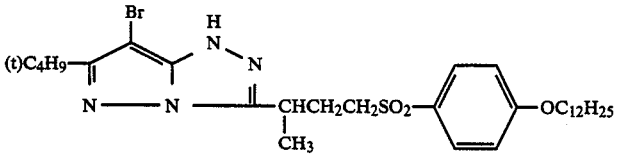
124
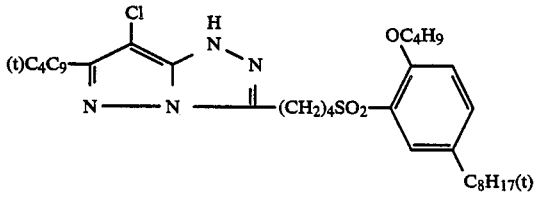

-continued
125
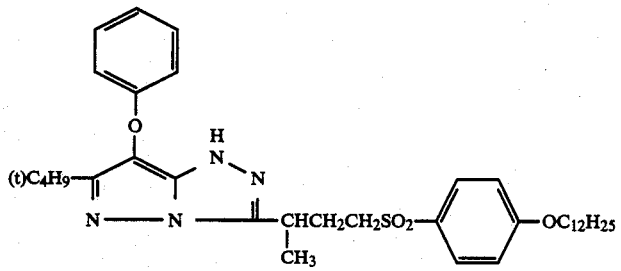
126
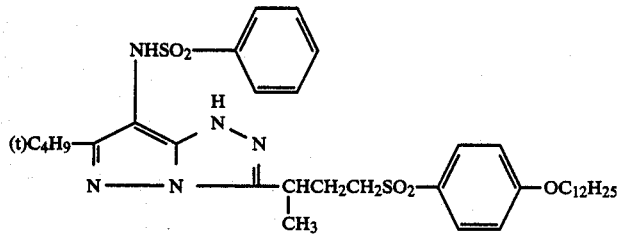
127
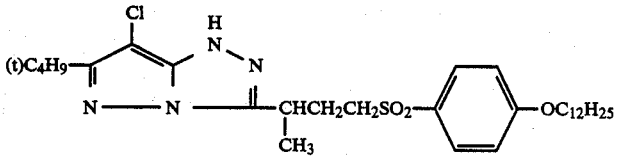
128
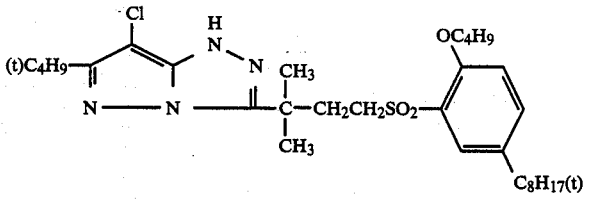
129
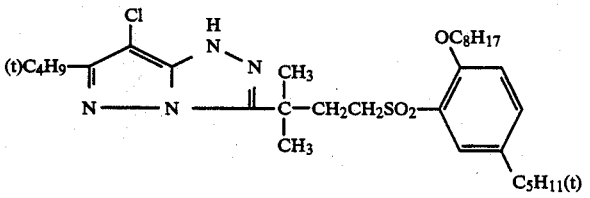
130
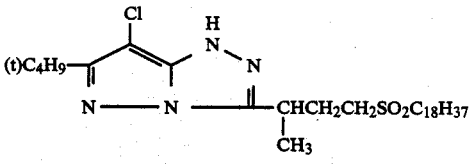
131
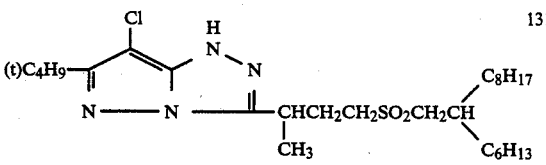
132
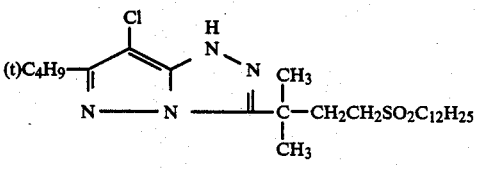
133
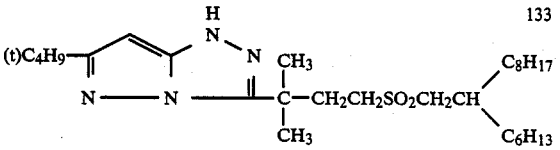

-continued
134
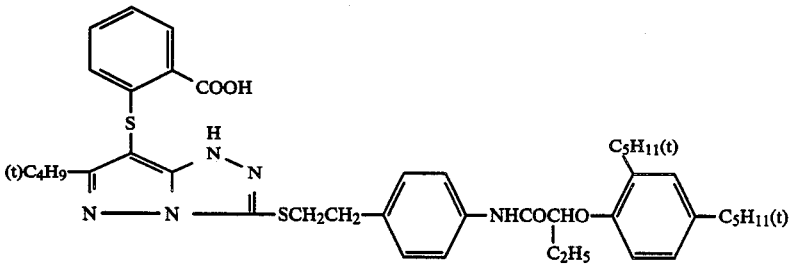
135
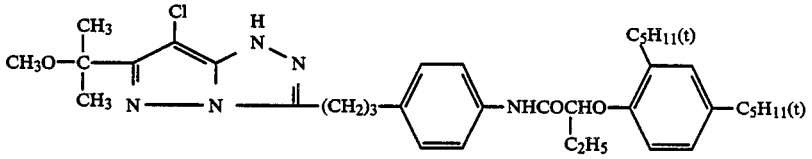
136
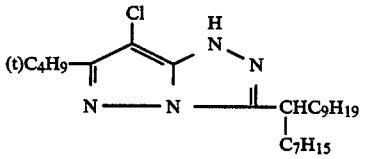
137
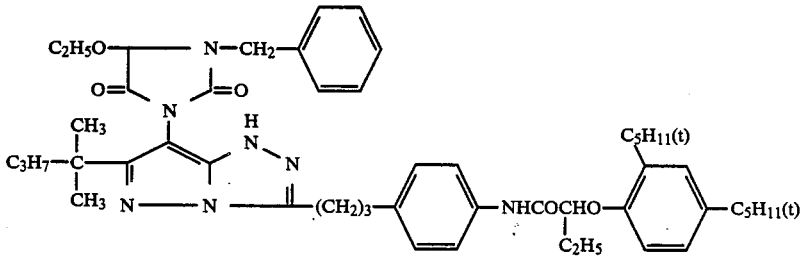
138
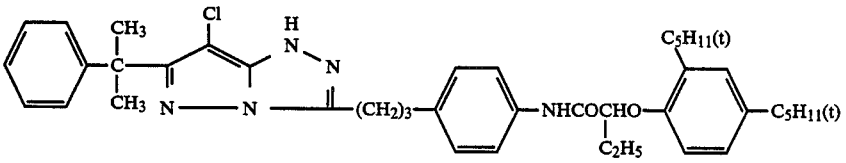
139
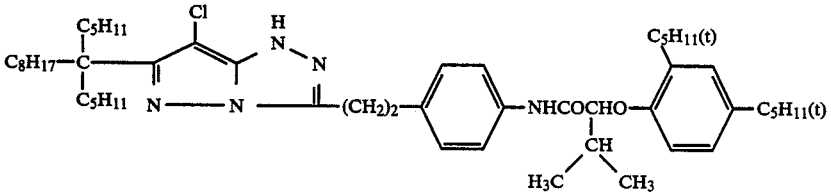
140
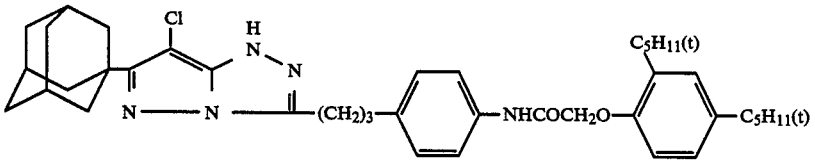
141
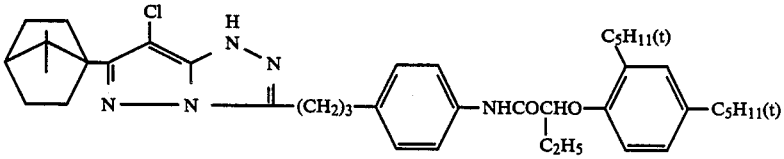

-continued
142
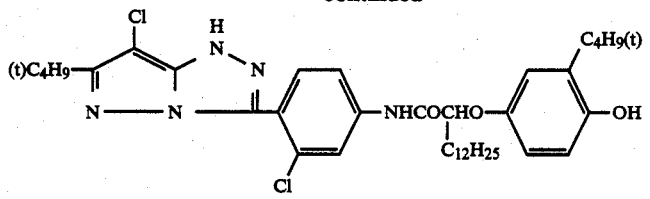
143
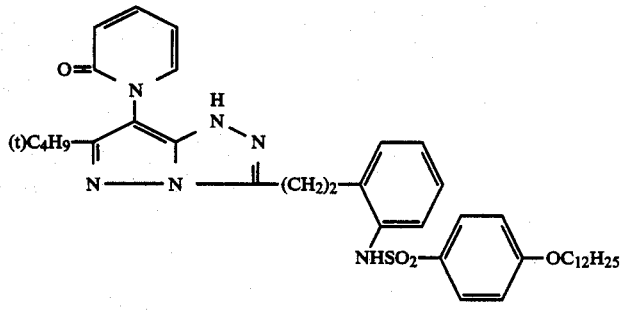
144
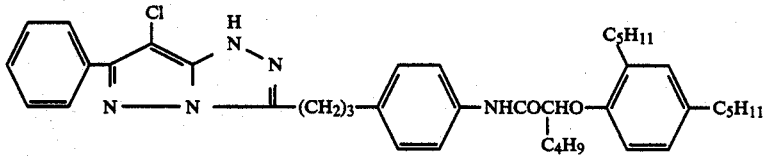
145
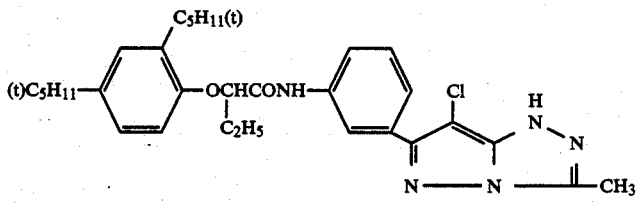
146
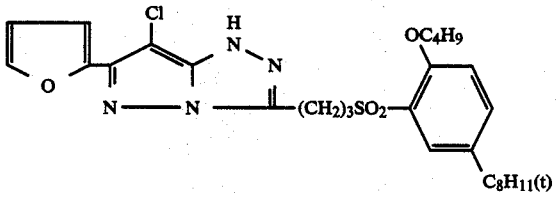
147
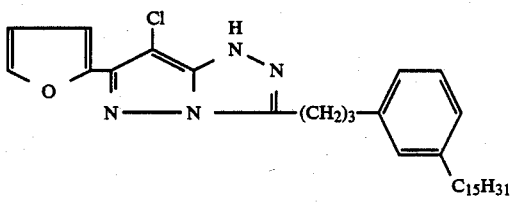
148
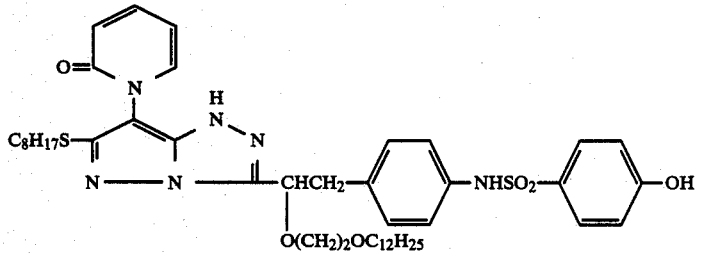
149
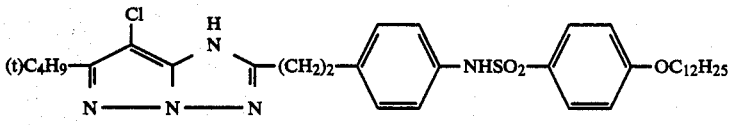
150
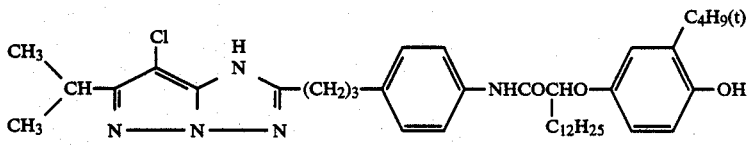

-continued
151
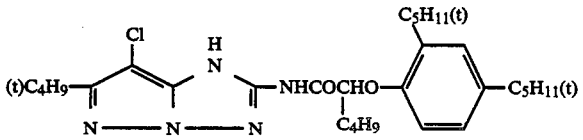
152
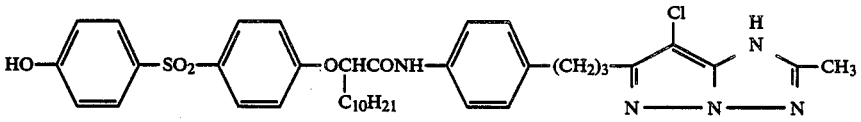
153
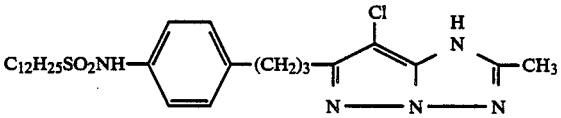
154
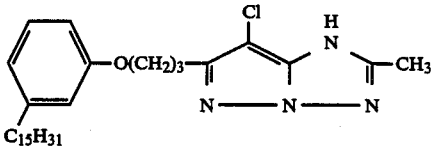
155
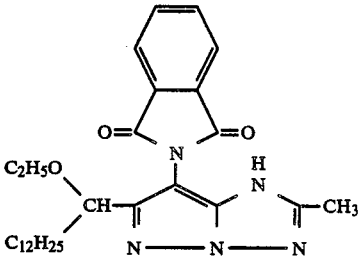
156
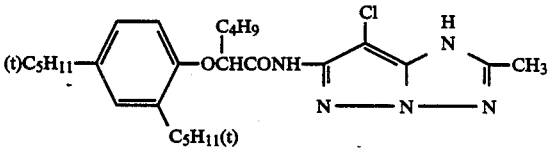
157
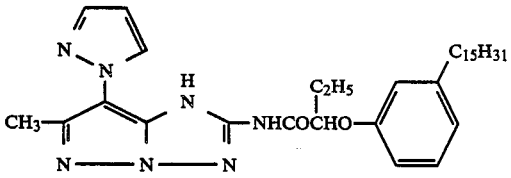
158
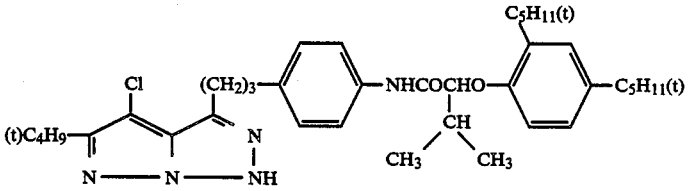
159
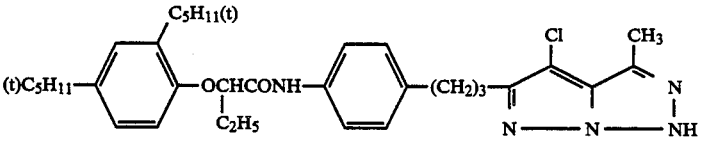
160
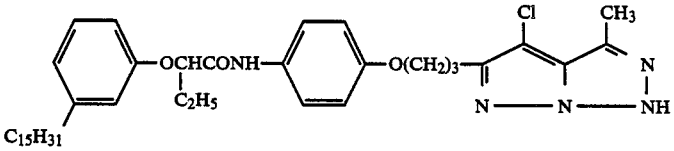
161
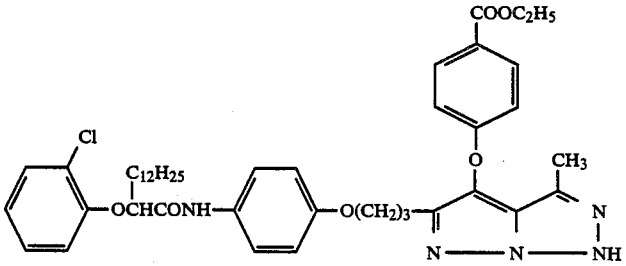

-continued
162
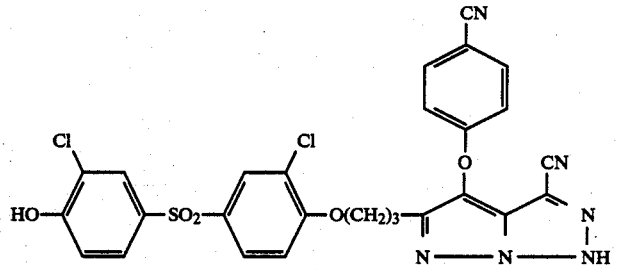
163
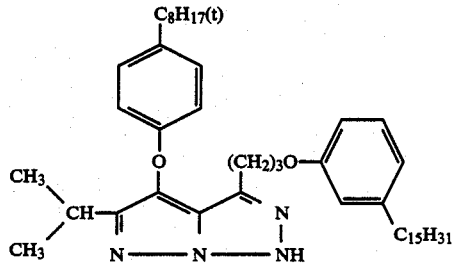
164
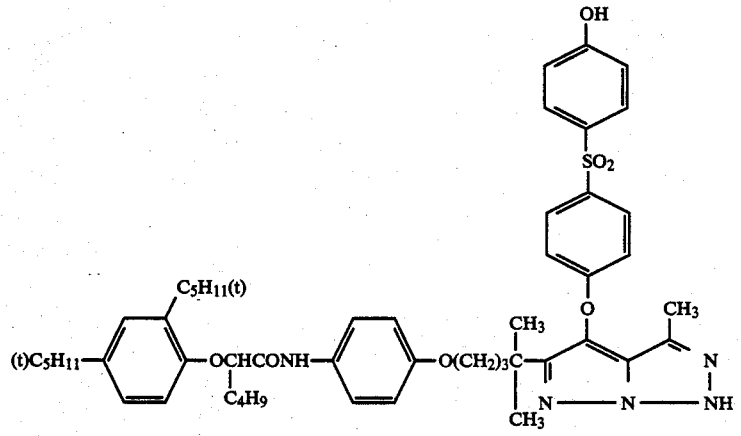
165
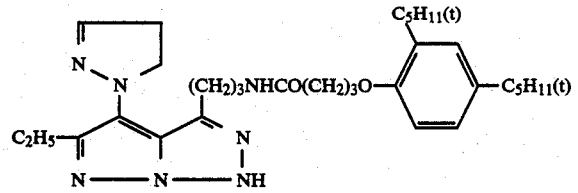
166
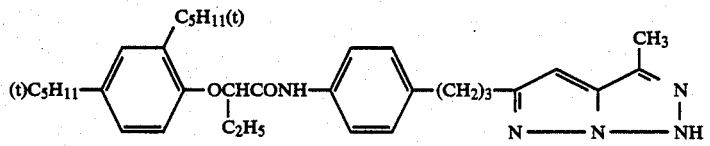
167
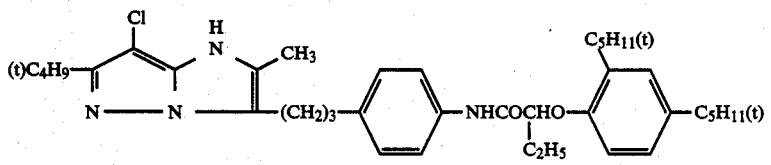
168
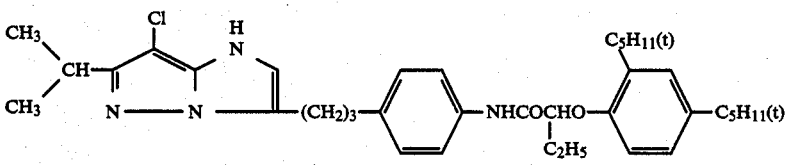

-continued
169
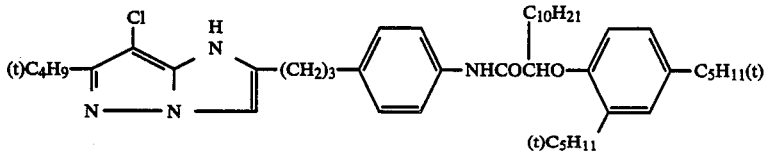
170
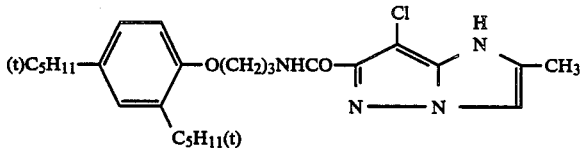
171
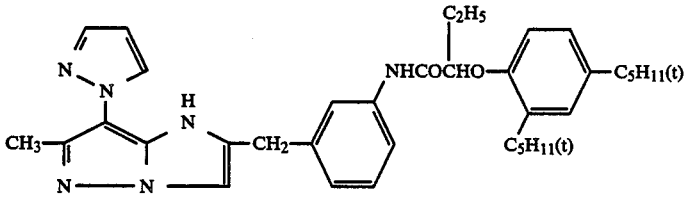
172
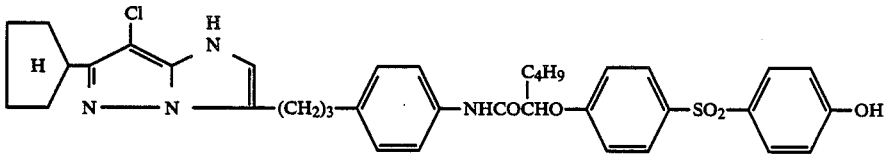
173
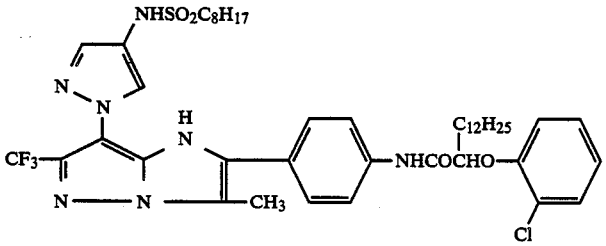
174
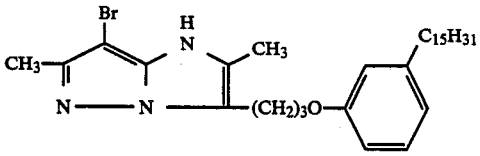
175
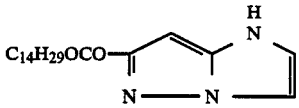
176
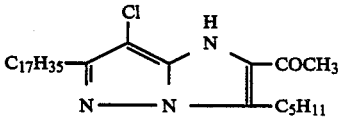
177
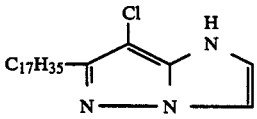
178
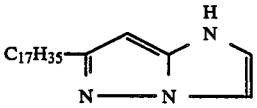
179
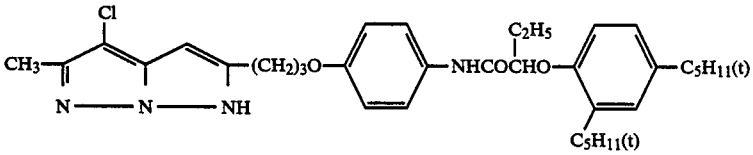

-continued
180
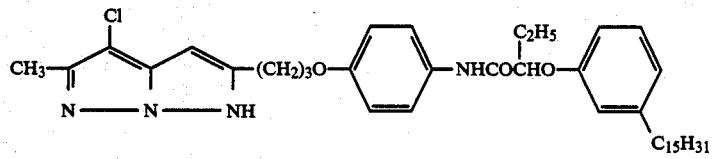
181
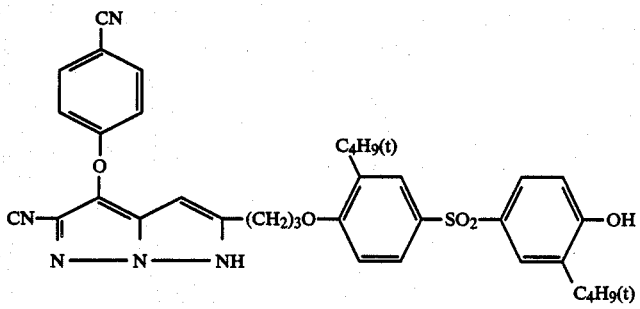
182
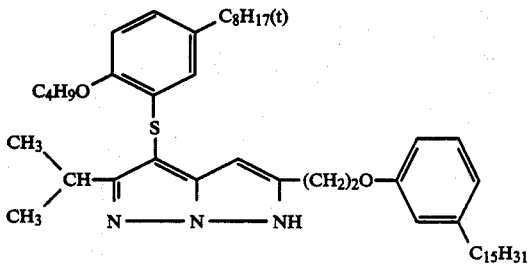
183
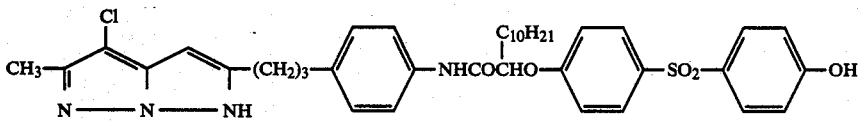
184
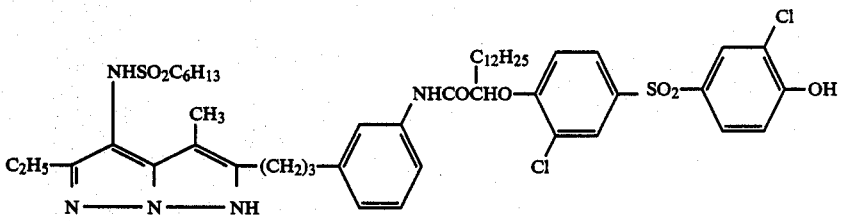
185
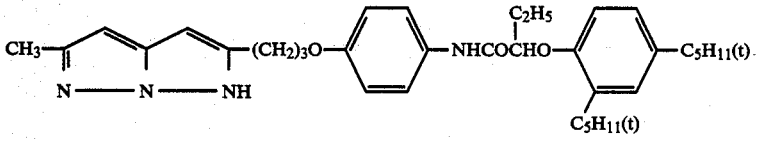
186
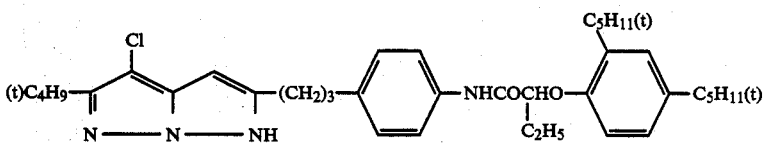
187
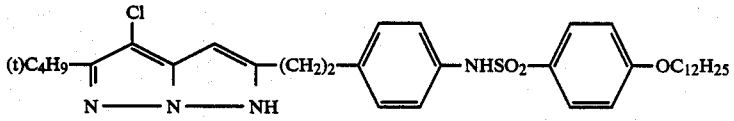

-continued
188
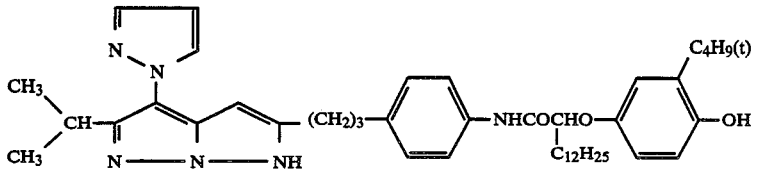
189
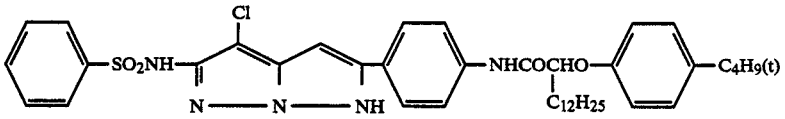
190
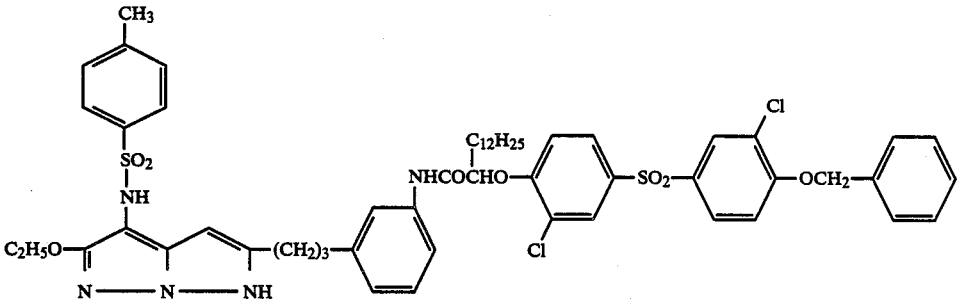
191
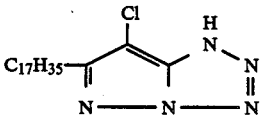
192
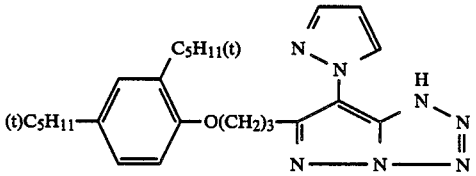
193
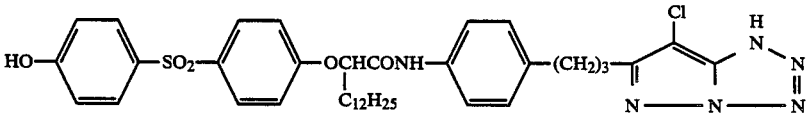
194
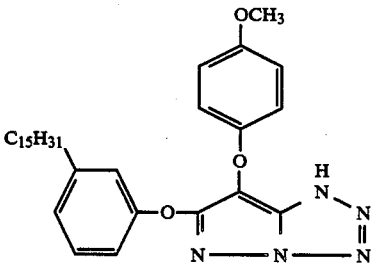
195
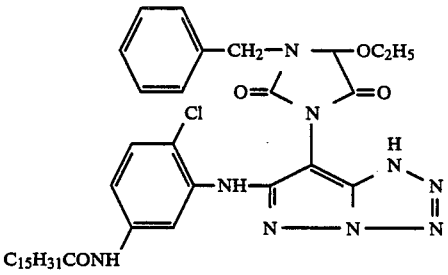
196
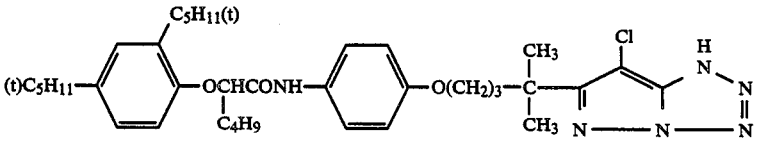
197
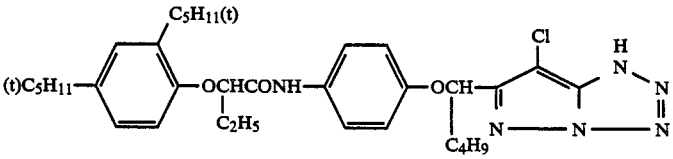

-continued

198

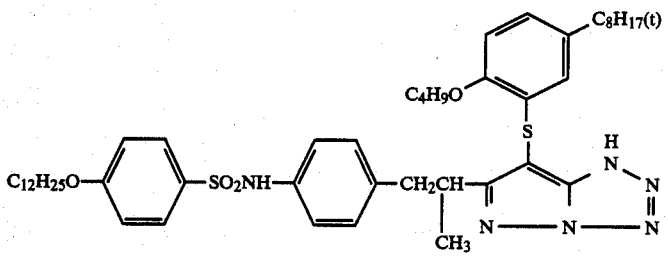

199

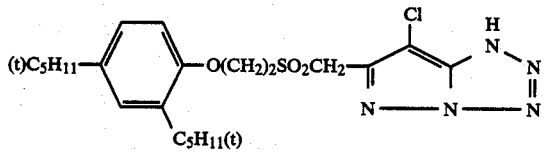

Syntheses of the above representative couplers were carried out by making reference to Journal of the Chemical Society, Perkin I, 1977, pp 2047-2052, U.S. Pat. No. 3,725,067 and Japanese Unexamined Patent Publications No. 99437/1984 and No. 42045/1983, No. 162548/1984, No. 171956/1984, No. 33552/1985, No. 43659/1985, etc.

The couplers of this invention may be used usually in the range of $1\times10^{-3}$ mole to 1 mole, preferably $1\times10^{-2}$ mole to $8\times10^{-1}$ mole, per mole of silver halide.

The couplers of this invention may also be used in combination with other kinds of magenta couplers.

As for the discoloration preventive agent which may be used in this invention in the same photographic layer as the layer containing the magenta coupler represented by Formula (I) (referred to hereinafter as "coupler of this invention"), any of compounds which can prevent the discoloration of the dye images formed through the coupler of this invention may be used, but the discoloration preventive agent which can be used with desired results may include the compounds represented by Formulas (A) to (H) and (J) to (N) shown below:

Formula (A)

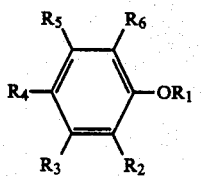

In the formula, $R^1$ represents a hydrogen atom, an alkyl group, an alkenyl group, an aryl group or a heterocyclic group; $R^2$, $R^3$, $R^5$ and $R^6$ each represent a hydrogen atom, a halogen atom, a hydroxyl group, an alkyl group, an alkenyl group, an ary group, an alkoxy group or an acylamino group; $R^4$ represents an alkyl group, a hydroxyl group, an aryl group or an alkoxy group. $R^1$ and $R^2$ may be ring-closed each other to form a 5- or 6-membered ring, whereat $R^4$ represents a hydroxyl group or an alkoxy group. Also, $R^3$ and $R^4$ may be ring-closed to form a hydrocarbon ring of 5 members, whereat $R^1$ represents an alkyl group, an aryl group or a heterocyclic group, except the case where $R^1$ is a hydrogen atom and $R^4$ is a hydroxyl group.

In the above Formula (A), wherein $R^1$ represents a hydrogen atom, an alkyl group, an alkenyl group, an aryl group or a heterocyclic group, the alkyl group may include, for example, straight-chain or branched alkyl groups such as a methyl group, an ethyl group, a propyl group, n-octyl group, tert-octyl group and hexadecyl group. The alkenyl group represented by $R^1$ may include, for example, an ally group, a hexenyl group, an octenyl group, etc. Further, the aryl group represented by $R^1$ may include each of a phenyl group and a naphthyl group. Further, the heterocyclic group represented by $R^1$ may include, specifically, a tetrahydropyranyl group, a pyrimidyl group, etc. These groups may each have a substituent. For example, as the alkyl group having a substituent, it may include a benzyl group and an ethoxymethyl group; as the aryl group having a substituent, a methoxyphenyl group, a chlorophenyl group, a 4-hydroxy-3,5-dibutylphenyl group, etc.

In Formula (A), wherein $R^2$, $R^3$, $R^5$ and $R^6$ each represent a hydrogen atom, a halogen atom, a hydroxyl group, an alkyl group, an alkenyl group, an aryl group, an alkoxy group or an acylamino group, the alkyl group, the alkenyl group and the aryl group of these may include the alkyl group, the alkenyl group and the aryl group mentioned for the above $R^1$. Also, the above halogen atom may include, for example, fluorine, chlorine, bromine, etc. Further, the above alkoxy group may include specifically a methoxy group, an ethoxy group, etc. Further, the above acylamino group is represented by R'CONH—, wherein R' represents an alkyl group (for example, groups such as methyl, ethyl, n-propyl, n-butyl, n-octyl, tert-octyl and benzyl), an alkenyl group (for example, groups such as allyl, octinyl and oleyl), an aryl group (for example, groups such as phenyl, methoxyphenyl and naphthyl) or a heterocyclic group (for example, groups such as pyridyl and pyrimidyl).

In the above Formula (A), wherein $R^4$ represents an alkyl group, a hydroxyl group, an aryl group or an alkoxy group, the alkyl group and the aryl group may include specifically those same as in the alkyl group and the aryl group represented by the above $R^1$. Also, the alkenyl group represented by $R^4$ may include those same as in the alkoxy group mentioned for the above $R^2$, $R^3$, $R^5$ and $R^6$.

The ring formed together with a benzene by ring closure of $R^1$ and $R^2$ may include, for example, chroman, coumaran and methylenedioxybenzene. Also, the ring formed together with a benzene ring by ring closure of $R^3$ and $R^4$ may include, for example, indane.

These rings may have a substituent (for example, alkyl, alkoxy and aryl).

An atom in the ring formed by ring closure of $R^1$ and $R^2$ or ring closure of $R^3$ and $R^4$ may be a spiro atom to form a spiro compound, or $R^2$ and $R^4$ may be a linking group to form a bis body.

Of the phenol series compounds and the phenylether series compounds represented by the above Formula (A), preferable is a biindane compound having four RO— groups (wherein R represents an alkyl group, an alkenyl group, an aryl group or a heterocyclic group), particularly preferable is a compound represented by Formula (A-1) shown below:

Formula (A-1)

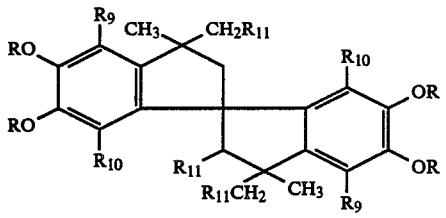

In the formula, R represents an alkyl group (for example, methyl, ethyl, propyl, n-octyl, tert-octyl, benzyl and hexadecyl), an alkenyl group (for example, allyl, octenyl and oleyl), an aryl group (for example, phenyl and naphthyl) or a heterocyclic group (for example, tetrahydropyranyl and pyrimidyl). $R^9$ and $R^{10}$ each represent a hydrogen atom, a halogen atom (for example, fluorine, chlorine and bromine), an alkyl group (for example, methyl, ethyl, n-butyl and benzyl), an alkoxy group (for example, allyl, hexenyl and octenyl) or an alkoxy group (for example, methoxy, ethoxy and benzyloxy); $R^{11}$ represents a hydrogen atom, an alkyl group (for example, methyl, ethyl, n-butyl and benzyl), an alkenyl group (for example, 2-propenyl, hexenyl and octenyl) or an aryl group (for example, phenyl, methoxyphenyl, chlorophenyl and naphthyl).

The compound represented by the above Formula (A) may also include the compounds disclosed in U.S. Pat. No. 3,935,016, No. 3,982,944 and No. 4,254,216, Japanese Unexamined Patent Publications No. 211004/1980 and No.145530/1979, British Patent Publications No. 2,077,455 and No. 2,062,888, U.S. Pat. No. 3,764,337, No. 3,432,300, No. 3,574,627 and No. 3,573,050, Japanese Unexamined Patent Publications No. 152225/1977, No. 20327/1978, No. 17729/1978 and No. 6321/1980, British Pat. No. 1,347,556, British Patent Publication No.2,066,975, Japanese Patent Publications No. 12337/1979 and No. 31625/1973, U.S. Pat. No. 3,700,455, etc.

The compound represented by the above Formula (A) may be used in an amount of 5 to 300 mole %, preferably 10 to 200 mole % based on the magenta coupler.

Typical examples of the compound represented by Formula (A) are shown below:

Type (1)

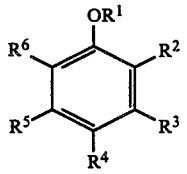

Type (2)

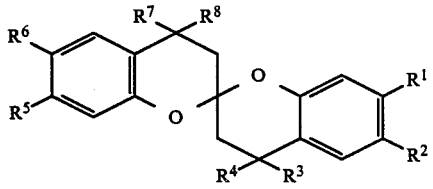

Type (3)

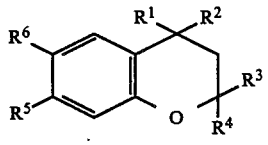

Type (4)

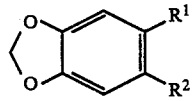

Type (5)

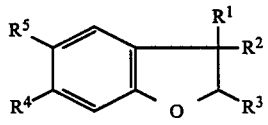

Type (6)

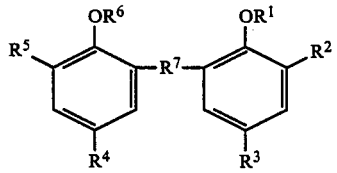

Type (7)

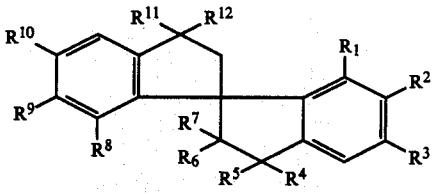

Type (4)

| Comp. No. | $R^1$ | $R^2$ |
|---|---|---|
| A-4 | $C_3H_7$ | 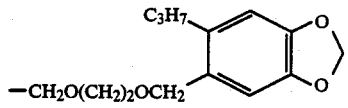 |
| A-9 | $C_3H_7$ | $-CH_2O(CH_2)_2OC_4H_9$ |

Type (1)

| Comp. No. | $R^1$ | $R^2$ | $R^3$ | $R^4$ | $R^5$ | $R^6$ |
|---|---|---|---|---|---|---|
| A-1 | H | OH | $-C(CH_3)_2CH_2C(CH_3)_3$ | $CH_3O$ | H | $-C(CH_3)_2CH_2C(CH_3)_3$ |
| A-8 | $C_8H_{17}$ | $C(CH_3)_2C_2H_5$ | H | $C_8H_{17}O$ | $C(CH_3)_2C_2H_5$ | H |
| A-14 | H | H | OH | $C(CH_3)_2CH_2C(CH_3)_3$ | H | H |
| A-16 | H | $C(CH_3)_2C_3H_7$ | H | $CH_3O$ | $C(CH_3)_2C_3H_7$ | H |

Type (2)

| Comp. No. | $R^1$ | $R^2$ | $R^3$ | $R^4$ | $R^5$ | $R^6$ | $R^7$ | $R^8$ |
|---|---|---|---|---|---|---|---|---|
| A-2 | $CH_3$ | OH | $CH_3$ | $CH_3$ | $CH_3$ | OH | $CH_3$ | $CH_3$ |
| A-10 | $CH_3$ | $OCH_3$ | $CH_3$ | $CH_3$ | $CH_3$ | $CH_3O$ | $CH_3$ | $CH_3$ |

Type (5)

| Comp. No. | $R^1$ | $R^2$ | $R^3$ | $R^4$ | $R^5$ |
|---|---|---|---|---|---|
| A-5 | $CH_3$ | $CH_3$ | $C_2H_5O$ | $(t)C_8H_{17}$ | OH |

Type (3)

| Comp. No. | $R^1$ | $R^2$ | $R^3$ | $R^4$ | $R^5$ | $R^6$ |
|---|---|---|---|---|---|---|
| A-3 | $CH_3$ | $CH_3$ | H | $CH_3$ | $(t)C_8H_{17}$ | OH |
| A-11 | $CH_3$ | $CH_3$ | H | $CH_3$ | $(t)C_8H_{17}$ | $C_8H_{17}O$ |
| A-12 | $CH_3$ | $CH_3$ | H | $CH_3$ | $CH_3$ | $O(CH_2)_2OC_{10}H_{21}$ |
| A-17 | H | $CH_3$ | $CH_3$ | $CH_3$ | $(t)C_8H_{17}$ | OH |
| A-18 | $CH_3$ | $CH_3$ | $CH_3$ | 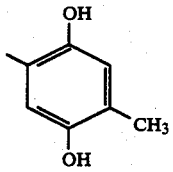 | $CH_3$ | OH |

Type (6)

| Comp. No. | $R^1$ | $R^2$ | $R^3$ | $R^4$ | $R^5$ | $R^6$ | $R^7$ |
|---|---|---|---|---|---|---|---|
| A-6 | H | $(t)C_4H_9$ | $CH_3$ | $CH_3$ | $(t)C_4H_9$ | H | $CH_2$ |
| A-15 | $CH_3$ | $(t)C_4H_9$ | $CH_3$ | $CH_3$ | $(t)C_4H_9$ | $CH_3$ | $CH_2$ |

Type (7)

| Comp. No. | $R^1$ | $R^2$ | $R^3$ | $R^4$ | $R^5$ | $R^6$ |
|---|---|---|---|---|---|---|
| A-13 | H | $C_3H_7O$ | $C_3H_7O$ | $CH_3$ | $CH_3$ | H |
| A-19 | H | $CH_3O$ | $CH_3O$ | $CH_3$ | $CH_3$ | H |
| A-20 | $CH_3$ | $C_4H_9O$ | $C_4H_9O$ | $CH_3$ | $CH_3$ | H |
| A-21 | H | $C_2H_5O$ | $C_2H_5O$ | $CH_3$ | $CH_3$ | H |
| A-22 | H | $CH_3O$ | $CH_3O$ | $C_2H_5$ | $CH_3$ | H |
| A-23 | H | $C_7H_{15}COO$ | $C_7H_{15}COO$ | $CH_3$ | $CH_3$ | H |
| A-24 | H | $C_4H_9O$ | $C_4H_9O$ | $CH_3$ | $CH_3$ | H |
| A-25 | H | $CH_3O(CH_2)_2O$ | $CH_3O(CH_2)_2O$ | $CH_3$ | $CH_3$ | H |
| A-26 | H | $CH_2{=}CHCH_2O$ | $CH_2{=}CHCH_2O$ | $CH_3$ | $CH_3$ | H |
| A-27 | H | $C_3H_7O$ | $C_3H_7O$ | $C_6H_5CH_2$ | $CH_3$ | $C_6H_5$ |
| A-28 | $CH_3O$ | $C_4H_9O$ | $C_4H_9O$ | $CH_3$ | $CH_3$ | H |
| A-29 | H | $(s)C_5H_{11}O$ | $(s)C_5H_{11}O$ | $CH_3$ | $CH_3$ | H |

-continued

| Type (7) | | | | | | |
|---|---|---|---|---|---|---|
| A-30 | H | $C_4H_9O$ | $C_4H_9O$ | (i)$C_3H_7$ | $CH_3$ | $CH_3$ |
| A-31 | H | $C_{18}H_{37}O$ | $C_{18}H_{37}O$ | $CH_3$ | $CH_3$ | H |
| A-32 | H | $C_6H_5CH_2O$ | $C_6H_5CH_2O$ | $CH_3$ | $CH_3$ | H |

| Comp. No. | $R^7$ | $R^8$ | $R^9$ | $R^{10}$ | $R^{11}$ | $R^{12}$ |
|---|---|---|---|---|---|---|
| A-13 | H | H | $C_3H_7O$ | $C_3H_7O$ | $CH_3$ | $CH_3$ |
| A-19 | H | H | $CH_3O$ | $CH_3O$ | $CH_3$ | $CH_3$ |
| A-20 | H | $CH_3$ | $C_4H_9O$ | $C_4H_9O$ | $CH_3$ | $CH_3$ |
| A-21 | H | H | $C_2H_5O$ | $C_2H_5O$ | $CH_3$ | $CH_3$ |
| A-22 | $CH_3$ | H | $CH_3O$ | $CH_3O$ | $CH_3$ | $C_2H_5$ |
| A-23 | H | H | $C_7H_{15}COO$ | $C_7H_{15}COO$ | $CH_3$ | $CH_3$ |
| A-24 | H | H | $C_4H_9O$ | $C_4H_9O$ | $CH_3$ | $CH_3$ |
| A-25 | H | H | $CH_3O(CH_2)_2O$ | $CH_3O(CH_2)_2O$ | $CH_3$ | $CH_3$ |
| A-26 | H | H | $CH_2{=}CHCH_2O$ | $CH_2{=}CHCH_2O$ | $CH_3$ | $CH_3$ |
| A-27 | H | H | $C_3H_7O$ | $C_3H_7O$ | $C_6H_5O$ | $CH_3$ |
| A-28 | H | $CH_3$ | $C_4H_9O$ | $C_4H_5O$ | $CH_3$ | $CH_3$ |
| A-29 | H | H | (s)$C_5H_{11}O$ | (s)$C_5H_{11}O$ | $CH_3$ | $CH_3$ |
| A-30 | $CH_3$ | H | $C_4H_9O$ | $C_4H_9O$ | (i)$C_3H_7$ | $CH_3$ |
| A-31 | H | H | $C_{18}H_{37}O$ | $C_{18}H_{37}O$ | $CH_3$ | $CH_3$ |
| A-32 | H | H | $C_6H_5CH_2O$ | $C_6H_5CH_2O$ | $CH_3$ | $CH_3$ |

A-7

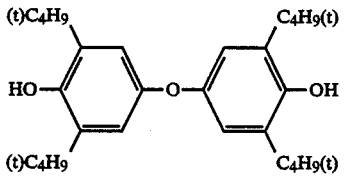

Formula (B)

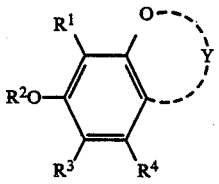

wherein, $R^1$ and $R^4$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group, or an alkoxycarbonyl group; $R^2$ represents a hydrogen atom, an alkyl group, an alkenyl group, an aryl group, an acyl group, a cycloalkyl group or a heterocyclic group; and $R_3$ represents a hydrogen atom, a halogen atom, an alkyl group, an alkenyl group, an aryl group, an aryloxy group, an acyl group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, an acyloxy group, a carbamoyl group, a sulfonamide group, a sulfamoyl group, etc.

Also, $R^2$ and $R^3$ may be ring-closed each other to form a 5- or 6-membered ring. The ring formed together with a benzene ring by the ring closure of $R^2$ and $R^3$ may include, for example, a chroman ring and a methylenedioxybenzene ring.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by Formula (B), compounds most useful for this invention are included in the compounds represented by Formulas (B-1), (B-2), (B-3), (B-4) and (B-5) shown below.

Formula (B-1)

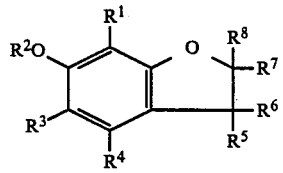

Formula (B-2)

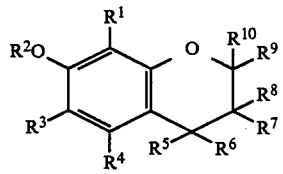

Formula (B-3)

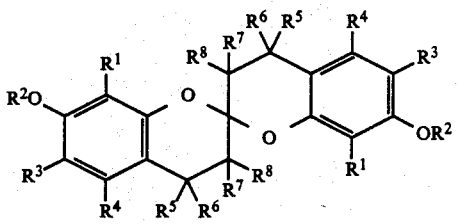

Formula (B-4)

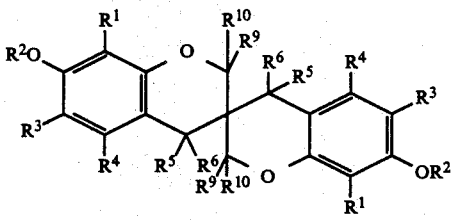

Formula (B-5)

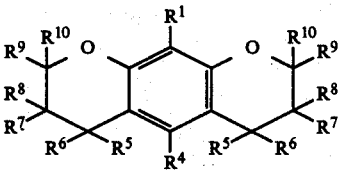

$R^1$, $R^2$, $R^3$ and $R^4$ in Formulas (B-1), (B-2), (B-3), (B-4) and (B-5) have the same meaning as those in the above Formula (B), and $R^5$, $R^6$, $R^7$, $R^8$, $R^9$ and $R^{10}$ each represents a hydrogen atom, a halogen atom, an alkyl group, an alkoxy group, a hydroxyl group, an alkenyl group, an alkenyloxy group, an aryl group, an aryloxy group or a heterocyclic group.

Also, $R^5$ and $R^6$, $R^6$ and $R^7$, $R^7$ and $R^8$, $R^8$ and $R^9$, and $R^9$ and $R^{10}$ each may be cyclized each other to form a carbon ring, and such a carbon ring may be further substituted with an alkyl group.

In the above Formulas (B-1), (B-2), (B-3), (B-4) and (B-5), particularly useful compounds are those in which $R^1$ and $R^4$ are each a hydrogen atom, an alkyl group, an alkoxy group, a hydroxyl group or a cycloalkyl group, and $R^5$, $R^6$, $R^7$, $R^8$, $R^9$ and $R^{10}$ are each a hydrogen atom, an alkyl group or a cycloalkyl group.

The compounds represented by Formula (B) include the compounds disclosed in Tetrahedron Letters, 1970, Vol. 126, pp 4743–4751; Japan Chemical Society, 1972, No. 10, pp 0987–1990; Chem. Lett. 1972, (4), pp 315–316 and Japanese Unexamined Patent Publication No. 139383/1980, and may be synthesized by the methods also disclosed in these publications.

The above compounds represented by Formula (B) may be used preferably in an amount of 5 to 300 mole %, more preferably 10 to 200 mole %, based on the above-mentioned magenta coupler of this invention.

Typical examples of these compounds are shown below:

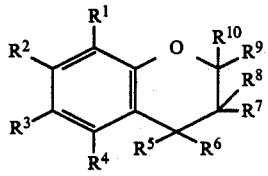

| Comp. No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| B-1 | H | H | H | H | H | $CH_3$ | H | H | $CH_3$ | $CH_3$ |
| B-2 | H | H | $CH_3$ | H | H | $CH_3$ | H | H | $CH_3$ | $CH_3$ |
| B-3 | H | H | $C_{12}H_{25}$ | H | H | $CH_3$ | H | H | $CH_3$ | $CH_3$ |
| B-4 | H | H | 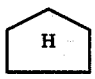 | H | H | $CH_3$ | H | H | $CH_3$ | $CH_3$ |
| B-5 | H | $CH_3$ | H | H | H | $CH_3$ | H | H | $CH_3$ | $CH_3$ |
| B-9 | $CH_3$ | H | $CH_3$ | H | H | H | H | 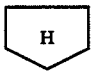 (Condensed) | | H |
| B-10 | H | $CH_3CO$ | H | H | H | (i)$C_3H_7$ | H | H | $CH_3$ | $CH_3$ |
| B-11 | H | $C_3H_7$ | (t)$C_8H_{17}$ | H | H | $CH_3$ | H | $CH_3$ | $CH_3$ | $CH_3$ |
| B-12 | Br | H | Br | H | H | H | H | $CH_3$ | $CH_3$ | $CH_3$ |
| B-13 | H | 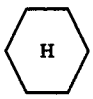 | H | H | $CH_3$ | $CH_3$ | H | H | $CH_2OH$ | $CH_3$ |

-continued

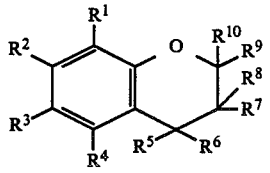

| Comp. No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| B-14 | H | 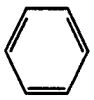 | H | H | $CH_3$ | $CH_3$ | H | H | $CH_3$ | $CH_3$ |
| B-15 | H | H | $CH_2{=}CHCH_2CO$ | | $CH_3$ | $CH_3$ | H | H | 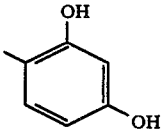 | $CH_3$ |
| B-16 | H | H | H | $CH_3SO_2NH$ | $CH_3$ | $CH_3$ | H | H | 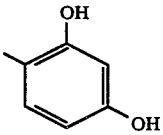 | $CH_3$ |
| B-17 | H | 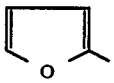 | $CH_3$ | H | Cl | H | Cl | H | $CH_3$ | $CH_3$ |
| B-18 | H | 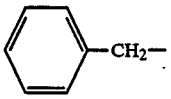 | $CH_3CONH$ | H | H | H | H | H | 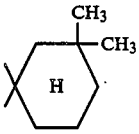 | (Spiro) |
| B-54 | $CH_3O$ | $CH_3O$ | H | H | H | H | H | H | $CH_3$ | $CH_3$ |
| B-55 | H | 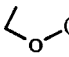 (Methylenedioxy) | | H | H | H | H | H | $CH_3$ | $CH_3$ |

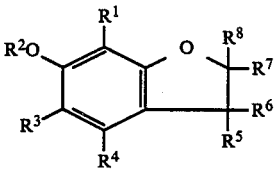

| Comp. No. | $R^1$ | $R^2$ | $R^3$ | $R^4$ | $R^5$ | $R^6$ | $R^7$ | $R^8$ |
|---|---|---|---|---|---|---|---|---|
| B-6 | H | H | H | H | H | 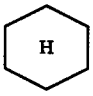 (Condensed) | | H |
| B-7 | H | H | $(i)C_3H_7$ | H | H | H | $CH_3$ | $CH_3$ |
| B-8 | H | $CH_3$ | Cl | H | H | H | $CH_3$ | $CH_3$ |
| B-19 | H | H | 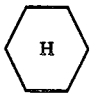 | H | $CH_3$ | $CH_3$ | $CH_3$ | $CH_3$ |
| B-20 | H | $CH_2{=}CHCH_2$ | $CH_3$ | H | $CH_3$ | $CH_3$ | $CH_3$ | H |

-continued

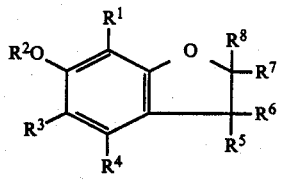

| Comp. No. | $R^1$ | $R^2$ | $R^3$ | $R^4$ | $R^5$ | $R^6$ | $R^7$ | $R^8$ |
|---|---|---|---|---|---|---|---|---|
| B-21 | H | $C_3H_7$ | $C_3H_7$ | H | $CH_3$ | $CH_3$ | 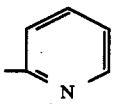 | H |
| B-22 | $CH_3$ | H | $CH_3$ | H | 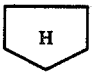 (Spiro) | | H | H |
| B-23 | $CH_3$ | H | 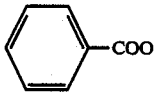 | H | $CH_3$ | $CH_3$ | $CH_3$ | $CH_3$ |

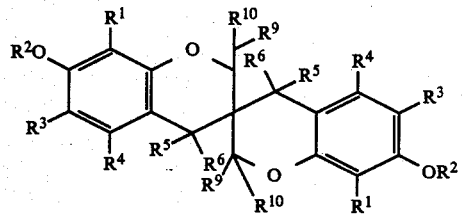

| Comp. No. | $R^1$ | $R^2$ | $R^3$ | $R^4$ | $R^5$ | $R^6$ | $R^9$ | $R^{10}$ |
|---|---|---|---|---|---|---|---|---|
| B-24 | H | H | H | H | $CH_3$ | $CH_3$ | H | H |
| B-25 | H | H | $CH_3$ | H | $CH_3$ | $CH_3$ | H | H |
| B-26 | H | H | (t)$C_4H_9$ | H | H | H | H | H |
| B-27 | H | $CH_3$ | H | H | $CH_3$ | $CH_3$ | H | H |
| B-28 | H | H | 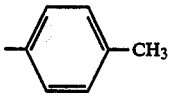 | H | $CH_3$ | $CH_3$ | H | H |
| B-29 | H | H | $C_2H_5COOCH_2$ | H | $CH_3$ | $CH_3$ | H | H |
| B-30 | $CH_3$ | 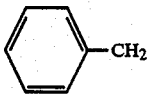 | H | $CH_3$ | $CH_3$ | $CH_3$ | H | H |
| B-31 | Cl | H | H | H | 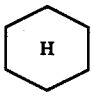 (Spiro) | | H | H |
| B-32 | H | H | $CH_3CONH$ | H | $CH_3$ | $CH_3$ | H | H |
| B-33 | $CH_3$ | 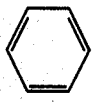 | (t)$C_8H_{17}$ | H | $CH_3$ | $CH_3$ | H | H |

-continued
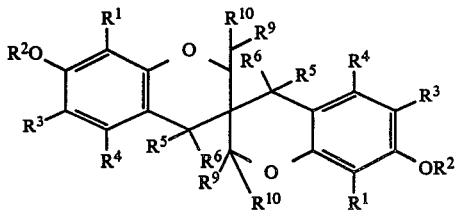
| Comp. No. | $R^1$ | $R^2$ | $R^3$ | $R^4$ | $R^5$ | $R^6$ | $R^9$ | $R^{10}$ |
|---|---|---|---|---|---|---|---|---|
| B-34 | H | H | 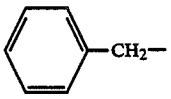 | H | $CH_3$ | $CH_3$ | H | H |
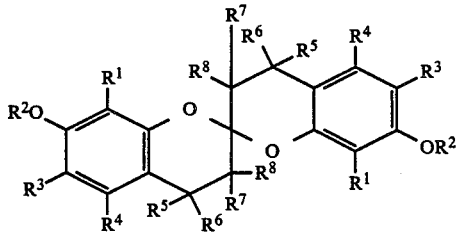
| Comp. No. | $R^1$ | $R^2$ | $R^3$ | $R^4$ | $R^5$ | $R^6$ | $R^7$ | $R^8$ |
|---|---|---|---|---|---|---|---|---|
| B-35 | H | H | H | H | $CH_3$ | $CH_3$ | H | H |
| B-36 | H | $C_3H_7$ | H | H | $CH_3$ | $CH_3$ | H | H |
| B-37 | H | $CH_3$ | $CH_3$ | H | $CH_3$ | $CH_3$ | H | H |
| B-38 | H | H | (t)$C_4H_9$ | H | $CH_3$ | $CH_3$ | H | H |
| B-39 | H | H | 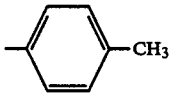 | H | $CH_3$ | $CH_3$ | H | H |
| B-40 | H | H | $CH_3SO_2NH$ | H | H | H | H | H |
| B-41 | $CH_3$ | 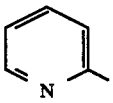 | H | $CH_3$ | $CH_3$ | $CH_3$ | H | H |
| B-42 | Cl | (t)$C_4H_9$ | H | H | 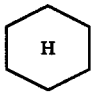 (Spiro) | | H | H |
| B-43 | H | $C_{12}H_{25}$ | $CH_3CONH$ | H | $CH_3$ | $CH_3$ | H | H |
| B-44 | H | H | (t)$C_8H_{17}$ | H | $CH_3$ | $CH_3$ | H | H |
| B-45 | H | H | 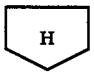 | H | $CH_3$ | $CH_3$ | H | H |

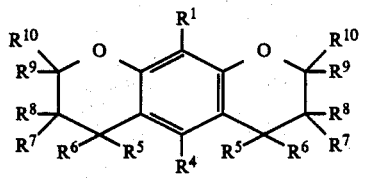

| Comp. No. | $R^1$ | $R^4$ | $R^5$ | $R^6$ | $R^7$ | $R^8$ | $R^9$ | $R^{10}$ |
|---|---|---|---|---|---|---|---|---|
| B-46 | H | H | H | H | H | H | $CH_3$ | $CH_3$ |
| B-47 | OH | H | H | H | H | H | $CH_3$ | $CH_3$ |
| B-48 | H | H | H | H | H | H | $CH_3$ | $C_2H_5$ |
| B-49 | H | H | H | H | H | H | 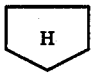 (Spiro) | |
| B-50 | $C_3H_7O$ | H | $CH_3$ | H | H | H | $CH_3$ | $CH_3$ |
| B-51 | H | H | H | H | $C_3H_7$ | H | $C_3H_7$ | H |
| B-52 | H | OH | H | H | H | H | $CH_3$ | $CH_3$ |
| B-53 | H | $C_3H_7O$ | H | H | H | H | $CH_3$ | $CH_3$ |

Formula (C)

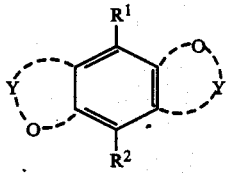

Formula (D)

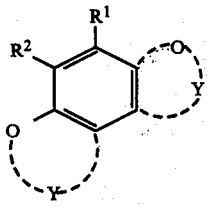

In the above formulas, $R^1$ and $R^2$ each represent a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

The groups mentioned above each may be substituted with other substituent which may include, for example, a halogen atom, an alkyl group, an alkenyl group, an alkoxy group, an aryloxy group, a hydroxyl group, an alkoxycarbonyl group, an aryloxycarbonyl group, an acylamino group, a carbamoyl group, a sulfonamide group, a sulfamoyl group, etc.

Y represents a group of atoms necessary for formation of a dichroman or dicoumaran ring together with a benzene ring.

Chroman or coumaran ring may be substituted with a halogen atom, an alkyl group, a cycloalkyl group, an alkoxy group, an alkenyl group, alkenyloxy group, a hydroxyl group, an aryl group, an aryloxy group or a heterocyclic group, or further may form a spiro ring.

Of the compounds represented by Formulas (C) and (D), compounds most useful for this invention are included in the compounds represented by Formulas (C-1), (C-2), (D-1) and (D-2), respectively.

Formula (C-1)

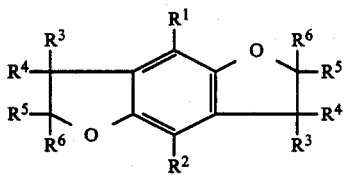

Formula (C-2)

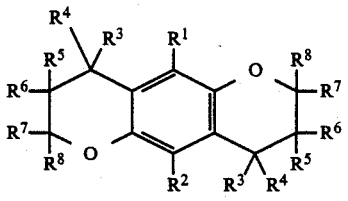

Formula (D-1)

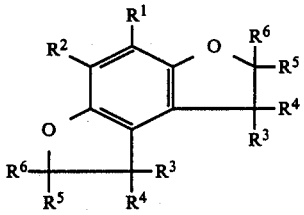

Formula (D-2)

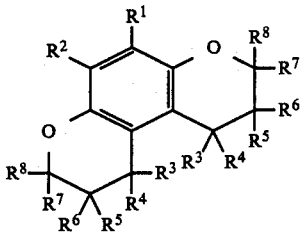

$R^1$ and $R^2$ in Formulas (C-1), (C-2), (D-1) and (D-2) have the same meaning as those in Formulas (C) and (D), and $R^3$, $R^4$, $R^5$, $R^6$ $R^7$ and $R^8$ each represent a hydrogen atom, a halogen atom, an alkyl group, an alkoxy group, a hydroxyl group, an alkenyl group, an alkenyloxy group, an aryl group, an aryloxy group or a heterocyclic ring. Also, $R^3$ and $R^4$, $R^4$ and $R^5$, $R^5$ and $R^6$, $R^6$ and $R^7$ and $R^8$ each may be cyclized each other to form a carbon ring, and such a carbon ring may be further substituted with alkyl group.

In the above Formulas (C-1), (C-2), (D-1) and (D-2), particularly useful compounds are those in which $R^1$ and $R^4$ are each a hydrogen atom, an alkyl group, an alkoxy group, a hydroxyl group or a cycloalkyl group, and $R^3$, $R^4$, $R^5$, $R^6$, $R^7$ and $R^8$ are each a hydrogen atom, an alkyl group or a cycloalkyl group.

The compounds represented by Formulas (C) and (D) include the compounds disclosed in Japan Chemical Society, Part C, 1968.(14), pp 1937–18; Organic Synthetic Chemical Association, 1970, 28(1), pp 60–65; Tetrahedron Letters, 1973.(29), pp 2707–2710, and may be synthesized by the methods also disclosed in these publications.

The above compounds represented by Formulas (C) and (D) may be used preferably in an amount of 5 to 300 mole %, more preferably 10 to 200 mole %, based on the above-mentioned magenta coupler of this invention.

Typical examples of these compounds are shown below:

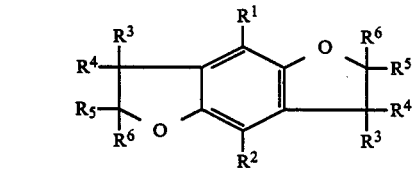

| Comp. No. | $R^1$ | $R^2$ | $R^3$ | $R^4$ | $R^5$ | $R^6$ |
|---|---|---|---|---|---|---|
| C-11 | H | H | H | H | $CH_3$ | $CH_3$ |
| C-12 | H | H | H | H | 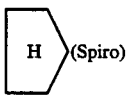 (Spiro) | |

-continued

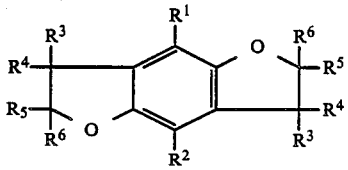

| Comp. No. | $R^1$ | $R^2$ | $R^3$ | $R^4$ | $R^5$ | $R^6$ |
|---|---|---|---|---|---|---|
| C-13 | H | H | H | 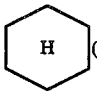 (Condensed) | | H |

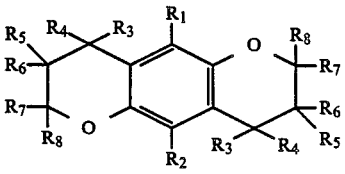

| Comp. No. | $R_1$ | $R_2$ | $R_3$ | $R_4$ | $R_5$ | $R_6$ | $R_7$ | $R_8$ |
|---|---|---|---|---|---|---|---|---|
| C-1 | H | H | H | H | H | H | H | H |
| C-2 | H | H | H | H | H | H | $CH_3$ | $CH_3$ |
| C-3 | H | H | $CH_3$ | H | H | H | $CH_3$ | $CH_3$ |
| C-4 | $CH_3$ | H | $CH_3$ | $CH_3$ | H | H | $CH_3$ | $CH_3$ |
| C-5 | OH | H | H | H | H | H | $C_2H_5$ | $CH_3$ |
| C-6 | $OCH_3$ | H | H | H | H | H | H | H |
| C-7 | $OC_3H_7$ | H | H | H | H | H | H | H |
| C-8 | $OC_{12}H_{25}$ | H | H | H | H | H | H | H |
| C-9 | $CH_3COO$ | H | H | H | H | H | $CH_3$ | $CH_3$ |
| C-10 | $CH_3CONH$ | H | H | H | H | H | 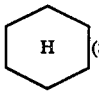 (Spiro) | |
| C-14 | $(CH_3)_2CCHCH_2$ (Cl) | $(CH_3)_2CCH_2CH_2$ (Cl) | H | H | H | H | $CH_3$ | $CH_3$ |
| C-15 | $CH_3$ | $CH_3$ | H | H | H | H | $CH_3$ | $CH_3$ |
| C-16 | $(CH_3)_2C{=}CHCH_2$ | $(CH_3)_2C{=}CCH_2$ | H | H | H | H | $CH_3$ | $CH_3$ |
| C-17 | Cl | H | H | H | H | H | H | H |

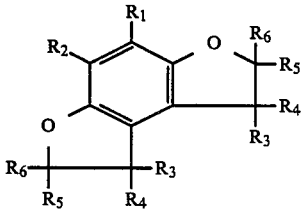

| Comp. No. | $R_1$ | $R_2$ | $R_3$ | $R_4$ | $R_5$ | $R_6$ |
|---|---|---|---|---|---|---|
| D-1 | $CH_3$ | $CH_3$ | H | H | H | H |
| D-2 | H | H | H | H | $CH_3$ | $CH_3$ |

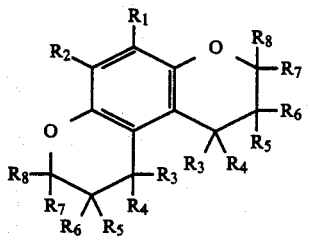

| Comp. No. | $R_1$ | $R_2$ | $R_3$ | $R_4$ | $R_5$ | $R_6$ | $R_7$ | $R_8$ |
|---|---|---|---|---|---|---|---|---|
| D-3 | H | H | H | H | H | H | H | H |
| D-4 | H | H | H | H | H | H | $CH_3$ | $CH_3$ |
| D-5 | $CH_3$ | $CH_3$ | H | H | H | H | $CH_3$ | $CH_3$ |
| D-6 | $(CH_3)_2C(Cl)CH_2CH_2$ | $(CH_3)_2C(Cl)CH_2CH_2$ | H | H | H | H | $CH_3$ | $CH_3$ |
| D-7 | H | H | Cl | H | Cl | H | H | H |
| D-8 | H | H | H | H | H | H | 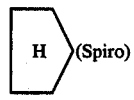 (Spiro) | |
| D-9 | $CH_3O$ | H | H | H | H | H | 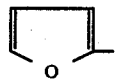 | H |
| D-10 | H | H | H | H | H | H | $CH_2OH$ | $CH_3$ |
| D-11 | 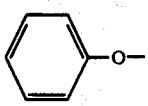 | H | H | H | H | H | $CH_3$ | $CH_3$ |

Formula (E)

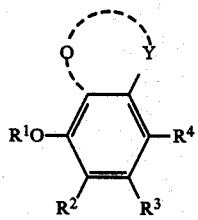

wherein, $R^1$ represents a hydrogen atom, an alkyl group, an alkenyl group, an aryl group, an acyl group, a cycloalkyl group or a heterocyclic group; and $R_3$ represents a hydrogen atom, a halogen atom, an alkyl group, an alkenyl group, an aryl group, an aryloxy group, an acyl group, an acylamino an acyloxy group, a sulfonamide group, a cycloalkyl group or an alkoxycarbonyl group.

R2 and R4 each represents a hydrogen atom, a halogen atom, an alkyl group, an alkenyl group, an aryl group, an acyl group, an acylamino group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$ may be ring-closed each other to form a 5- or 6-membered ring.

In that occasion, $R^3$ and $R^4$ each represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by Formula (E), compounds most useful for this invention are included in the compounds represented by Formulas (E-1), (E-2), (E-3), (E-4) and (E-5).

Formula (E-1)

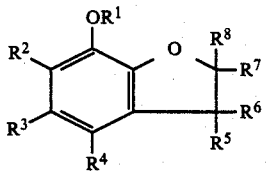

Formula (E-2)

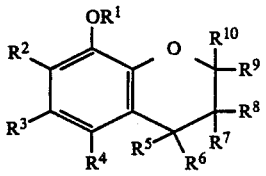

Formula (E-3)

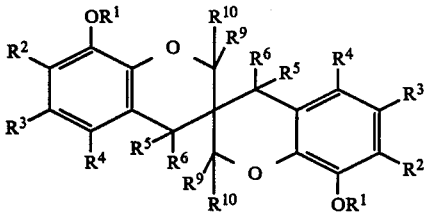

Formula (E-4)

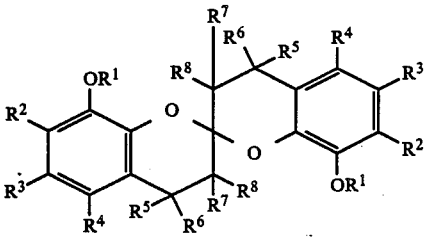

Formula (E-5)

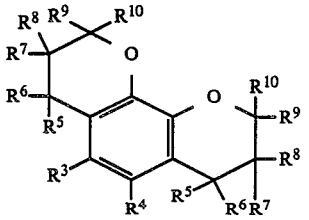

$R^1$, $R^2$, $R^3$ and $R^4$ in Formulas (E-1) to (E-5) have the same meaning as those in the above Formula (E), and $R^5$, $R^6$, $R^7$, $R^8$, $R^9$ and $R^{10}$ each represents a hydrogen atom, a halogen atom, an alkyl group, an alkoxy group, a hydroxyl group, an alkenyl group, an alkenyloxy group, an aryl group, an aryloxy group or a heterocyclic group.

Further, $R^5$ and $R^6$, $R^6$ and $R^7$, and $R^7$ and $R^8$, $R^8$ and $R^9$, and $R^9$ and $R^{10}$ each may be cyclized each other to form a carbon ring, and such a carbon ring may be further substituted with an alkyl group.

In the above Formulas (E-1) to (E-5), particularly useful compounds are those in which $R^1$, $R^2$, $R^3$ and $R^4$ are each a hydrogen atom, an alkyl group or a cycloalkyl group; and in the above Formula (E-5), $R^3$ and $R^4$ are each a hydrogen atom, an alkyl group, an alkoxy group, a hydroxyl group or a cycloalkyl group; and in the above Formulas (E-1) to (E-5), $R^5$, $R^6$, $R^7$, $R^8$, $R^9$ and $R^{10}$ are each a hydrogen atom, an alkyl group or a cycloalkyl group.

The compounds represented by Formula (E) include the compounds disclosed in Tetrahedron Letters, 1965.(8), pp 457–460; Japan Chemical Society, Part C, 1966.(22), pp 2013–2016; Zh. Org. Khim, 1970, (6), pp 1230–1237, and may be synthesized by the methods also disclosed in these publications.

The above compounds represented by Formula (E) may be used preferably in an amount of 5 to 300 mole %, more preferably 10 to 200 mole %, based on the above-mentioned magenta coupler of this invention.

Typical examples of these compounds are shown below:

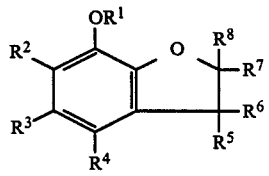

| Comp. No. | $R_1$ | $R_2$ | $R_3$ | $R_4$ | $R_5$ | $R_6$ | $R_7$ | $R_8$ |
|---|---|---|---|---|---|---|---|---|
| E-19 | H | H | H | H | H | | | H |
| | | | | | | 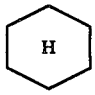 (Condensed) | | |
| E-20 | $C_3H_7$ | H | H | H | H | | | H |
| | | | | | | 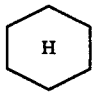 (Condensed) | | |

-continued

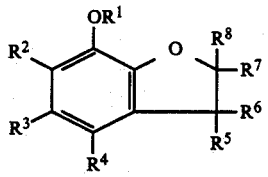

| Comp. No. | $R_1$ | $R_2$ | $R_3$ | $R_4$ | $R_5$ | $R_6$ | $R_7$ | $R_8$ |
|---|---|---|---|---|---|---|---|---|
| E-21 | H | H | H | H | H | H | 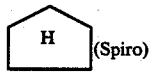 (Spiro) | |
| E-22 | $CH_3$ | H | H | H | H | H | 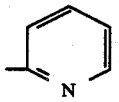 | H |
| E-23 | H | H | H | H | H | H | $CH_3$ | $CH_3$ |
| E-24 | $CH_3$ | H | 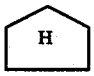 | H | H | H | $CH_3$ | $CH_3$ |
| E-25 | 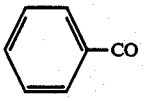 | H | H | H | H | H | $CH_3$ | $CH_3$ |
| E-26 | $C_{12}H_{25}$ | H | H | H | $CH_3$ | $CH_3$ | $CH_3$ | $CH_2OH$ |

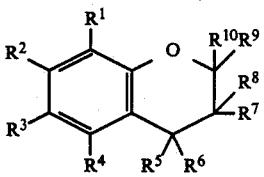

| Comp. No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| E-1 | H | H | H | H | H | H | H | H | H | H |
| E-2 | H | H | H | H | H | H | H | H | $CH_3$ | $CH_3$ |
| E-3 | H | H | H | H | $CH_3$ | H | H | H | $CH_3$ | $CH_3$ |
| E-4 | H | H | $CH_2{=}CHCH_2$ | H | H | H | H | H | $CH_3$ | $CH_3$ |
| E-5 | $CH_3$ | H | H | H | H | H | H | H | $CH_3$ | $CH_3$ |
| E-6 | $C_3H_7$ | H | H | H | H | H | H | H | $CH_3$ | $CH_3$ |
| E-7 | $C_{12}H_{25}$ | H | H | H | $CH_3$ | H | H | H | $CH_3$ | $CH_3$ |
| E-8 | 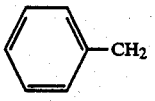 | H | H | H | H | H | H | H | H | H |
| E-9 | 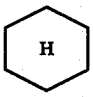 | H | H | H | H | H | H | H | $CH_3$ | $CH_3$ |
| E-10 | 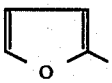 | H | H | H | H | H | H | H | $CH_3$ | $CH_3$ |
| E-11 | H | H | H | H | H | H | H | H | $CH_3$ | $C_{16}H_{33}$ |

-continued

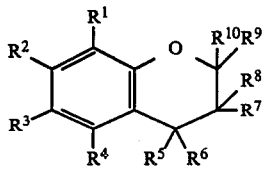

| Comp. No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| E-12 | H | H | 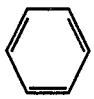 | H | H | H | H | H | $CH_3$ | $CH_3$ |
| E-13 | $CH_3$ | H | $CH_3CO$ | H | H | H | H | H | $CH_3$ | $CH_3$ |
| E-14 | $CH_3$ | H | H | H | H | Br | Br | H | H | H |
| E-15 | $CH_3$ | H | H | H | H | Cl | Cl | H | H | H |
| E-16 | $CH_3$ | H | H | H | H | $CH_3O$ | Br | H | H | H |
| E-17 | $CH_3$ | H | H | H | H | OH | Br | H | $CH_3$ | $CH_3$ |
| E-18 | $CH_3$ | H | H | H | H | $C_2H_5O$ | OH | H | $CH_3$ | $CH_3$ |

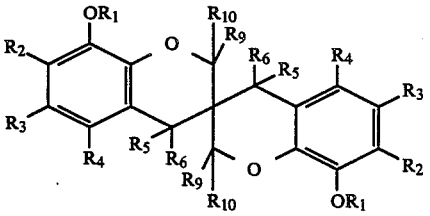

| Comp. No | $R_1$ | $R_2$ | $R_3$ | $R_4$ | $R_5$ | $R_6$ | $R_9$ | $R_{10}$ |
|---|---|---|---|---|---|---|---|---|
| E-27 | H | H | H | H | H | H | H | H |
| E-28 | $CH_3$ | H | H | H | H | H | H | H |
| E-29 | 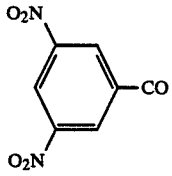 | H | H | H | H | H | H | H |
| E-30 | H | H | $CH_3$ | H | H | H | $CH_3$ | $CH_3$ |
| E-31 | $C_3H_7$ | H | H | H | H | H | H | H |
| E-32 | $C_3H_7$ | H | H | H | $CH_3$ | $CH_3$ | H | H |
| E-37 | H | H | H | $CH_3CONH$ | H | H | H | H |
| E-38 | CO | H | H | H | H | H | H | H |

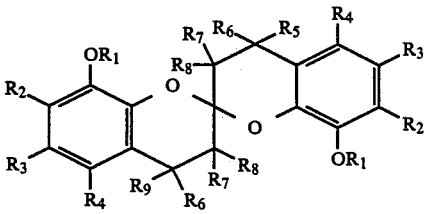

| Comp. No | $R_1$ | $R_2$ | $R_3$ | $R_4$ | $R_5$ | $R_6$ | $R_7$ | $R_8$ |
|---|---|---|---|---|---|---|---|---|
| E-33 | H | H | H | H | H | H | H | H |
| E-34 | H | H | H | H | $CH_3$ | $CH_3$ | H | H |
| E-35 | $C_{12}H_{25}$ | H | H | H | $CH_3$ | $CH_3$ | H | H |
| E-36 | $CH_3$ | H | $CH_3$ | H | $CH_3$ | $CH_3$ | H | H |

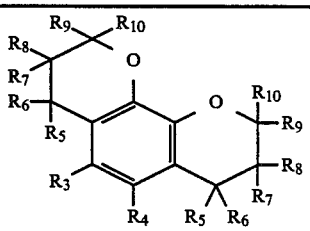

| Comp. No | $R_3$ | $R_4$ | $R_5$ | $R_6$ | $R_7$ | $R_8$ | $R_9$ | $R_{10}$ |
|---|---|---|---|---|---|---|---|---|
| E-39 | H | H | H | H | H | H | H | H |
| E-40 | H | H | H | H | H | H | $CH_3$ | $CH_3$ |
| E-41 | OH | H | H | H | H | H | $CH_3$ | $CH_3$ |
| E-42 | $C_3H_7O$ | H | $CH_3$ | $CH_3$ | H | H | H | H |

Formula (F)

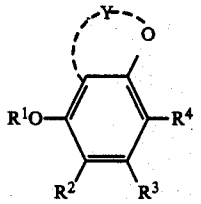

wherein, $R^1$ represents a hydrogen atom, an alkyl group, an alkenyl group, an aryl group, an acyl group, a cycloalkyl group or a heterocyclic group; $R^2$ represents a hydrogen atom, a halogen atom, an alkyl group, an alkenyl group, an aryl group, aryloxy group, an acyl group, an acylamino group, an acyloxy group, a sulfonamide group, a cycloalkyl group or an alkoxycarbonyl group; $R^3$ represents a hydrogen atom, a halogen atom, an alkyl group, an alkenyl group, an aryl group, an acyl group, an acylamino group, a sulfonamide group, a cycloalkyl group or an alkoxycarbonyl group; and $R^4$ represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$ may be ring-closed each other to form a 5- or 6-membered ring. In this occasion, $R^3$ and $R^4$ each represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by Formula (F), compounds most useful for this invention are included in the compounds represented by Formulas (F-1), (F-2), (F-3), (F-4) and (F-5).

Formula (F-1)

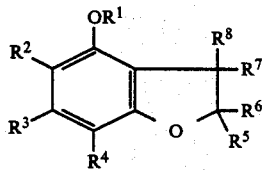

Formula (F-2)

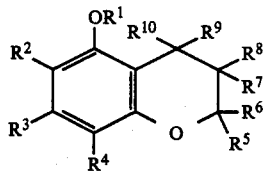

Formula (F-3)

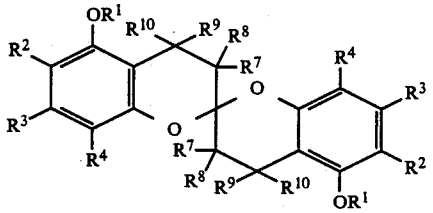

Formula (F-4)

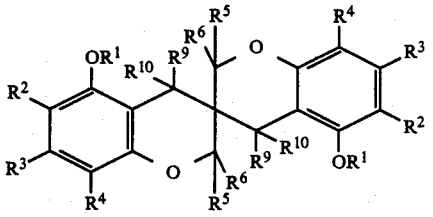

Formula (F-5)

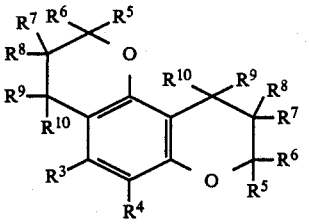

$R^1$, $R^2$, $R^3$ and $R^4$ in Formulas (F-1) to (F-5) have the same meaning as those in the above Formula (F), and $R^5$, $R^6$, $R^7$, $R^8$, $R^9$ and $R^{10}$ each represent a hydrogen atom, a halogen atom, an alkyl group, an alkoxy group, a hydroxyl group, an alkenyl group, an alkenyloxy group, an aryl group, an aryloxy group or a heterocyclic group.

Further, $R^5$ and $R^6$, $R^6$ and $R^7$, $R^7$ and $R^8$, $R^8$ and $R^9$, and $R^9$ and $R^{10}$ each may be cyclized each other to form a carbon ring, and such a carbon ring may be further substituted with an alkyl group.

Also, in Formulas (F-3), (F-4) and (F-5), $R^1$ to $R^{10}$ in two of them each may be the same or different.

In the above Formulas (F-1), (F-2), (F-3), (F-4) and (F-5), particularly useful compounds are those in which $R^1$, $R^2$ and $R^3$ are each a hydrogen atom, an alkyl group or a cycloalkyl group; $R^4$ is a hydrogen atom, an alkyl group, an alkoxy group, a hydroxyl group or a cycloalkyl group; and further, $R^5$, $R^6$, $R^7$, $R^8$, $R^9$ and $R^{10}$ are each a hydrogen atom, an alkyl group or a cycloalkyl group.

The compounds represented by Formula (F) include the compounds disclosed in Tetrahedron Letters, 1970, Vol. 26, pp 4743–4751; Japan Chemical Society, 1972, No. 10, pp 1987–1990; Synthesis, 1975, Vol. 6, pp 392–393; and Bul. Soc. Chim. Belg, 1975, Vol. 84(7), pp 747–759, and may be synthesized by the methods disclosed in these publications.

The above compounds represented by Formula (F) may be used preferably in an amount of 5 to 300 mole %, more preferably 10 to 200 mole %, based on the above-mentioned magenta coupler of this invention.

Typical examples of the compounds represented by Formula (F) are shown below:

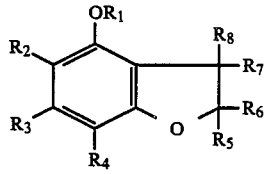

| Comp. No | $R_1$ | $R_2$ | $R_3$ | $R_4$ | $R_5$ | $R_6$ | $R_7$ | $R_8$ |
|---|---|---|---|---|---|---|---|---|
| F-11 | H | H | H | H | H | 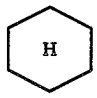 (Condensed) | | H |
| F-12 | $C_3H_7$ | H | H | H | H | 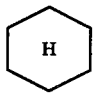 (Condensed) | | H |
| F-13 | H | H | H | H | H | H | H | H |
| F-14 | H | H | H | H | H | H | $CH_3$ | H |
| F-15 | H | H | $CH_3$ | H | H | H | $CH_3$ | H |
| F-16 | H | H | 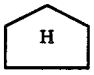 | H | H | H | $CH_3$ | H |
| F-17 | H | H | 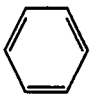 | H | H | H | $CH_3$ | H |
| F-18 | $C_3H_7$ | H | $CH_3$ | H | H | H | $CH_3$ | H |
| F-19 | 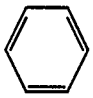 | H | H | H | 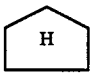 (Spiro) | | H | H |
| F-24 | $CH_2{=}CHCH_2$ | $CH_3$ | $CH_3$ | H | H | $C_2H_5O$ | $CH_3$ | $CH_3$ |
| F-25 | $C_3H_7$ | H | H | H | H | 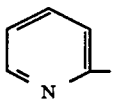 | $CH_3$ | $CH_3$ |
| F-26 | H | $CH_3$ | $CH_3$ | H | H | H | 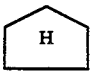 (Spiro) | |

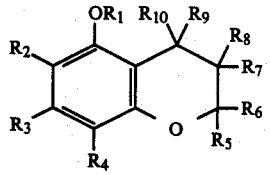

| Comp. No | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| F-1 | H | H | H | H | H | H | H | H | H | H |
| F-2 | H | H | H | H | $CH_3$ | $CH_3$ | H | H | $CH_3$ | H |
| F-3 | H | H | H | H | $CH_3$ | $CH_3$ | H | H | H | H |
| F-4 | H | $(CH_3)_2C{=}CCHCH_2$ | H | H | $CH_3$ | $CH_3$ | H | H | H | H |
| F-5 | $CH_3$ | H | H | H | $CH_3$ | $CH_3$ | H | H | H | H |
| F-6 | $C_3H_7$ | H | H | H | $CH_3$ | $CH_3$ | H | H | H | H |
| F-7 | $C_{12}H_{25}$ | H | H | H | $CH_3$ | $CH_3$ | H | H | H | H |
| F-8 | 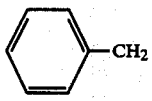 | H | H | H | $CH_3$ | $CH_3$ | H | H | H | H |
| F-9 | 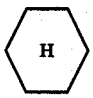 | H | H | H | $CH_3$ | $CH_3$ | H | H | H | H |
| F-10 | 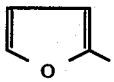 | H | H | H | $CH_3$ | $CH_3$ | H | H | H | H |
| F-20 | H | Cl | H | H | H | 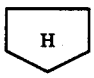 (Condensed) | | H | H | H |
| F-21 | H | H | H | H | $CH_3$ | $CH_2OH$ | H | H | $CH_3$ | $CH_3$ |
| F-22 | $C_3H_7$ | $(t)C_8H_{17}$ | H | H | $C_2H_5$ | $CH_3$ | H | H | H | H |
| F-23 | $CH_3CO$ | H | H | H | $CH_3$ | $CH_3$ | H | H | $CH_3$ | H |

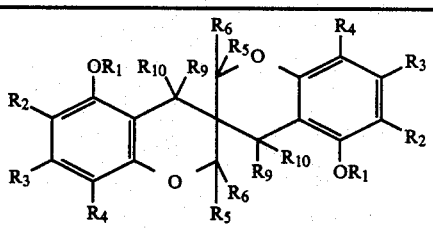

| Comp. No | $R_1$ | $R_2$ | $R_3$ | $R_4$ | $R_5$ | $R_6$ | $R_9$ | $R_{10}$ |
|---|---|---|---|---|---|---|---|---|
| F-27 | H | H | H | H | H | H | $CH_3$ | $CH_3$ |
| F-28 | $C_3H_7$ | H | H | H | H | H | $CH_3$ | $CH_3$ |
| F-29 | H | H | H | $(t)C_8H_{17}$ | H | H | H | H |
| F-30 | H | Cl | H | H | H | H | 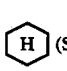 (Spiro) | |

-continued

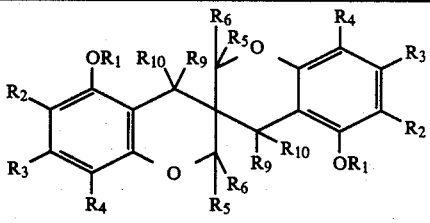

| Comp. No | $R_1$ | $R_2$ | $R_3$ | $R_4$ | $R_5$ | $R_6$ | $R_9$ | $R_{10}$ |
|---|---|---|---|---|---|---|---|---|
| F-31 | 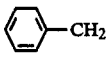 | H | H | H | H | H | $CH_3$ | $CH_3$ |

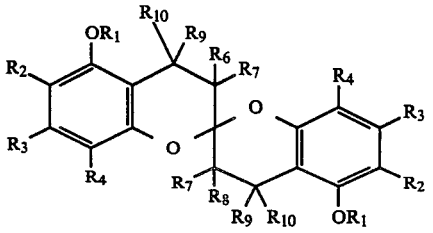

| Comp. No | $R_1$ | $R_2$ | $R_3$ | $R_4$ | $R_7$ | $R_8$ | $R_9$ | $R_{10}$ |
|---|---|---|---|---|---|---|---|---|
| F-32 | H | H | H | H | H | H | $CH_3$ | $CH_3$ |
| F-33 | $CH_3$ | H | H | H | H | H | $CH_3$ | $CH_3$ |
| F-34 | H | $CH_3$ | H | H | H | H | H | H |
| F-35 | H | H | H | (t)$C_5H_9$ | H | H | $CH_3$ | $CH_3$ |
| F-36 | H | 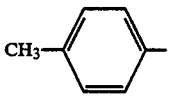 | H | H | H | H | $CH_3$ | $CH_3$ |
| F-37 | H | H | H | $CH_3SO_2NH$ | H | H | H | H |
| F-38 | 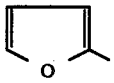 | H | H | H | H | H | $CH_3$ | $CH_3$ |
| F-39 | $C_{12}H_{25}$ | H | H | H | H | H | $CH_3$ | $CH_3$ |
| F-40 | 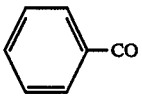 | H | H | H | H | H | 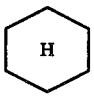 (Spiro) | |
| F-41 | H | H | 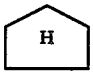 | H | H | H | $CH_3$ | $CH_3$ |

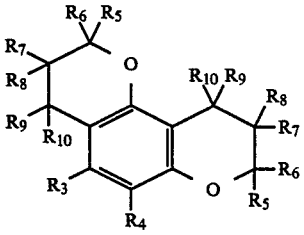

| Comp. No. | $R_3$ | $R_4$ | $R_5$ | $R_6$ | $R_7$ | $R_8$ | $R_9$ | $R_{10}$ |
|---|---|---|---|---|---|---|---|---|
| F-42 | H | H | $CH_3$ | $CH_3$ | H | H | H | H |
| F-43 | H | H | 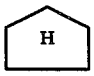 (Spiro) | | H | H | H | H |
| F-44 | H | OH | $CH_3$ | $CH_3$ | H | H | $CH_3$ | H |
| F-45 | H | $C_3H_7O$ | H | H | H | H | $CH_3$ | $CH_2OH$ |
| F-46 | OH | H | $CH_3$ | $CH_3$ | H | H | H | H |
| F-47 | $C_3H_7O$ | H | $CH_3$ | $CH_3$ | H | H | H | H |

Formula (G)

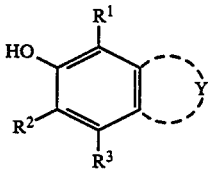

wherein, $R^1$ and $R^3$ each represent a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group; and $R^2$ represents a hydrogen atom, a halogen atom, an alkyl group, an alkenyl group, a hydroxyl group, an aryl group, an acyl group, an acylamino group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^2$ and $R^3$ may be ring-closed each other to form a 5- or 6-membered hydrocarbon ring. This 5- or 6-membered hydrocarbon ring may be substituted with a halogen atom, an alkyl group, a cycloalkyl group, an alkoxy group, an alkenyl group, a hydroxyl group, an aryl group, an aryloxy group or a heterocyclic group.

Y represents a group of atoms necessary for formation of an indane ring. The indane ring may be substituted with a halogen atom, an alkyl group, an alkenyl group, an alkoxy group, a cycloalkyl group, a hydroxyl group, an aryl group, an aryloxy group or a heterocyclic group, or may further form a spiro ring.

Of the compounds represented by Formula (G), compounds most useful for this invention are included in the compounds represented by Formulas (G-1) to (G-3).

Formula (G-1)

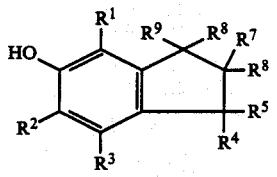

Formula (G-2)

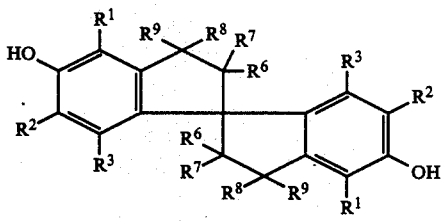

Formula (G-3)

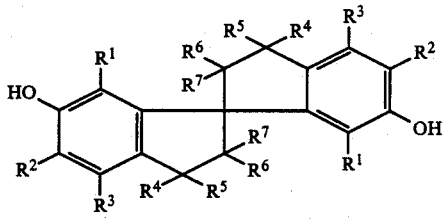

$R^1$, $R^2$ and $R^3$ in Formulas (G-1) to (G-3) have the same meaning as those in the above Formula (G), and $R^4$, $R^5$, $R^6$, $R^7$, $R^8$ and $R^9$ each represent a hydrogen atom, a halogen atom, an alkyl group, an alkoxy group, an alkenyl gorup, a hydroxyl group, an aryl group, an aryloxy group or a heterocyclic group. $R^4$ and $R^5$, $R^5$ and $R^6$, $R^6$ and $R^7$, $R^7$ and R8, and R8 and $R^9$ each may be ring-closed each other to form a hydrocarbon ring, and such a hydrocarbon ring may be further substituted with an alkyl group.

In the above Formulas (G-1) to (G-3), particularly useful compounds are those in which $R^1$ and $R^3$ are each a hydrogen atom, an alkyl group, an alkoxy group, a hydroxyl group or a cycloalkyl group; $R^2$ is a hydrogen atom, an alkyl group, a hydroxy group or a cycloalkyl group; and $R^4$, $R^5$, $R^6$, $R^7$, $R^8$ and $R^9$ are each a hydrogen atom, an alkyl group or a cycloalkyl group.

The above compounds represented by Formula (G) may be used preferably in an amount of 5 to 300 mole %, more preferably 10 to 200 mole %, based on the above-mentioned magenta coupler of this invention.

Typical examples of the compounds represented by Formula (G) are shown below:

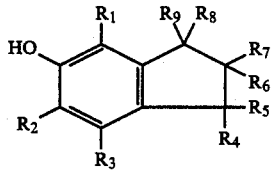

| Comp. No. | $R_1$ | $R_2$ | $R_3$ | $R_4$ | $R_5$ | $R_6$ | $R_7$ | $R_8$ | $R_9$ |
|---|---|---|---|---|---|---|---|---|---|
| G-1 | H | H | H | H | H | H | H | H | H |
| G-2 | H | H | H | H | H | H | H | $CH_3$ | $CH_3$ |
| G-3 | H | H | H | H | H | H | H | $CH_3$ | $C_{16}H_{33}$ |
| G-4 | H | OH | H | H | H | H | H | $CH_3$ | $C_{16}H_{33}$ |
| G-5 | H | H | H | $CH_3$ | $CH_3$ | H | H | $CH_3$ | $CH_3$ |
| G-6 | H | Cl | H | $CH_3$ | $CH_3$ | H | H | $CH_3$ | $CH_3$ |
| G-7 | Cl | Cl | H | $CH_3$ | $CH_3$ | H | H | $CH_3$ | $CH_3$ |
| G-8 | H | H | $CH_3$ | $CH_3$ | $CH_3$ | H | H | $CH_3$ | $CH_3$ |
| G-9 | H | H | H | H | 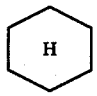 (Condensed) | | H | H | H |
| G-10 | H | H | H | H | H | H | H | 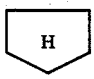 (Spiro) | |
| G-11 | H | $C_3H_7$ | H | $CH_3$ | $CH_3$ | H | H | $CH_3$ | $CH_3$ |
| G-12 | H | (t)$C_8H_{17}$ | H | $CH_3$ | $CH_3$ | H | H | $CH_3$ | $CH_3$ |

-continued

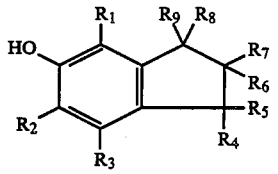

| Comp. No. | $R_1$ | $R_2$ | $R_3$ | $R_4$ | $R_5$ | $R_6$ | $R_7$ | $R_8$ | $R_9$ |
|---|---|---|---|---|---|---|---|---|---|
| G-13 | H | 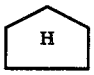 | H | $CH_3$ | $CH_3$ | H | H | $CH_3$ | $CH_3$ |
| G-14 | H | H | H | 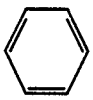 | $CH_3$ | H | H | $CH_3$ | $CH_3$ |
| G-15 | H | H | $CH_3O$ | $CH_3$ | $CH_3$ | H | H | $CH_3$ | $CH_3$ |
| G-16 | $CH_3H$ | H | H | H | 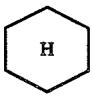 (Condensed) | | H | H | H |
| G-17 | H | $CH_3SO_2NH$ | H | $CH_3$ | $CH_3$ | H | H | $CH_3$ | $CH_3$ |
| G-18 | H | $CH_3CO$ | H | $CH_3$ | $CH_3$ | H | H | $CH_3$ | $CH_3$ |
| G-19 | H | 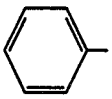 | H | $CH_3$ | $CH_3$ | H | H | $CH_3$ | $CH_3$ |
| G-20 | H | 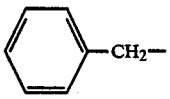 | H | $CH_3$ | $CH_3$ | H | H | $CH_3$ | $CH_3$ |
| G-21 | H | 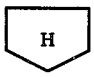 (Condensed) | | H | H | H | H | H | H |
| G-22 | H | 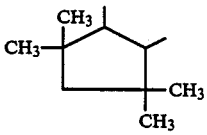 (Condensed) | | $CH_3$ | $CH_3$ | H | H | $CH_3$ | $CH_3$ |
| G-23 | H | 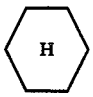 (Condensed) | | $CH_3$ | $CH_3$ | H | H | $CH_3$ | $CH_3$ |
| G-24 | $CH_3$ | 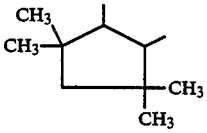 (Condensed) | | $CH_3$ | $CH_3$ | H | H | $CH_3$ | $CH_3$ |

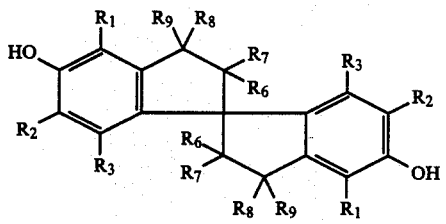

| Comp. No. | $R^1$ | $R^2$ | $R^3$ | $R^6$ | $R^7$ | $R^8$ | $R^9$ |
|---|---|---|---|---|---|---|---|
| G-29 | H | H | H | H | H | $CH_3$ | $CH_3$ |
| G-32 | $CH_3$ | H | H | H | H | $CH_3$ | $CH_3$ |

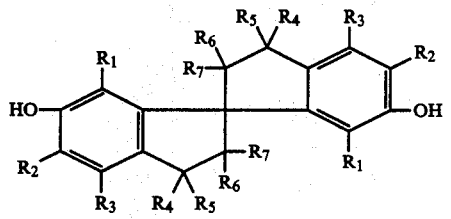

| Comp. No. | $R_1$ | $R_2$ | $R_3$ | $R_4$ | $R_5$ | $R_6$ | $R_7$ |
|---|---|---|---|---|---|---|---|
| G-25 | H | $CH_3$ | H | $CH_3$ | $C_6H_5$ | H | H |
| C-26 | Cl | Cl | H | $CH_3$ | $CH_3$ | H | H |
| G-27 | H | OH | H | $CH_3$ | $CH_3$ | H | H |
| G-28 | H | $C_3H_7$ | H | $CH_3$ | $CH_3$ | H | H |
| G-30 | H | Cl | H | $CH_3$ | $CH_3$ | H | H |
| G-31 | H | $C_2H_5$ | H | $CH_3$ | $CH_3$ | H | H |
| G-33 | $CH_3$ | $CH_3$ | H | $CH_3$ | $CH_3$ | H | H |
| G-34 | H | 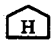 | H | $CH_3$ | $CH_3$ | H | H |
| G-35 | H | $CH_3$ | H | H | H | H | H |
| G-36 | H | H | H | 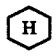 (Spiro) | | H | H |
| G-37 | $CH_3$ | H | H | $CH_3$ | $CH_3$ | H | H |
| G-38 | H | $CH_3$ | H | $CH_3$ | $C_6H_5$ | H | H |
| G-39 | 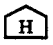 | H | H | $CH_3$ | $CH_3$ | H | H |
| G-40 | $CH_3$ | $CH_3$ | H | $C_2H_5$ | $C_2H_5$ | H | H |
| G-41 | H | H | H | H | H | $CH_3$ | $CH_3$ |
| G-42 | H | OH | H | 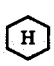 (Spiro) | | H | H |
| G-43 | H | 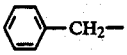 | H | H | H | H | H |
| G-44 | H | (t)$C_4H_9$ | H | $CH_3$ | $CH_3$ | H | H |
| G-45 | H | (t)$C_8H_{17}$ | H | $CH_3$ | $CH_3$ | H | H |

Formula (H)

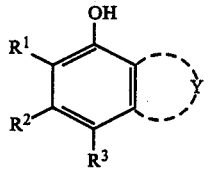

wherein, $R^1$ and $R^2$ each represent a hydrogen atom, a halogen atom, an alkyl group, an alkenyl group, an aryl group, an acyl group, an acylamino group, an acyloxy group, a sulfonamide group, a cycloalkyl group or an alkoxycarbonyl group; and $R^3$ represents a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$, and $R^2$ and $R^3$ each may be ring-closed each other to form a 5- or 6-membered hydrocarbon ring, and the hydrocarbon ring may be substituted with a halogen atom, an alkyl group, a cycloalkyl group, an alkoxyl group, an alkenyl group, a hydroxyl group, an aryl group, an aryloxy group or a heterocyclic group.

Y represents a group of atoms necessary for formation of an indane ring. The indane ring may be substituted with a group capable of substituting the above hydrocarbon ring, or may further form a spiro ring.

Of the compounds represented by Formula (H), compounds most useful for this invention are included in the compounds represented by Formulas (H-1) to (H-3).

Formula (H-1)

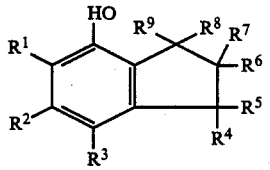

Formula (H-2)

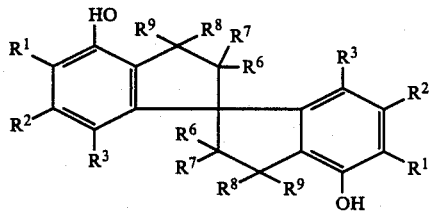

Formula (H-3)

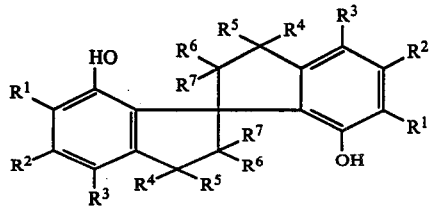

$R^1$, $R^2$ and $R^3$ in Formulas (H-1) to (H-3) have the same meaning as those in the above Formula (H), and $R^4$, $R^5$, $R^6$, $R^7$, $R^8$ and $R^9$ each represents a hydrogen atom, a halogen atom, an alkyl group, an alkoxy group, a hydroxyl group, an alkenyl group, an aryl group, an aryloxy group or a heterocyclic group. $R^4$ and $R^5$, $R^5$ and $R^6$, $R^6$ and $R^7$, $R^7$ and $R^8$, and $R^8$ and $R^9$ each may be ring-closed each other to form a hydrocarbon ring, and such a hydrocarbon ring may be further substituted with an alkyl group.

In the above Formulas (H-1) to (H-3), particularly useful compounds are those in which $R^1$ and $R^2$ are each a hydrogen atom, an alkyl group or a cycloalkyl group; $R^3$ is a hydrogen atom, an alkyl group, an alkoxy group, a hydroxyl group or a cycloalkyl group; and $R^4$, $R^5$, $R^6$, $R^7$, $R^8$ and $R^9$ are each a hydrogen atom, an alkyl group or a cycloalkyl group.

Synthesis method of the above compounds represented by Formula (H) is known, and they may be synthesized in accordance with U.S. Pat. No. 3,057,929; Chem. Bar., 1972, 95(5), pp 1673–1674; Chemistry Letters, 1980, pp 739–742.

The above compounds represented by Formula (H) may be used preferably in an amount of 5 to 300 mole %, more preferably 10 to 200 mole %, based on the above-mentioned magenta coupler of this invention.

Typical examples of the compounds represented by Formula (H) are shown below:

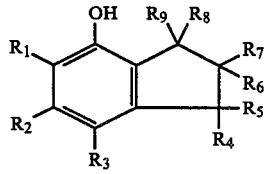

| Comp. No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| H-1 | H | H | H | H | H | H | H | H | H |
| 2 | $CH_3$ | H | H | H | H | H | H | H | H |
| 3 | H | H | H | H | H | H | H | $CH_3$ | $C_{16}H_{33}$ |
| 4 | H | H | OH | H | H | H | H | H | H |
| 5 | $CH_2{=}CHCH_2$ | H | Cl | H | H | H | H | H | H |
| 6 | H | H | H | H | H | H | H | $CH_3$ | $CH_3$ |
| 7 | H | H | H | $CH_3$ | $CH_3$ | H | H | H | H |
| 8 | H | H | H | $CH_3$ | $CH_3$ | $CH_3$ | H | H | H |
| 9 | $CH_2{=}CHCH_2$ | H | $CH_3O$ | H | H | H | H | H | H |
| 10 | H | H | H | $CH_3$ | $CH_3$ | H | H | $CH_3$ | $CH_3$ |
| 11 | H | $C_3H_7$ | H | $CH_3$ | $CH_3$ | H | H | $CH_3$ | $CH_3$ |
| 12 | Cl | H | Cl | H | H | H | H | $CH_3$ | $CH_3$ |
| 13 | H | H | H | H | 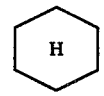 (Condensed) | | H | H | H |
| 14 | H | H | H | H | H | H | H | 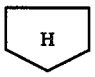 (Spiro) | |
| 15 | H | 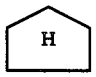 | H | $CH_3$ | $CH_3$ | H | H | $CH_3$ | $CH_3$ |
| 16 | H | $CH_3SO_2NH$ | H | $CH_3$ | $CH_3$ | H | H | $CH_3$ | $CH_3$ |
| 17 | H | $CH_3CO$ | H | H | H | H | H | $CH_3$ | $CH_3$ |
| 18 | H | 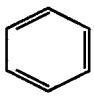 | H | $CH_3$ | $CH_3$ | H | H | $CH_3$ | $CH_3$ |
| 19 | H | 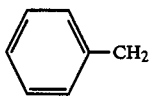 | H | $CH_3$ | $CH_3$ | H | H | $CH_3$ | $CH_3$ |

-continued

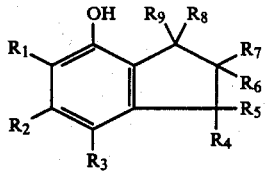

| Comp. No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| 21 | | 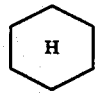 (Condensed) | $CH_3$ | H | H | H | H | $CH_3$ | $CH_3$ |
| 22 | H | H | H | $CH_3$ | 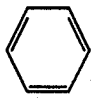 | H | H | $CH_3$ | $CH_3$ |

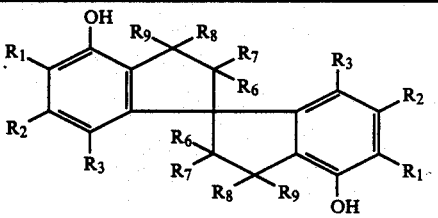

| Comp. No | $R_1$ | $R_2$ | $R_3$ | $R_6$ | $R_7$ | $R_8$ | $R_9$ |
|---|---|---|---|---|---|---|---|
| H-23 | H | H | H | H | H | H | H |
| 24 | H | H | OH | H | H | H | H |
| 25 | $CH_3$ | H | $CH_3$ | H | H | H | H |
| 26 | H | H | $CH_3$ | H | H | H | H |
| 27 | Cl | H | Cl | H | H | $CH_3$ | $CH_3$ |
| 28 | H | H | H | H | H | H | 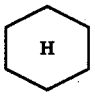 (Spiro) |
| 29 | H | H | H | H | H | $CH_3$ | 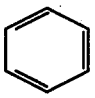 |
| 30 | H | H | 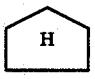 | H | H | H | H |
| 31 | H | H | 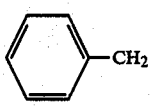 | H | H | $CH_3$ | $CH_3$ |
| 36 | H | H | (t)$C_4H_9$ | H | H | $CH_3$ | $CH_3$ |

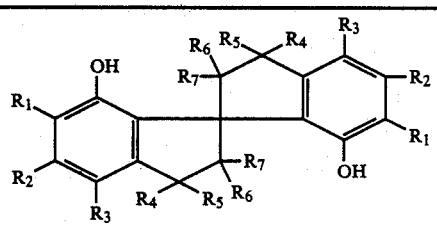

| Comp. No. | $R_1$ | $R_2$ | $R_3$ | $R_4$ | $R_5$ | $R_6$ | $R_7$ |
|---|---|---|---|---|---|---|---|
| H-32 | H | H | H | H | H | H | H |
| 33 | H | H | H | $CH_3$ | $CH_3$ | H | H |
| 34 | H | H | (t)$C_4H_9$ | $CH_3$ | $CH_3$ | H | H |
| 35 | H | H | (t)$C_8H_{17}$ | $CH_3$ | $CH_3$ | H | H |

H-20

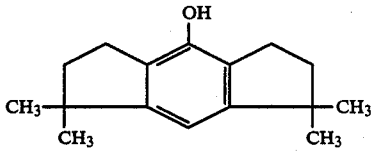

Formula (J)

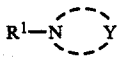

wherein, $R^1$ represents an aliphatic group, a cycloalkyl group or an aryl group; and Y represents a group of nonmetal atoms necessary for forming a heterocyclic ring of 5 to 7 members together with a nitrogen atom; provided that, when two or more hetero atoms are present in the nonmetal atom containing a nitrogen atom for forming the heterocyclic ring, at least two hetero atoms are hetero atoms which are not contiguous to each other.

The aliphatic group represented by $R^1$ may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, an ethenyl group, a propenyl group, etc.

The cycloalkyl group represented by $R^1$ may include a 5- to 7-membered cycloalkyl group which may have a substituent, which may include, for example, a cyclopentyl group, a cyclohexyl group, etc.

The aryl group represented by $R^1$ may include a phenyl group and a naphthyl group, which respectively may have a substituent.

The substituents for the aliphatic group, the cycloalkyl group and the aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic group, an alkylthio group, an arylthio group, etc., and these substituents may further have a substituent.

In the above Formula (J), Y, which represents a group of nonmetal atoms necessary for forming a heterocyclic ring of 5 to 7 members together with a nitrogen atom, at least two of the nonmetal atoms containing a nitrogen atom for forming the heterocyclic ring must be hetero atoms, and this at least two hetero atoms must not be contiguous to each other. If, in the heterocyclic ring of the compound represented by Formula (J), all of the hetero atoms are contiguous to each other, the performance as a magenta dye image stabilizing agent will not be attained, undesirably.

The above heterocyclic ring of 5 to 7 members of the compound represented by Formula (J) may have a substituent, and the substituent may include an alkyl group, an aryl group, an acyl group, a carbamoyl group, an alkoxycarbonyl group, a sulfonyl group, a sulfamoyl group, etc., which may further have a substituent. Also, the heterocyclic ring of 5 to 7 members may be saturated, and a saturated heterocyclic ring is preferred. Further, a benzene ring, etc. may be condensed, or a spiro ring may be formed.

The above compounds represented by Formula (J) may be used preferably in an amount of 5 to 300 mole %, more preferably 10 to 200 mole %, based on the above-mentioned magenta coupler represented by Formula (1) of this invention.

Typical examples of the compounds represented by Formula (J) are shown below:

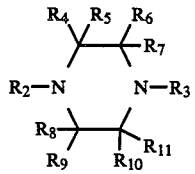

| | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| J-1 | $C_{12}H_{25}$ | $C_{12}H_{25}$ | H | H | H | H | H | H | H | H |
| J-2 | $C_{14}H_{29}$ | $C_{14}H_{29}$ | H | H | H | H | H | H | H | H |
| J-3 | $C_{14}H_{29}$ | H | H | H | H | H | H | H | H | H |
| J-4 | $C_{14}H_{29}$ | $CH_3CO$ | H | H | H | H | H | H | H | H |
| J-5 | $C_{16}H_{33}$ | $C_{16}H_{33}$ | H | H | H | H | H | H | H | H |
| J-6 | $C_{14}H_{29}$ | $CH_3$ | H | H | H | H | H | H | H | H |
| J-7 | 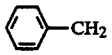 | 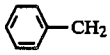 | H | H | H | H | H | H | H | H |
| J-8 | 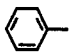 | 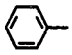 | H | H | H | H | H | H | H | H |
| J-11 | $CH_3$ | 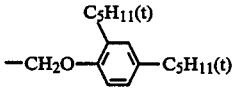 | H | H | H | H | H | H | H | H |
| J-13 | $C_{14}H_{29}$ | $C_4H_9NHCO$ | H | H | H | H | H | H | H | H |
| J-14 | $(t)C_8H_{17}$ | 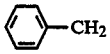 | H | H | H | H | H | H | H | H |
| J-15 | $C_{14}H_{29}$ | $CF_3CO$ | H | H | H | H | H | H | H | H |
| J-16 | $C_{14}H_{29}$ | $C_2H_5OCO$ | H | H | H | H | H | H | H | H |
| J-17 | $CH_3$ | 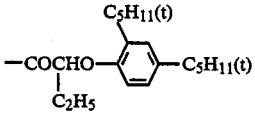 | H | H | H | H | H | H | H | H |
| J-18 | $C_{14}H_{29}$ | $C_{14}H_{29}$ | $CH_3$ | H | H | H | H | H | H | H |
| J-19 | $C_{14}H_{29}$ | $C_{14}H_{29}$ | $CH_3$ | H | H | H | H | H | $CH_3$ | H |
| J-20 | $C_{14}H_{29}$ | $C_{14}H_{29}$ | $CH_3$ | $CH_3$ | $CH_3$ | $CH_3$ | $CH_3$ | $CH_3$ | $CH_3$ | $CH_3$ |

-continued

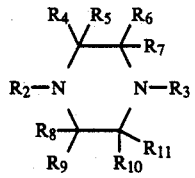

| | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| J-21 | $CH_3$ | 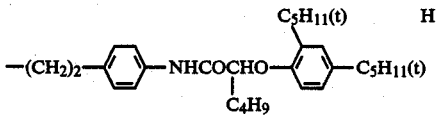 | H | H | H | H | H | H | H | H |
| J-22 | $C_{12}H_{25}$ | $CH_3$ | $CH_3$ | H | H | H | $CH_3$ | H | H | H |
| J-23 | $C_{12}H_{25}$ | $C_{12}H_{25}$ | $CH_3$ | H | H | H | H | H | $CH_3$ | H |
| J-24 | $C_{16}H_{33}$ | $C_{16}H_{33}$ | $CH_3$ | H | H | H | H | H | $CH_3$ | H |
| J-25 | $C_6H_5CH{=}CH{-}CH_2{-}$ | $C_{12}H_{25}$ | H | H | H | H | H | H | H | H |
| J-26 | $C_{12}H_{25}$ | $C_2H_5$ | $CH_3$ | H | H | H | H | H | H | H |
| J-27 | $C_{16}H_{33}$ | H | $C_2H_5$ | H | H | H | H | H | H | H |
| J-29 | $C_{14}H_{29}$ | $CH_2BrCH_2$ | H | H | H | H | H | H | H | H |
| J-30 | $CH_3O(CH_2)_4{-}$ | $CH_3O(CH_2)_4$ | H | H | H | H | H | H | H | H |

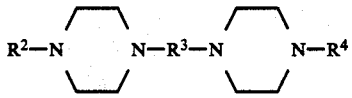

| | $R^2$ | $R^3$ | $R^4$ |
|---|---|---|---|
| J-9 | $C_{14}H_{29}$ | $(CH_2)_2$ | $C_{14}H_{29}$ |
| J-10 | $(t)C_8H_{17}$ | $(CH_2)_6$ | $(t)C_8H_{17}$ |
| J-12 | $C_{14}H_{29}$ | $CH_2$ | $C_{14}H_{29}$ |

-continued

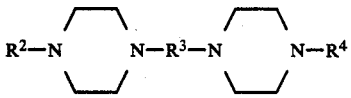

| | $R^2$ | $R^3$ | $R^4$ |
|---|---|---|---|
| J-28 | $C_{12}H_{25}$ | 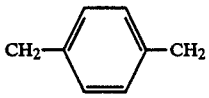 | $C_{12}H_{25}$ |

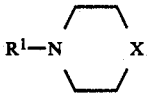

| | X | $R_1$ |
|---|---|---|
| J-31 | O | $C_{12}H_{25}$ |
| J-32 | O | $C_{14}H_{29}$ |
| J-33 | O | $C_6H_5CH{=}CH{-}$ |
| J-34 | O | 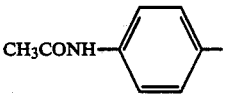 |
| J-35 | O | α-naphtyl |
| J-36 | O | 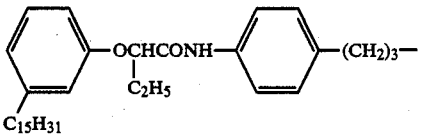 |
| J-37 | O | 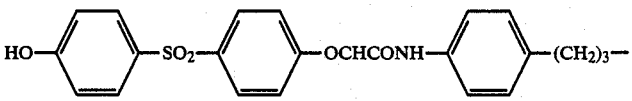 |

-continued
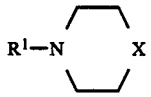
| | X | $R_1$ |
|---|---|---|
| J-38 | O | 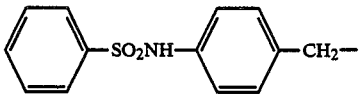 |
| J-39 | O | 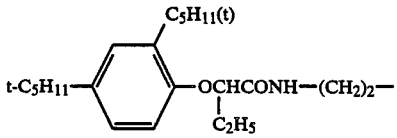 |
| J-40 | O | 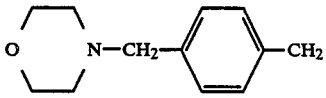 |
| J-41 | S | $C_{14}H_{29}$ |
| J-42 | S | 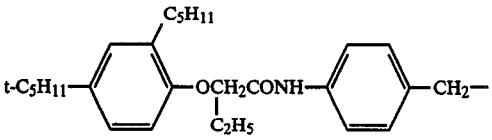 |
| J-43 | S | 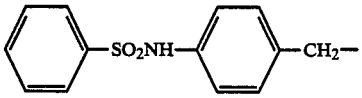 |
| J-44 | S | 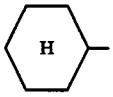 |
| J-45 | S | 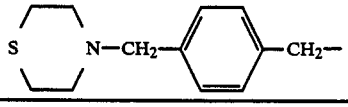 |
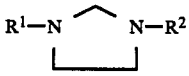
| | $R^1$ | $R^2$ |
|---|---|---|
| J-46 | $C_{12}H_{25}$ | $C_{12}H_{25}$ |
| J-47 | $C_{14}H_{29}$ | $C_{14}H_{29}$ |
| J-48 | $C_6H_5CH_2$ | $C_6H_5CH_2$ |
| J-49 | $C_{16}H_{33}$ | H |
| J-50 | $C_{16}H_{33}$ | $CH_3CO$ |
| J-51 | $C_{16}H_{33}$ | $C_{16}H_{33}$ |
| J-52 | $C_{14}H_{29}$ | $C_{14}H_{29}$ |
| J-53 | $C_{12}H_{25}$ | $C_{12}H_{25}$ |
| J-54 | $C_{14}H_{29}$ | $CH_3CO$ |
| J-55 | $C_{14}H_{29}$ | $CF_3CO$ |
| J-56 | $C_2H_5$ | 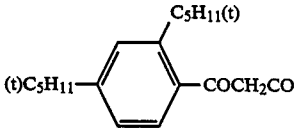 |

-continued
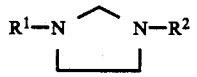
| | $R^1$ | $R^2$ |
|---|---|---|
| J-57 | $C_{14}H_{29}$ | $C_2H_5OCO$ |
| J-58 | $C_{14}H_{29}$ | $CH_3NHCO$ |
| J-59 | $C_{14}H_{29}$ | $C_4H_9O_2$ |
| J-60 | $C_{14}H_{29}$ | $(CH_3)_2NSO_2$ |
| J-61 | $C_{12}H_{25}$ | 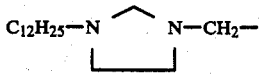 |
| J-62 | H | 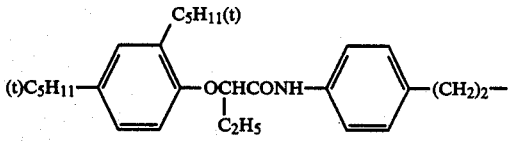 |
| J-63 | 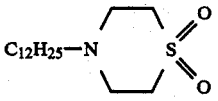 | |
| J-64 | 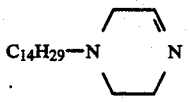 | |
| J-65 | 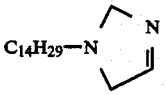 | |
| J-66 | 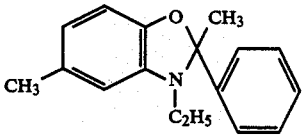 | |
| J-67 | 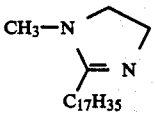 | |
| J-68 | 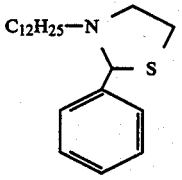 | |
| J-69 | 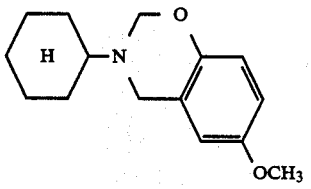 | |

-continued

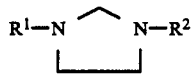

| | $R^1$ | $R^2$ |
|---|---|---|
| J-70 | 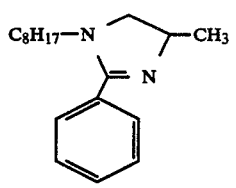 | |
| J-71 | 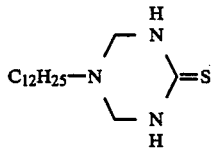 | |
| J-72 | 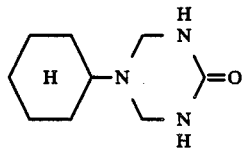 | |
| J-73 | 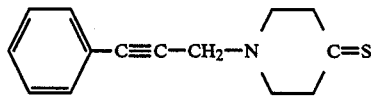 | |
| J-74 | 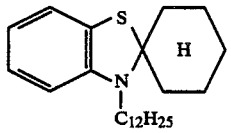 | |

Of the compounds represented by Formula (J), particularly preferable are piperazine series compounds and homopiperazine series compounds, and more preferably, they are the compounds represented by Formula (J-1) or (J-2) shown below:

Formula (J-1)

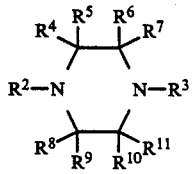

Formula (J-2)

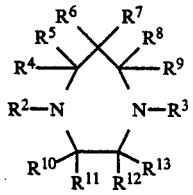

In the formulas, $R^2$ and $R^3$ each represent a hydrogen atom, an alkyl group or an aryl group, provided that R2 and R3 are not hydrogen atoms at the same time. $R^4$ to $R^{13}$ each represent a hydrogen atom, an alkyl group or an aryl group.

In the above Formulas (J-1) and (J-2), wherein $R^2$ and $R^3$ each represent a hydrogen atom, an alkyl group or an aryl group, the alkyl group represented by $R^2$ or $R^3$ may include, for example, a methyl group, an ethyl group, a butyl group, an octyl group, a dodecyl group, a tetradecyl group, a hexadecyl group, an octadecyl group, etc. The aryl group represented by $R^2$ or $R^3$ may included a phenyl group, etc. The alkyl group and the aryl group represented by $R^2$ or $R^3$ may have a substituent, and the substituent may include a halogen atom, an alkyl group, an aryl group, an alkoxy group, an aryloxy group, a heterocyclic group, etc.

The sum of the number of the carbon atoms of $R^2$ and $R^3$ (including their substituents) is preferably 6 to 40.

In the above Formulas (J-1) and (J-2), wherein $R^4$ to $R^{13}$ each represent a hydrogen atom, an alkyl group or an aryl group, the alkyl group represented by $R^4$ to $R^{13}$ may include, for example, a methyl group, an ethyl group, etc. The aryl group represented by $R^4$ to $R^{13}$ may include a phenyl group, etc.

Examples of the compounds represented by Formula correspond to the compounds disclosed in the exemplary piperazine series compounds (J-1) to (J-30) and the exemplary homopiperazine series compounds (J-51) to (J-62).

Synthesis examples for typical magenta dye image stabilizing agents of the invention represented by the above Formula (J) are shown in the following:

Synthesis Example 1

(Synthesis of Compound J-2)

To 100 ml of acetone in which 9.0 g of piperazine and 55 g of myristylbromide were dissolved, 15 g of anhydrous potassium carbonate was added to carry out reaction while boiling under reflux for 10 hours. After the reaction was completed, the reaction mixture was emptied to 500 ml of water, followed by extraction with 500 ml of ethyl acetate. After the layer of ethyl acetate was dried with use of magnesium sulfate, the ethyl acetate was evaporated to obtain resultant white crystals, which were recrystallized with use of 300 ml of acetone to obtain 34 g of white scaly crystals (Yield: 70%). m.p.: 55° to 58° C.

Synthesis Example 2

(Synthesis of Compound J-34)

After 18 g of 4-morpholinoaniline was dissolved in 100 ml of ethyl acetate, 12 ml of acetic anhydride was added little by little with stirring, while maintaining the reaction mixture to 20° C. After acetic anhydride was added, the reaction mixture was ice-cooled to collect by filtration the crystals precipitated, followed by recrystallization with use of ethyl acetate to obtain 16.5 g of white powdery crystals (Yield: 75%). m.p.: 207° to 210° C.

Formula (K)

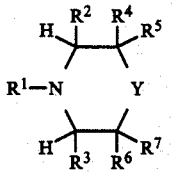

In the formula, $R^1$ represents an aliphatic group, a cycloalkyl group or an aryl group, and Y represents a simple bond arm or a divalent hydrocarbon group necessary for forming a heterocyclic ring of 5 to 7 members together with a nitrogen atom. $R^2$, $R^3$, $R^4$, $R^5$, $R^6$ and $R^7$ each represent a hydrogen atom, an aliphatic group, a cycloalkyl group or an aryl group. However, $R^2$ and $R^4$, and $R^3$ and $R^6$ each may be bonded to each other to form simple bond arms to form a heterocyclic ring of 5 to 7 members together with a nitrogen atom and Y. Also, when Y is the simple bond arm, $R^5$ and $R^7$ may be bonded to each other to form the simple bond arm to form an unsaturated heterocyclic ring of 5 members together with Y. When Y is not the simple bond arm, $R^5$ and Y, and $R^7$ and Y or Y itself may form unsaturated bonds to form an unsaturated heterocyclic ring of 6 or 7 members together with a nitrogen atom and Y.

The aliphatic group represented by $R^1$ may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, an ethenyl group, a propenyl group, etc.

The cycloalkyl group represented by $R^1$ may include a cycloalkyl group of 5 to 7 members which may have a substituent, for example, a cyclopentyl group, a cyclohexyl group, etc.

The aryl group represented by $R^1$ may include a phenyl group and a naphthyl group, each of which may have a substituent.

The substituents for the aliphatic group, the cycloalkyl group and the aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic ring, an alkylthio group, an arylthio group, etc., and these substituents may further have a substituent.

In the above Formula (K), wherein Y represents a simple bond arm or a divalent hydrocarbon group necessary for forming a heterocyclic ring of 5 to 7 members together with a nitrogen atom, and when Y is the simple bond arm, $R^5$ and $R^7$ may further be bonded to each other to form a simple bond arm to form an unsaturated heterocyclic ring of 5 members; when Y is the divalent hydrocarbon group, namely a methylene group, $R^5$ and Y, or $R^7$ and Y may form an unsaturated bond to form an unsaturated heterocyclic ring of 6 members, and when it is an ethylene group, $R^5$ and Y, $R^7$ and Y, or Y itself may form an unsaturated bond to form an unsaturated heterocyclic ring of 7 members. Further, the divalent hydrocarbon represented by Y may have a substituent, and such a substituent may include an alkyl group, a carbamoyl group, an alkyloxycarbonyl group, an acylamino group, a sulfonamide group, a sulfamoyl group, an aryl group, a heterocyclic group, etc.

In the above Formula (K), wherein $R^2$, $R^3$, $R^4$, $R^5$, $R^6$ and $R^7$ each represent a hydrogen atom, an aliphatic group, a cycloalkyl group or an aryl group, the aliphatic group represented by $R^2$ to $R^7$ may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, an ethenyl group, a propenyl group, etc.

The cycloalkyl group represented by $R^2$ to $R^7$ may include a cycloalkyl group of 5 to 7 members which may have a substituent, for example, a cyclopentyl group, a cyclohexyl group, etc.

The aryl group represented by $R^2$ to $R^7$ may include a phenyl group and a naphthyl group, each of which may have a substituent. The substituents for the aliphatic group, the cycloalkyl group and the aryl group represented by $R^2$ to $R^7$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic group, an alkylthio group, etc.

The compound represented by the above Formula (K) is more preferable when it has a saturated heterocyclic ring of 5 to 7 members than when it has an unsaturated one.

The compound represented by the above Formula (K) may be used preferably in an amount of 5 to 300 mole %, more preferably 10 to 200 mole %, based on the magenta coupler represented by the above Formula (I) of the invention.

Typical examples of the compound represented by the above Formula (K) are shown below:

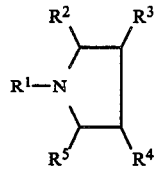

| | $R^1$ | $R^2$ | $R^3$ | $R^4$ | $R^5$ |
|---|---|---|---|---|---|
| K-1 | $C_8H_{17}$ | H | H | H | H |
| K-2 | 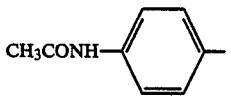 | H | H | H | H |
| K-3 | 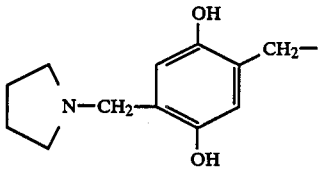 | H | H | H | H |
| K-4 | $C_{12}H_{25}$ | H | H | H | H |
| K-5 | $C_{14}H_{29}$ | H | H | H | H |
| K-6 | $C_{16}H_{33}$ | H | H | H | H |
| K-7 | $C_{14}H_{29}$ | H | 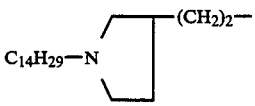 | H | H |
| K-8 | 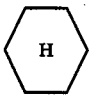 | $CH_3$ | $CH_3$ | H | H |
| K-9 | $C_6H_5CH{=}CHCH_2-$ | H | H | H | H |
| K-10 | 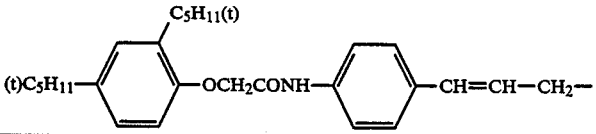 | H | H | H | H |

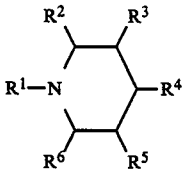

| | $R^1$ | $R^2$ | $R^3$ | $R^4$ | $R^5$ | $R^6$ |
|---|---|---|---|---|---|---|
| K-11 | (t)$C_8H_{17}$ | H | H | H | H | H |
| K-12 | 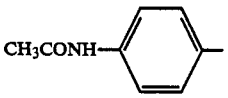 | H | H | H | H | H |
| K-13 | $C_{12}H_{25}$ | H | H | H | H | H |
| K-14 | $C_{14}H_{29}$ | H | H | H | H | H |
| K-15 | $C_{16}H_{33}$ | H | H | H | H | H |
| K-16 | $C_{14}H_{29}$ | $CH_3$ | H | H | H | H |

-continued
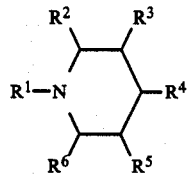
| | $R^1$ | $R^2$ | $R^3$ | $R^4$ | $R^5$ | $R^6$ |
|---|---|---|---|---|---|---|
| K-17 | 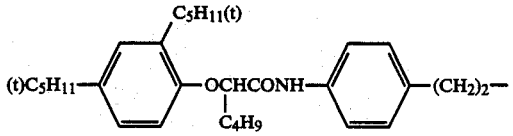 | | | H | H | H |
| K-18 | $C_8H_{17}$ | $CH_3$ | $CH_3$ | H | $CH_3$ | $CH_3$ |
| K-19 | 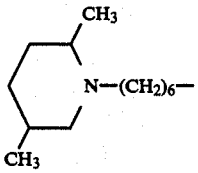 | $CH_3$ | H | H | $CH_3$ | H |
| K-20 | $CH_3$ | H | H | $C_{12}H_{25}OCOCH_2$— | H | H |
| K-21 | $CH_3$ | $CH_3$ | H | $C_{16}H_{33}OCOCH_2$— | H | $CH_3$ |
| K-22 | $CH_3$ | $C_{16}H_{33}$ | H | H | H | H |
| K-23 | $C_6H_5$ | H | H | $C_{12}H_{25}OCO$— | H | H |
| K-24 | $CH_3$ | $C_6H_5$ | H | H | H | H |
| K-25 | 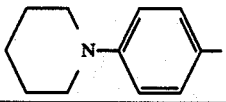 | H | H | H | H | H |
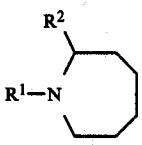
| | $R^1$ | $R^2$ |
|---|---|---|
| K-26 | $C_8H_{17}$ | H |
| K-27 | 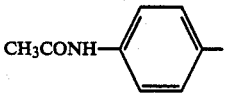 | H |
| K-28 | 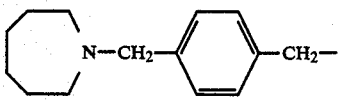 | H |
| K-29 | $C_{14}H_{29}$ | H |
| K-30 | 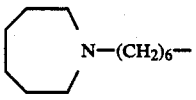 | H |
| K-31 | $C_{16}H_{33}$ | $CH_3$ |

-continued

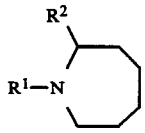

| | $R^1$ | $R^2$ |
|---|---|---|
| K-32 | 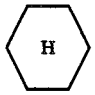 | H |
| K-33 | 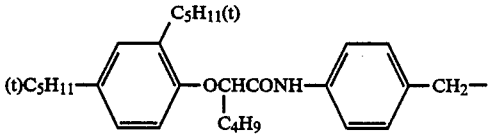 | H |
| K-34 | 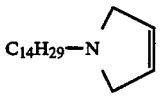 | |
| K-35 | 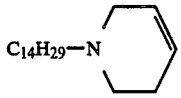 | |
| K-36 | 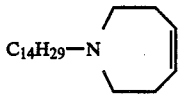 | |
| K-37 | 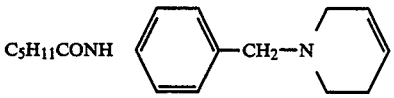 | |
| K-38 | 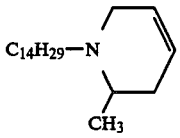 | |
| K-39 | 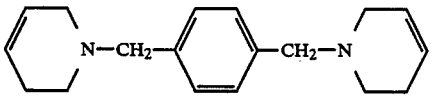 | |
| K-40 | 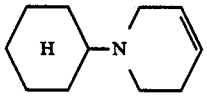 | |
| K-41 | 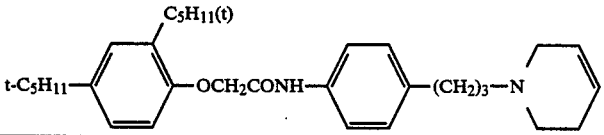 | |

Next, a synthesis example for the compound represented by the above Formula (K) is shown below:

Synthesis Example 1

(Synthesis of Compound K-14)

To 60 ml of acetone in which 9.0 g of piperazine and 28 g of myristylbromide were dissolved, 6.0 g of anhydrous potassium carbonate was added to carry out reaction while boiling under reflux for 20 hours. After the reaction was completed, the reaction mixture was emptied to 300 ml of water, followed by extraction with 300 ml of ethyl acetate. After the layer of ethyl acetate was dried with use of magnesium sulfate, the ethyl acetate was evaporated to obtain resultant white crystals, which were recrystallized with use of 100 ml of acetone to obtain 12 g of white scaly crystals (Yield: 43%). m.p.: 175° to 180° C.

Formula (L)

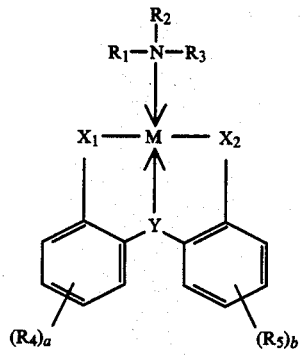

Formula (M)

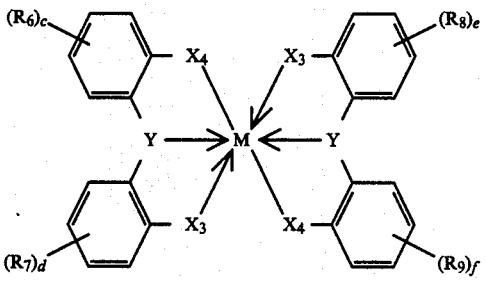

In Formulas (L) and (M), $X^1$, $X^2$ and $X^4$ each represents an oxygen atom, a sulfur atom or an —$NR^{10}$— group ($R^{10}$ represents a hydrogen atom, an alkyl group, an aryl group or a hydroxyl group); $X^3$ represents a hydroxyl group or a mercapto group; Y represents an oxygen atom or a sulfur atom; $R^1$, $R^2$ and $R^3$ each represents a hydrogen atom, an alkyl group or an aryl group, provided that at least one of $R^1$, $R^2$ and $R^3$ represents an alkyl group or an aryl group; $R^4$, $R^5$, $R^6$, $R^7$, $R^8$ and $R^9$ each represent an alkyl group, an aryl group, an alkoxy group, an aryloxy group, an alkoxycarbonyl group, an aryloxycarbonyl group, an acyl group, an acylamino group, an alkylamino group, a carbamoyl group, a sulfamoyl group, a sulfonamide group, a sulfonyl group or a cycloalkyl group, and they may be linked to each other to form a 5- or 6-membered ring; M represents a metal atom; and a, b, c, d, e and f each represents an integer of 0 to 4.

In this invention, the metal complex represented by the above Formula (L) and Formula (M) may be used alone. Alternatively, two or more kinds of the compounds represented by the above general formulas or one or more kinds of each of the compounds represented by the general formulas may be used in combination. In either cases, the object of this invention can be achieved sufficiently. $X^1$, $X^2$ and $X^4$ in Formulas (L) and (M) may be the same or different each other, and they each represent an oxygen atom, a sulfur atom or a —$NR^{10}$— group {$R^{10}$ represents a hydrogen atom, an alkyl group (for example, a methyl group, an ethyl group, an n-propyl group, an i-propyl group, an n-butyl group, a t-butyl group, an i-butyl group, a benzyl group, etc.), an aryl group (for example, a phenyl group, a tolyl group, a naphthyl group, etc.) or a hydroxyl group.}, preferably they each represent an oxygen atom or a sulfur atom, and more preferably, an oxygen atom.

$X^3$ in Formula (M) represents a hydroxyl group or a mercapto group, and preferably represents a hydroxyl group.

Y in Formula (L) and Formula (M) (although two "Y"s are present in Formula (M), they each other may be the same or different) represents an oxygen atom or a sulfur atom, and preferably represents a sulfur atom.

In Formulas (L) and (M), $R^4$, $R^5$, $R^6$, $R^7$, $R^8$ and $R^9$ each represent an alkyl group (for example, a straight-chain or branched alkyl group having 1 to 20 carbon atoms, including a methyl group, an ethyl group, an n-propyl group, an n-butyl group, an n-octyl group, a t-octyl group, an n-hexadecyl group etc.), an aryl group (for example, a phenyl group, a naphthyl group, etc.), an alkoxy group (for example, a straight-chain or branched alkyloxy group including a methoxy group, an n-butoxy group, a t-butoxy group, etc.), an aryloxy group (for example, a phenyl group, etc.), an alkoxycarbonyl group (for example, a straight-chain or branched alkyloxycarbonyl group including an n-pentyloxycarbonyl group, a t-pentyloxycarbonyl group, an n-octyloxycarbonyl group, a t-octyloxycarbonyl group, etc.), an aryloxycarbonyl group (for example, a phenoxycarbonyl group, etc.), an acyl group (for example, a straight-chain or branched alkylcarbonyl group including an acetyl group, a stearoyl group, etc.), an acylamino group (for example, a straight-chain or branched alkylcarbonylamino group including an acetamide group, etc., and an arylcarbonylamino group including a benzoylamino group, etc.), an arylamino group (for example, an N-phenylamino group, etc.), an alkylamino group (for example, a straight-chain or branched alkylamino group including an N-n-butylamino group, an N,N-diethylamino group, etc.), a carbamoyl group (for example, a straight-chain or branched alkylcarbamoyl group including an n-butylcarbamoyl group, etc.), a sulfamoyl group (for example, a straight-chain or branched alkylsulfamoyl group including an N,N-di-n-butylsulfamoyl group, an N-n-dodecylsulfamoyl group, etc.), a sulfonamide group (for example, a straight-chain or branched alkylsulfonylamino group including a methylsulfonylamino group, etc., an arylsulfonylamino group including a phenylsulfonylamino group, etc.), a sulfonyl group (for example, a straight-chain or branched alkylsulfonyl group including a mesyl group, etc., an arylsulfonyl group including a tosyl group, etc.) or a cycloalkyl group (for example, a cyclohexyl group, etc.). Also, two substituents may be ring-closed to form a 5- or 6-membered ring (for example, a benzene ring).

M in Formulas (L) and (M) represents a metal atom, which is preferably a transition metal including a nickel atom, a copper atom, a cobalt atom, a palladium atom, an iron atom, a platinum atom, etc., and particularly preferably a nickel atom.

$R^1$, $R^2$ and $R^3$ in Formula (L) represents a straight-chain or branched alkyl group (for example, a methyl group, an ethyl group, an n-propyl group, an n-butyl group, an n-octyl group, an n-hexadecyl group, etc.) or an aryl group (for example, a phenyl group, a naphthyl group, etc.).

These alkyl group and aryl group may be condensed with a substituent (for example, an alkoxy group, an aryloxy group, an alkoxycarbonyl group, an aryloxycarbonyl group, an acyl group, an acylamino group, an arylamino group, an alkylamino group, a carbamoyl group, a sulfamoyl group, a sulfonamide group, a sulfonyl group, a cycloalkyl group, etc.)
Examples of typical metal complexes according to this invention are shown below, to which, however, they are not limited.
L-1
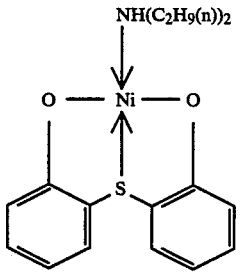
L-2
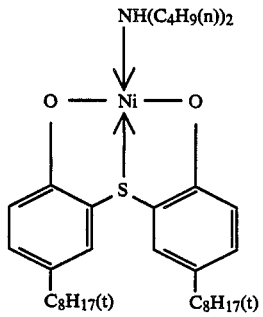
L-3
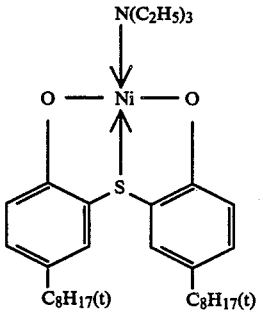
L-4
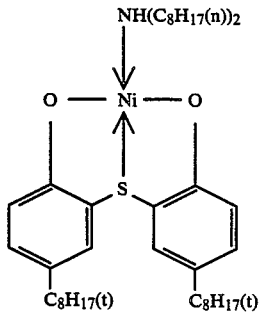
L-5
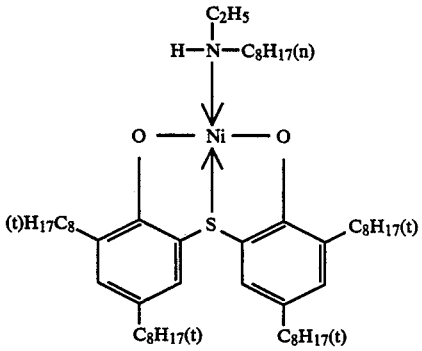
L-6
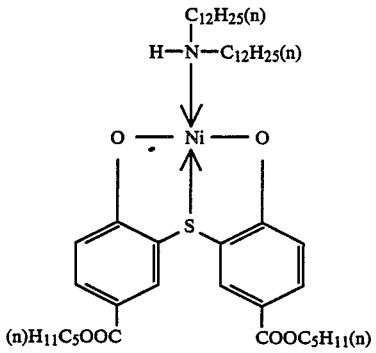
L-7
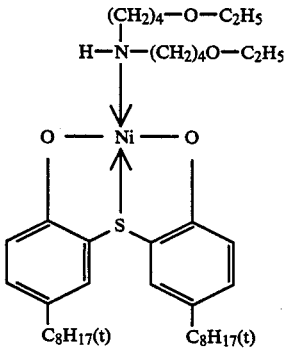
L-8
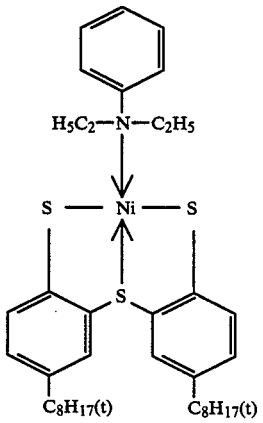

-continued
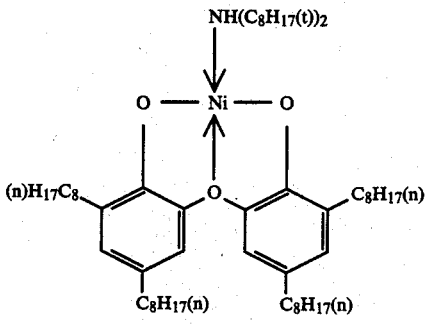
L-9
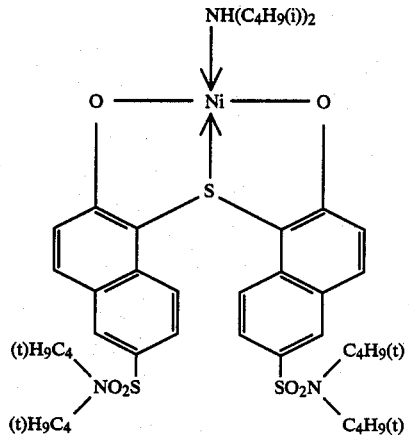
L-10
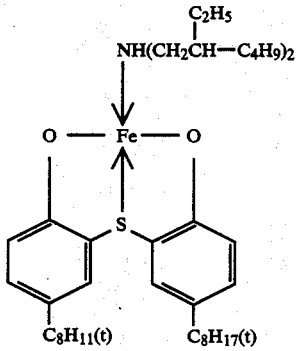
L-11
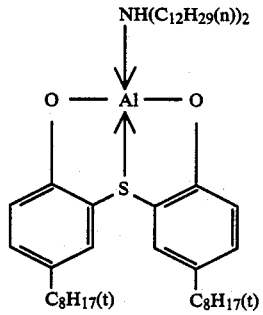
L-12
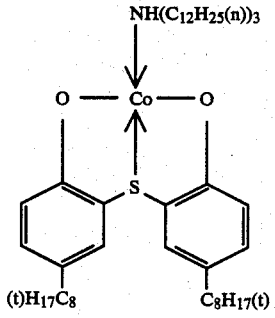
L-13
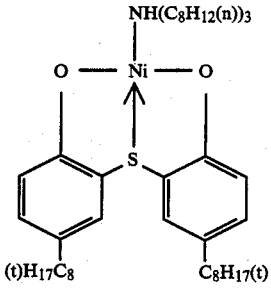
L-14
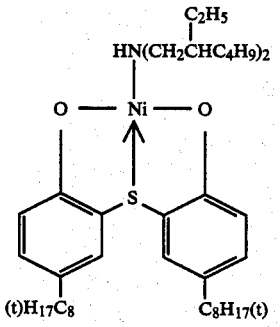
L-15
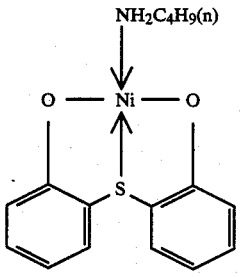
L-16

-continued
L-17
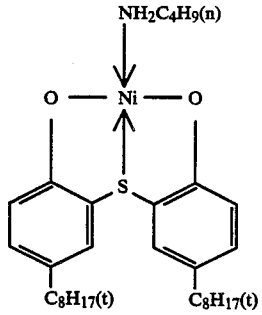
L-18
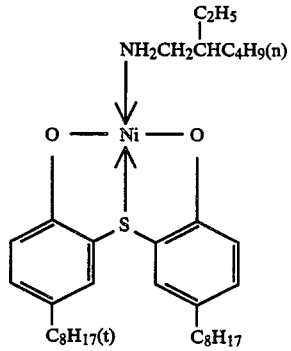
L-19
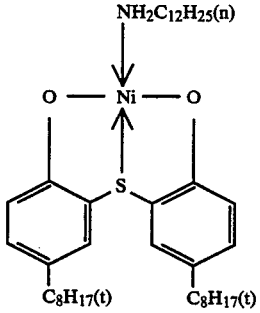
L-20
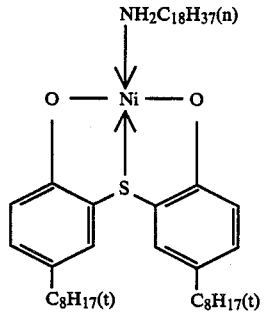
M-1
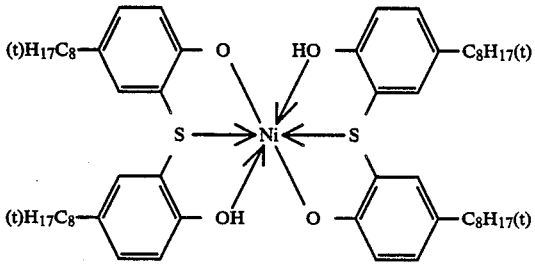
M-2
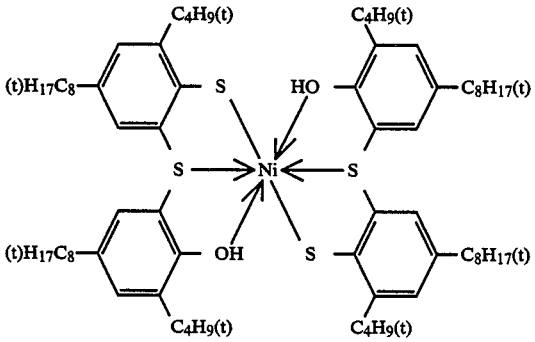
M-3
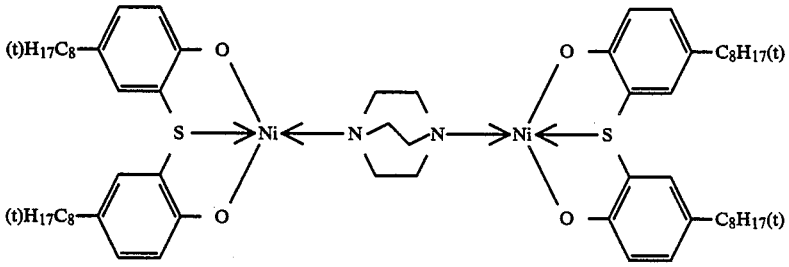

Formula (N)

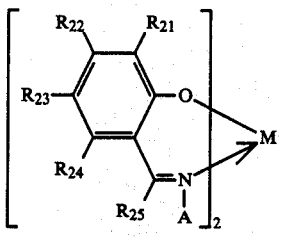

In Formula (N), $R^{21}$, $R^{22}$, $R^{23}$ and $R^{24}$ each represent a hydrogen atom, a halogen atom, a hydroxyl group, a cyano group, or an alkyl group, an aryl group, a cycloalkyl group or a heterocyclic group which is bonded to a carbon atom on a benzene ring directly or indirectly through a divalent linking group. Also, $R^{21}$ and $R^{22}$, $R^{22}$ and $R^{23}$, or $R^{23}$ and $R^{24}$ may be bonded to each other to form a 6-membered ring.

$R^{25}$ represents a hydrogen atom, an alkyl group or an aryl group. A represents a hydrogen atom, an alkyl group, an aryl group or a hydroxyl group. M represents a metal atom.

In Formula (N), the halogen atom represented by $R^{21}$, $R^{22}$, $R^{23}$ and $R^{24}$ may include a fluorine atom, a chlorine atom, a bromine atom and an iodine atom.

The alkyl group represented by $R^{21}$, $R^{22}$, $R^{23}$ and $R^{24}$ may include preferably an alkyl group having 1 to 19 carbon atoms, which may be any of straight-chain alkyl group or branched alkyl group and may have a substituent.

The aryl group represented by $R^{21}$, $R^{22}$, $R^{23}$ and $R^{24}$ may include preferably an aryl group having 6 to 14 carbon atoms, which may have a substituent.

The heterocyclic group represented by $R^{21}$, $R^{22}$, $R^{23}$ and $R^{24}$ may be preferably of a 5-membered ring or a 6-membered ring, which may have a substituent.

The cycloalkyl group represented by $R^{21}$, $R^{22}$, $R^{23}$ and $R^{24}$ may be preferably of a 5-membered ring or a 6-membered ring, which may have a substituent.

The 6-membered ring formed by bonding $R^{21}$ and $R^{22}$ to each other may include, for example, he following:

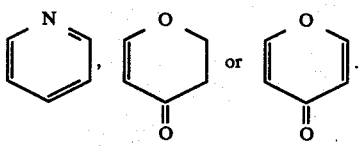

The 6-membered ring formed by bonding $R^{22}$ and $R^{23}$ or $R^{23}$ and $R^{24}$ to each other may include preferably a benzene ring, which benzene ring may have a substituent or may have been bonded.

The alkyl group represented by $R^{21}$, $R^{22}$, $R^{23}$ and $R^{24}$ may include, for example, a methyl group, an ethyl group, a propyl group, a butyl group, a t-butyl group, a hexyl group, an octyl group, a decyl group, a dodecyl group, a tetradecyl group, a hexadecyl group and an octadecyl group.

The aryl group represented by $R^{21}$, $R^{22}$, $R^{23}$ and $R^{24}$ may include, for example, a phenyl group and a naphthyl group.

The heterocyclic group represented by $R^{21}$, $R^{22}$, $R^{23}$ and $R^{24}$ may be preferably a 5- or 6-membered heterocyclic group having as a hetero atom in the ring at least one of a nitrogen atom, oxygen atom or a sulfur atom, including, for example, a furyl group, a hydrofuryl group, a thienyl group, a pyrolyl group, a pyrolidyl group, a pyridyl group, an imidazolyl group, a pyrazolyl group, a quinolyl group, an indolyl group, an oxazolyl group, a thiazolyl group, etc.

The cycloalkyl group represented by $R^{21}$, $R^{22}$, $R^{23}$ and $R^{24}$ may include, for example, a cyclopentyl group, a cyclohexyl group, an cyclohexyl group, a cyclohexadienyl group, etc.

The 6-membered ring formed by bonding $R^{21}$, $R^{22}$, $R^{23}$ and $R^{24}$ to each other may include, for example, a benzene ring, a naphthalene ring, an isobenzothiophene ring, an isobenzofuran ring, an isoindone ring, etc.

The above alkyl group, the cycloalkyl group, the aryl group or the heterocyclic group represented by $R^{21}$, $R^{22}$, $R^{23}$ and $R^{24}$ may be bonded to a carbon atom on the benzene ring through a divalent linking group including, for example, an oxy group (—O—), a thio group (—S—), an amino group, an oxycarbonyl group, a carbonyl group, a carbamoyl group, a sulfamoyl group, a carbonylamino group, a sulfonylamino group, a sulfonyl group, a carbonyloxy group, etc.

Examples in which the alkyl group represented by $R^{21}$, $R^{22}$, $R^{23}$ and $R^{24}$ are bonded to a carbon atom on the benzene ring through the above divalent linking group, may include an alkoxy group (for example, a methoxy group, an ethoxy group, a butoxy group, a propoxy group, a 2-ethylhexyloxy group, an n-decyloxy group, an n-dodecyloxy group, an n-hexadecyloxy group, etc.), an alkoxycarbonyl group (for example, a methoxycarbonyl group, an ethoxycarbonyl group, a butoxycarbonyl group, an n-decyloxycarbonyl group, an n-hexadecyloxycarbonyl group, etc.), an acyl group (for example, an acetyl group, a valeryl group, a stearoyl group, a benzoyl group, a toluoyl group, etc.), an acyloxy group (for example, an acetoxy group, a hexadecylcarbonyloxy group, etc.), an alkylamino group, (for example, an n-butylamino group, an N,N-diethylamino group, an N,N-didecylamino group, etc.), an alkylcarbamoyl group (for example, a butylcarbamoyl group, an N,N-diethylcarbamoyl group, an n-dodecylcarbamoyl group, etc.), an alkylsulfamoyl group (for example, a butylsulfamoyl group, an N,N-diethylsulfamoyl group, an n-dodecylsulfamoyl group, etc.), a sulfonylamino group (for example, a methylsulfonylamino group, a butylsulfonylamino group, etc.), a sulfonyl group (for example, a mesyl group, an ethanesulfonyl group, etc.) or an acylamino group (for example, an acetylamino group, a valerylamino group, a palmitoylamino group, a benzoylamino group, a toluoylamino group, etc.).

Examples in which the cycloalkyl group represented by $R^{21}$, $R^{22}$, $R^{23}$ and $R^{24}$ is bonded to a carbon atom on the benzene ring through the above divalent linking group, may include a cyclohexyloxy group, a cyclohexylcarbonyl group, a cyclohexyloxycarbonyl group, a cyclohexylamino group, a cyclohexenylcarbonyl group, a cyclohexenyloxy group, etc.

Examples in which the aryl group represented by $R^{21}$, $R^{22}$, $R^{23}$ and $R^{24}$ is bonded to a carbon atom on the benzene ring through the above divalent linking group, may include an aryloxy group (for example, a phenoxy group, a naphthoxy group, etc.), an aryloxycarbonyl group (for example, a phenoxycarbonyl group, a naphthoxycarbonyl group, etc.), an acyl group (for example, a benzoyl group, a naphthoyl group, etc.), an anilino group (for example, a phenylamino group, an N-methylanilino group, an N-acetylanilino group, etc.), an acyloxy group (for example, a benzoyloxy group, a toluoyloxy group, etc.), an arylcarbamoyl group (for example, a phenylcarbamoyl group, etc.), an arylsulfamoyl group (for example, a phenylsulfamoyl group, etc.), an arylsulfonylamino group (for example, a phenylsulfonylamino group, a p-tolylsulfonylamino group, etc.), an arylsulfonyl group (for example, a benzenesulfonyl group, a tosyl group, etc.) or an acylamino group (for example, a benzoylamino group, etc.).

The alkyl group, the aryl group, the heterocyclic group and the cycloalkyl group each represented by $R^{21}$, $R^{22}$, $R^{23}$ and $R^{24}$ or the 6-membered ring formed by bonding $R^{21}$ and $R^{22}$, $R^{22}$ and $R^{23}$ or $R^{23}$ and $R^{24}$ to each other may be substituted with those including a halogen atom (for example, a chlorine atom, a bromine atom, a fluorine atom, etc.), a cyano group, an alkyl group (for example, a methyl group, an ethyl group, an i-propyl group, a butyl group, a hexyl group, an octyl group, a decyl group, a dodecyl group, a tetradecyl group, a hexadecyl group, a heptadecyl group, an octadecyl group, a methoxyethoxy ethyl group, etc.), an aryl group (for example, a phenyl group, a tolyl group, a naphthyl group, a chlorophenyl group, a methoxyphenyl group, an acetylphenyl group, etc.), an alkoxy group (for example, a methoxy group, an ethoxy group, a butoxy group, a propoxy group, a methoxyethoxy group, etc.), an aryloxy group (for example, a phenoxy group, a tolyloxy group, a naphthoxy group, a methoxyphenoxy group, etc.), an alkoxycarbonyl group (for example, a methoxycarbonyl group, a butoxycarbonyl group, a phenoxymethoxycarbonyl group, etc.), an aryloxycarbonyl group (for example, a phenoxycarbonyl group, a tolyloxycarbonyl group, a methoxyphenoxycarbonyl group, etc.), an acyl group (for example, a formyl group, an acetyl group, a valeryl group, a stearoyl group, a benzoyl group, toluoyl group, a naphthoyl group, a p-methoxybenzoyl group, etc.), an acyloxy group (for example, an acetoxy group, an acyloxy group, etc.), an acylamino group (for example, an acetamide group, a benzamide group, a methoxyacetamide group, etc.), an anilino group (for example, a phenylamino group, an N-methylanilino group, an N-phenylanilino group, an N-acetylanilino group, etc.), an alkylamino group (for example, an n-butylamino group, an N,N-diethylamino group, a 4-methoxy-n-butylamino group, etc.), a carbamoyl group (for example, an n-butylcarbamoyl group, an N,N-diethylcarbamoyl group, an n-butylsulfamoyl group, an N,N-diethylsulfamoyl group, an n-dodecylsulfamoyl group, an N-(4-methoxy-n-butyl)sulfamoyl group, etc.), a sulfonylamino group (for example, a methylsulfonylamino group, a phenylsulfonylamino group, a methoxymethylsulfonylamino group, etc.) or a sulfonyl group (for example, a methyl group, a tosyl group, a methoxymethanesulfonyl group, etc.).

The alkyl group represented by $R^{25}$ and A may have a substituent, or may be any of straight-chain or branched alkyl groups. These alkyl groups may be, except the carbon atom at the substituent moiety, preferably alkyl groups having 1 to 20 carbon atoms, including, for example, a methyl group, an ethyl group, a propyl group, a butyl group, a hexyl group, an octyl group, a decyl group, a dodecyl group, a tetradecyl group, a hexadecyl group, a heptadecyl group, an octadecyl group, etc.

The aryl group represented by $R^{25}$ and A may have a substituent, and may be, except the carbon atom at the substituent moiety, preferably an aryl group having 6 to 14 carbon atoms, including, for example, a phenyl group, a tolyl group, a naphthyl group, etc., to which two ligands may be also linked through A.

In the above formula, M represents a metal atom, which includes preferably a transition metal atom, more preferably, Cu, Co, Ni, Pd, Fe or Pt, and particularly preferably, Ni. Preferable group for A includes a hydroxyl group.

Of the above complexes represented by Formula (N), preferably used are those in which $R^{21}$ is an oxy group, a thio group; an alkyl group, a cycloalkyl group, an aryl group or a heterocyclic group attached through a carbonyl group; a hydroxyl group or fluorine, and at least one of the groups represented by $R^{22}$, $R^{23}$ or $R^{24}$ is a hydrogen atom, a hydroxyl group, an alkyl group or an alkoxy group. Of these, more preferably used are complexes in which $R^{25}$ is a hydrogen atom and the sum of carbon number of the group represented by $R^{21}$, $R^{22}$, $R^{23}$ or $R^{24}$ is at least 4 or more.

Exemplary compounds of the above are shown below:

N-1

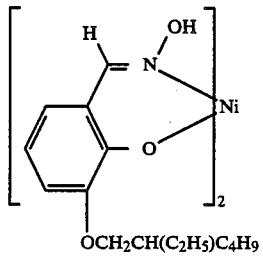

N-2

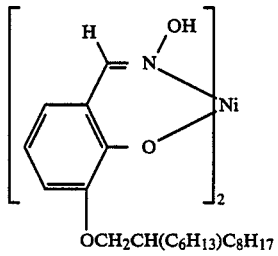

N-3

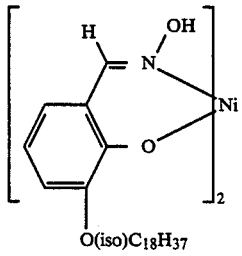

N-4

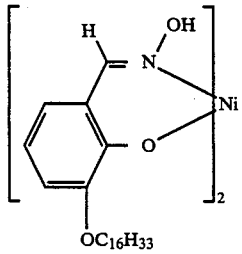

-continued
N-5
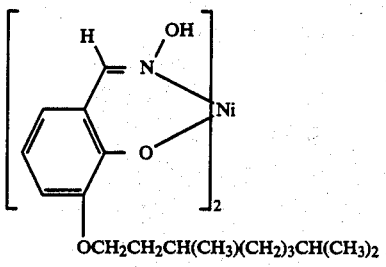
N-6
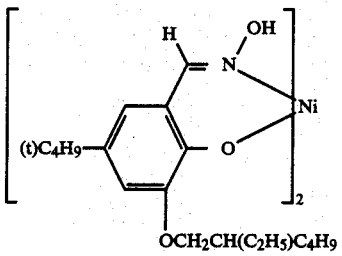
N-7
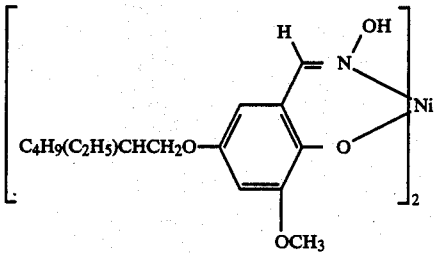
N-8
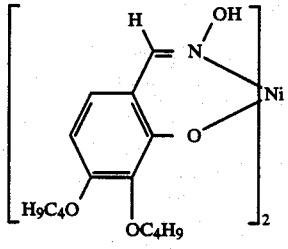
N-9
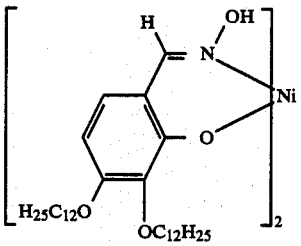
N-10
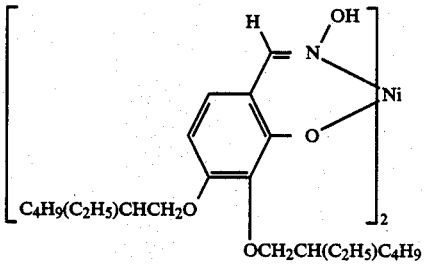
-continued
N-11
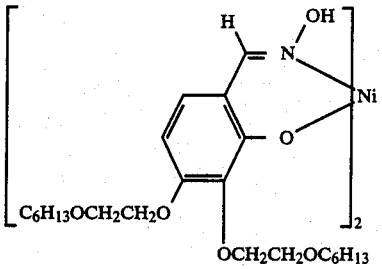
N-12
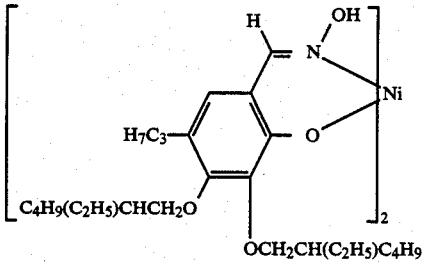
N-13
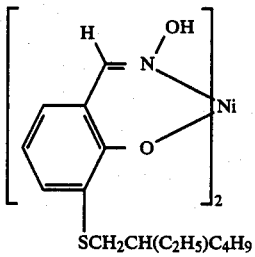
N-14
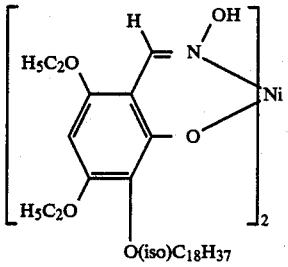
N-15
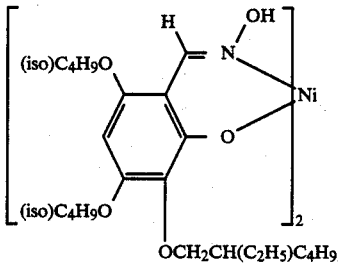
N-16
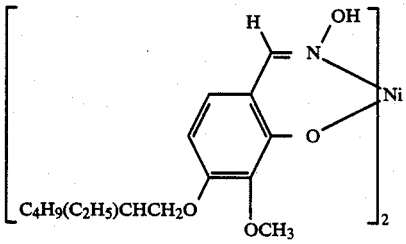

-continued
N-17
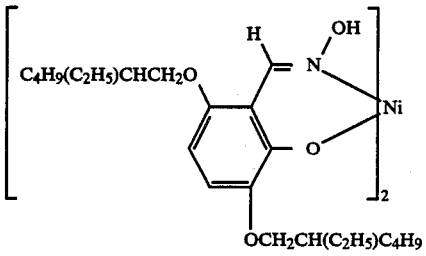
N-18
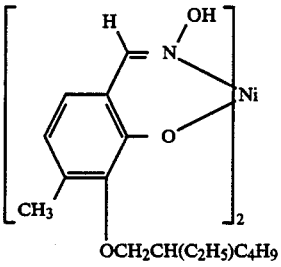
N-19
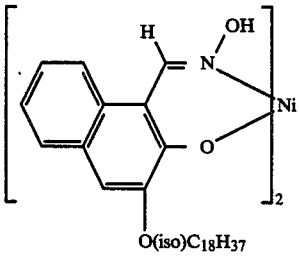
N-20
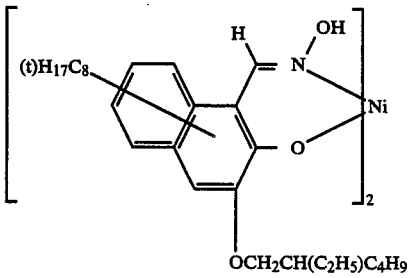
N-21
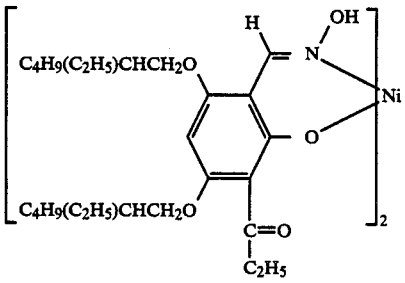
-continued
N-22
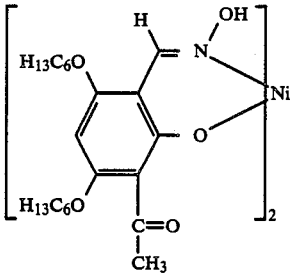
N-23
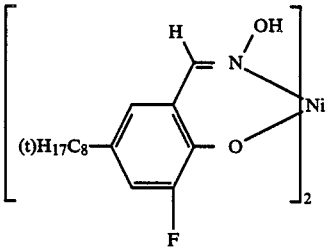
N-24
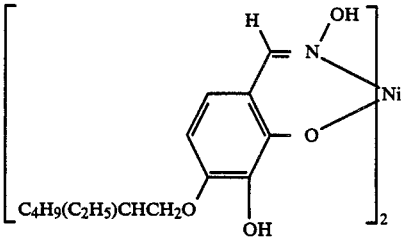
N-25
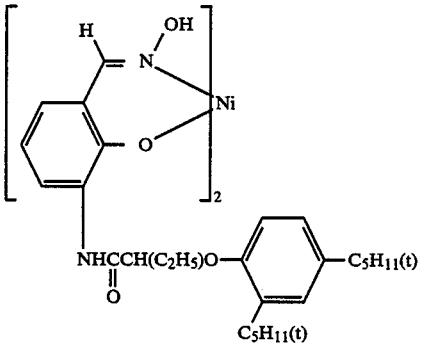
N-26
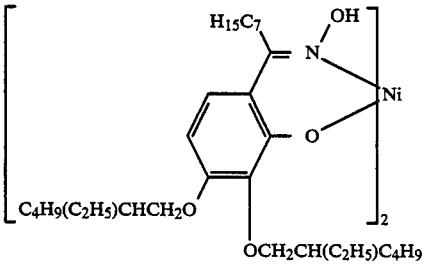

-continued
N-27
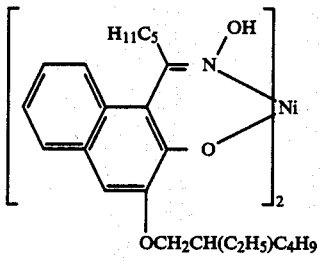
N-28
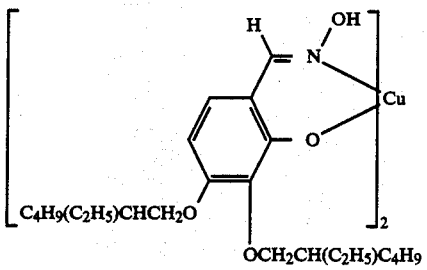
N-29
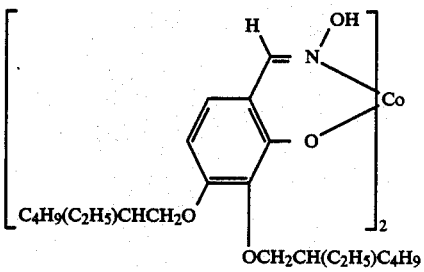
N-30
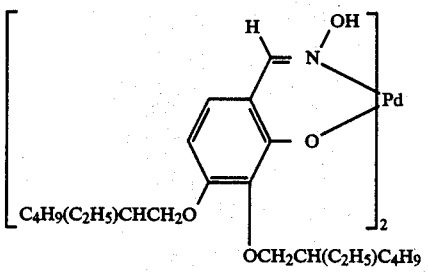
N-31
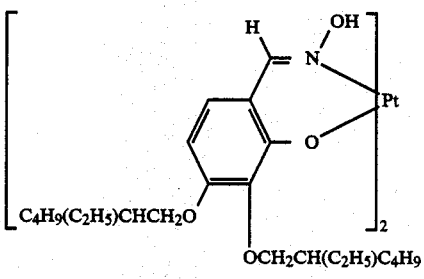
-continued
N-32
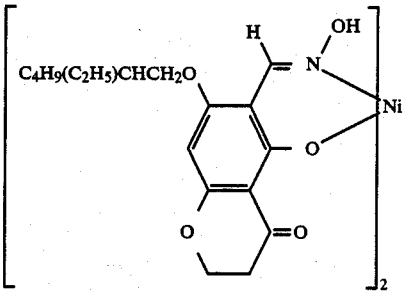
N-33
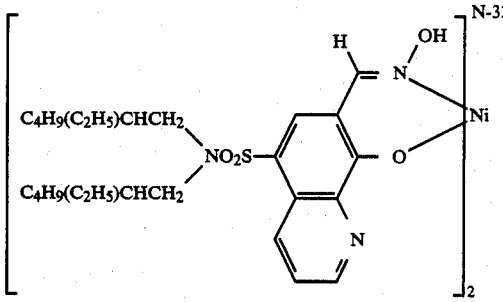
N-34
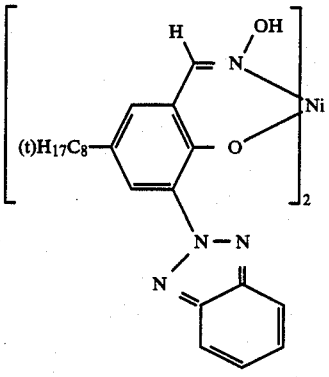
N-35
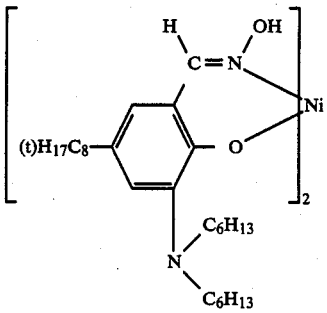
N-36
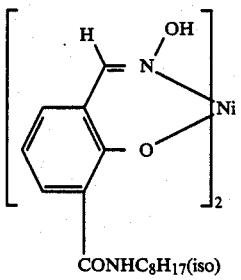

-continued
N-37
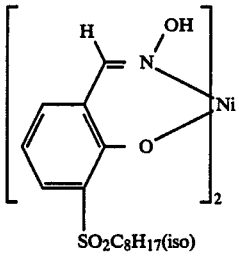
N-38
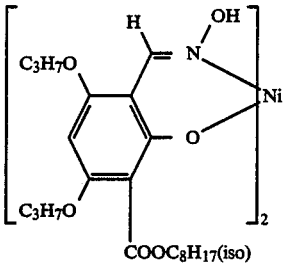
N-39
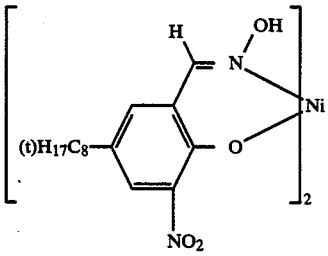
N-40
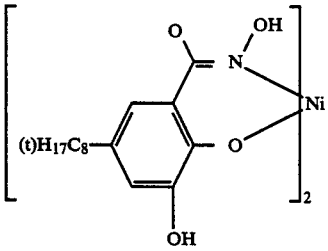
N-41
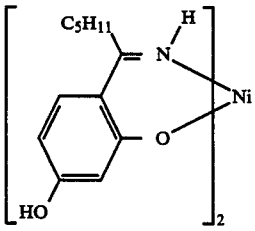
N-42
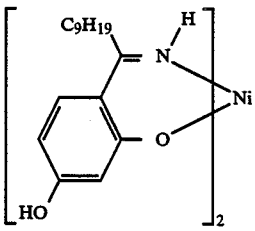
-continued
N-43
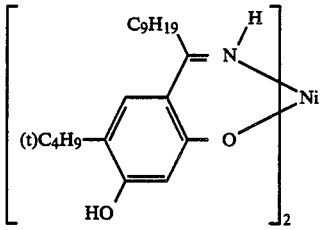
N-44
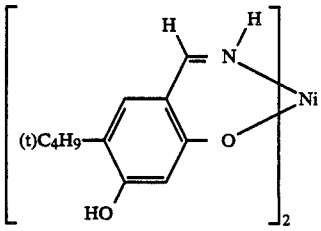
N-45
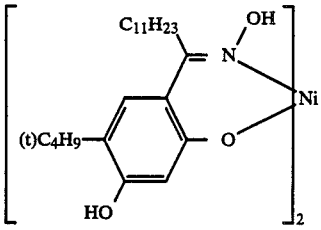
N-46
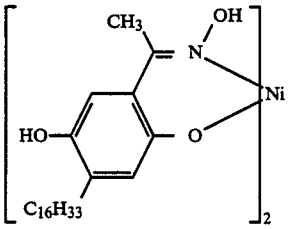
N-47
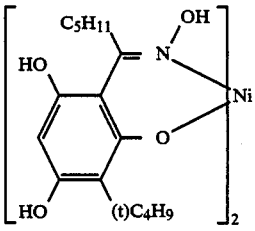
N-48
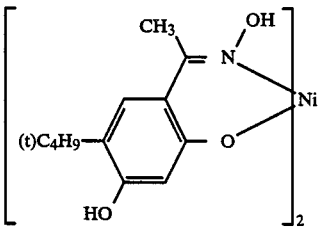

-continued
N-49
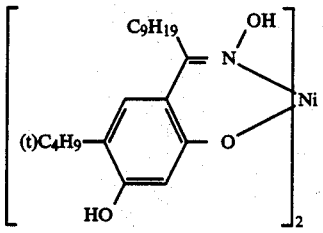
N-50
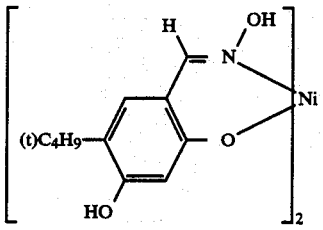
N-51
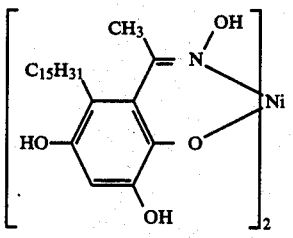
N-52
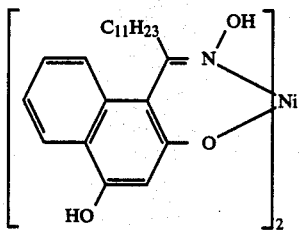
N-53
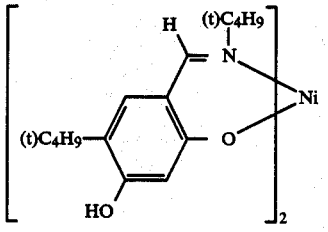
N-54
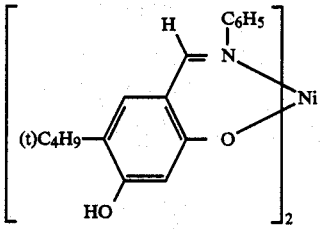
-continued
N-55
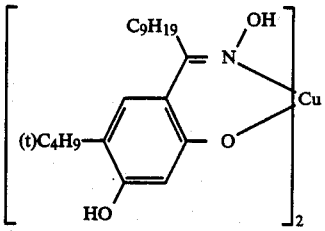
N-56
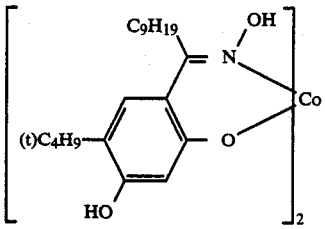
N-57
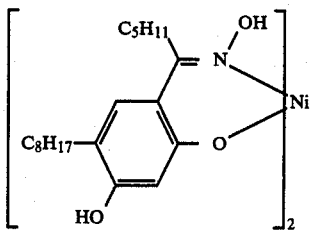
N-58
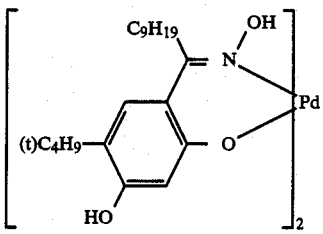
N-59
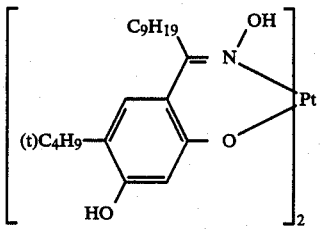
N-60
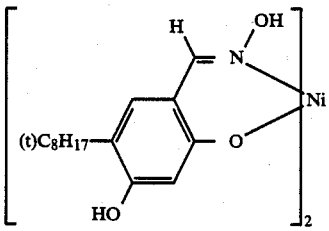

-continued
N-61
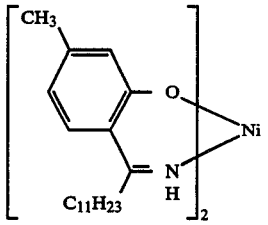
N-62
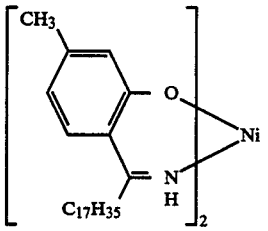
N-63
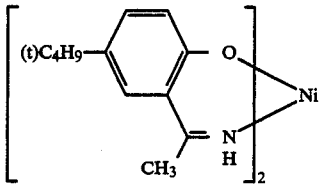
N-64
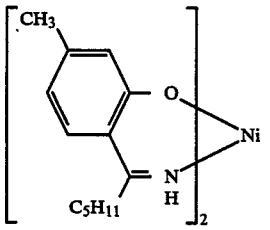
N-65
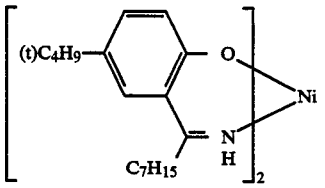
N-66
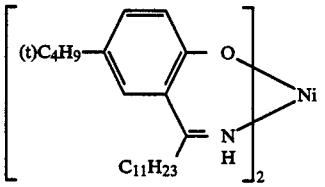
N-67
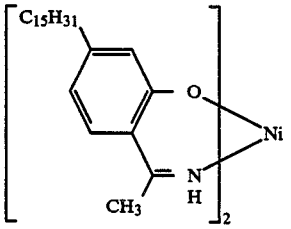
-continued
N-68
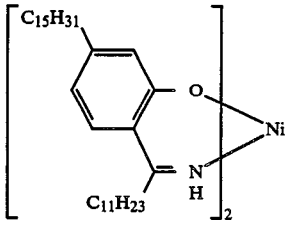
N-69
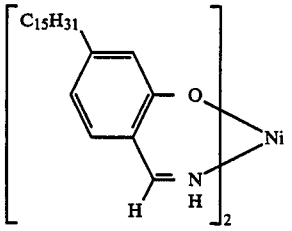
N-70
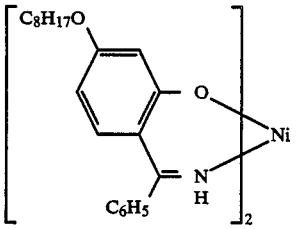
N-71
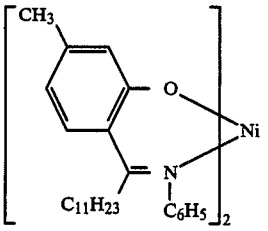
N-72
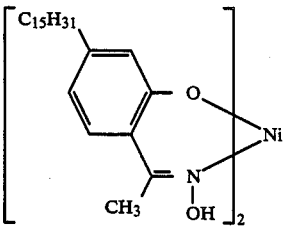
N-73
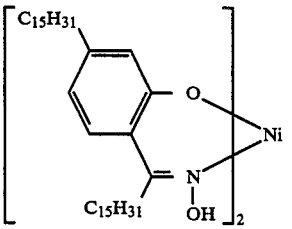

-continued
N-74
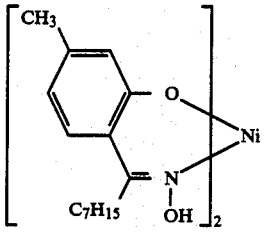
N-75
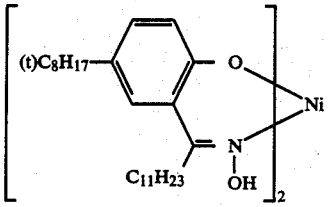
N-76
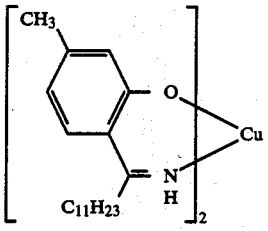
N-77
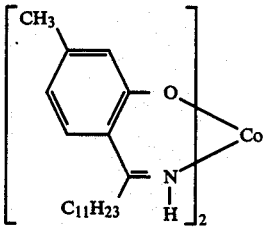
N-78
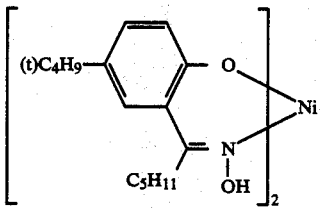
N-79
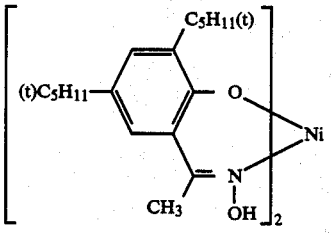
N-80
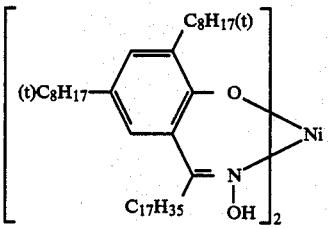
-continued
N-81
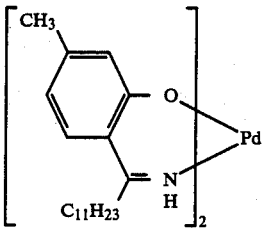
N-82
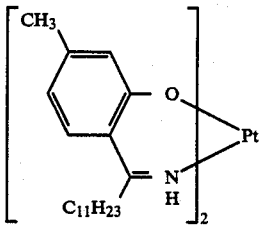
N-83
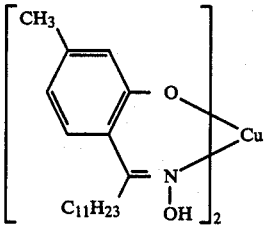
N-84
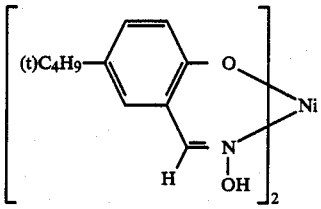
N-85
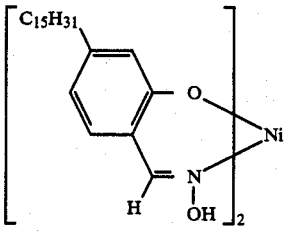
N-86
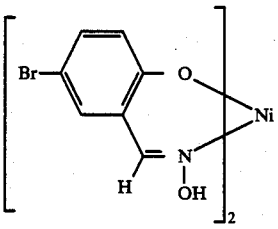

-continued
N-87
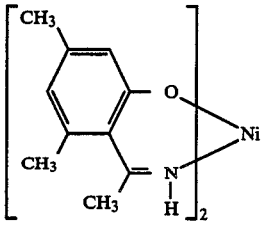
N-88
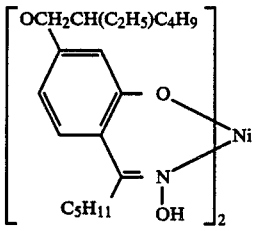
N-89
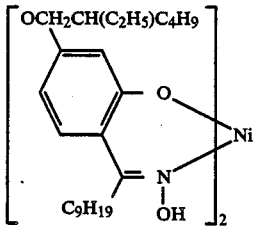
N-90
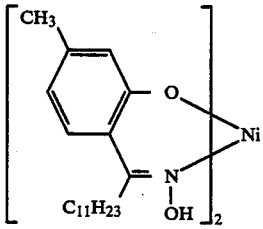
N-91
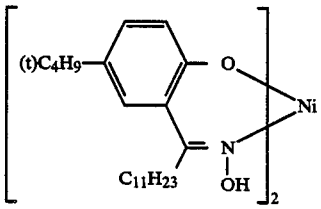
N-92
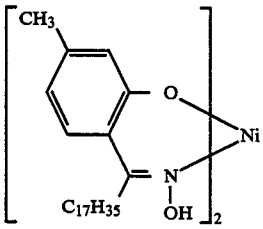
-continued
N-93
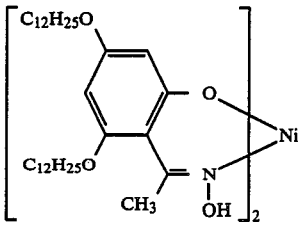
N-94
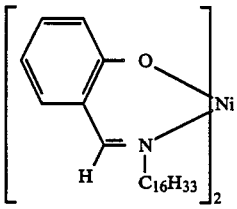
N-95
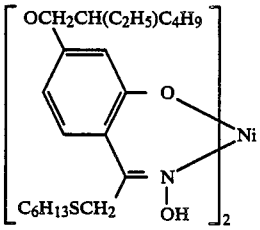
N-96
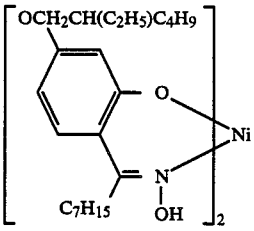
N-97
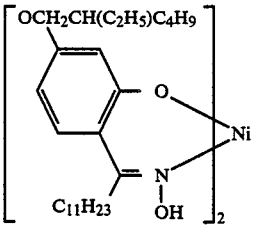
N-98
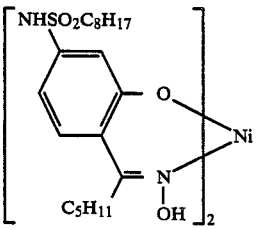

-continued

N-99

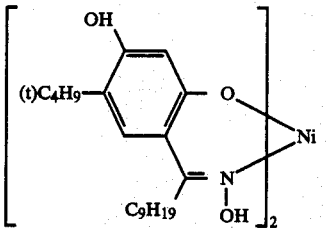

N-100

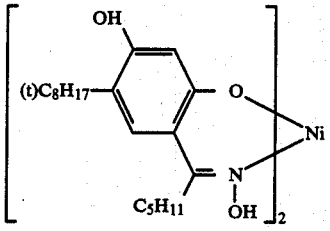

N-101

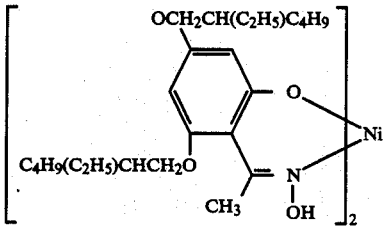

N-102

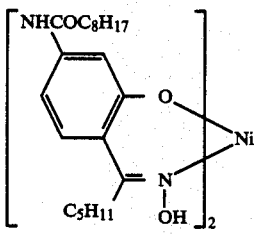

N-103

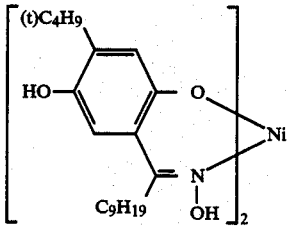

N-104

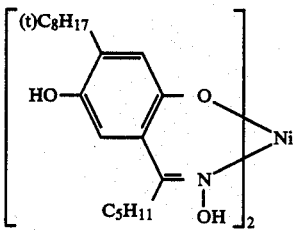

-continued

N-105

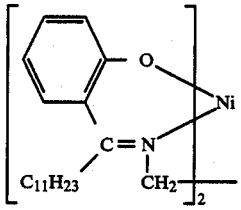

N-106

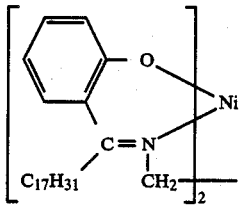

N-107

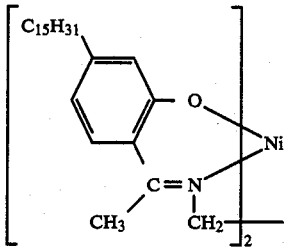

The above metal complex can be synthesized by the method disclosed in E. G. Cox, F. W. Pinkard, W. Wardlaw and K. C. Webster, J. Chem. Soc., 1935, 459.

The compound according to this invention, represented by Formula (L), (M) or (N) may be preferably contained in a proportion of from 0.01 to 3 moles, more preferably from 0.1 to 2 moles per mole of the coupler.

In this invention, the alkyl group represented by $R^1$ and $R^2$ in Formula (a) preferably includes an alkyl group having 1 to 12 carbon atoms, more preferably an alkyl group having 3 to 8 carbon atoms and branched at the α-position. $R^1$ and $R^2$ are each particularly preferably a t-butyl group or a t-pentyl group.

The alkyl group represented by $R^3$ may be straight-chain or branched one, including, for example, a methyl group, an ethyl group, a propyl group, a butyl group, a pentyl group, an octyl group, a nonyl group, a dodecyl group, an octadecyl group, etc. When this alkyl group have a substituent, the substituent may include a halogen atom, a hydroxyl group, a nitro group, a cyano group, an aryl group (for example, a phenyl group, a hydroxyphenyl group, a 3,5-di-t-butyl-4-hydroxyphenyl group, a 3,5-di-t-pentyl-4-hydroxyphenyl group, etc.), an amino group (for example, a dimethylamino group, a diethylamino group, a 1,3,5-triazinylamino group, etc.), an alkyloxycarbonyl group (for example, a methoxycarbonyl group, an ethoxycarbonyl group, a propyloxycarbonyl group, a butoxycarbonyl group, a pentyloxycarbonyl group, an octyloxycarbonyl group, a nonyloxycarbonyl group, a dodecyloxycarbonyl group, an octadecyloxycarbonyl group, etc.), an aryloxycarbonyl group (for example, a phenoxycarbonyl group, etc.), a carbamoyl group (for example, an alkylcarbamoyl group including a methylcarbamoyl group, an ethylcarbamoyl group, a propylcarbamoyl group, a butylcarbamoyl group, a heptylcarbamoyl group, etc., an arylcarbamoyl group including a phenylcarbamoyl group, a cycloalkylcarbamoyl group including a cyclohexylcarbamoyl group, etc.) and a heterocyclic group including an isocyanuryl group, a 1,3,5-triazinyl group, etc. The amino group represented by R may include, for example, alkylamino groups such as a dimethylamino group, a diethylamino group and a methylethylamino group; arylamino groups such as a phenylamino group and a hydroxyl phenylamino group; cycloalkylamino groups such as a cyclohexyl group; heterocyclic amino groups such as a 1,3,5-triazinylamino group and an isocyanuryl group; etc. The monovalent organic group represented by R' and R'' may include, for example, an alkyl group (for example, a methyl group, an ethyl group, a propyl group, a butyl group, an amyl group, a decyl group, a dodecyl group, a hexadecyl group, an octadecyl group, etc.), an aryl group (for example, a phenyl group, a naphthyl group, etc.), a cycloalkyl group (for example, a cyclohexyl group, etc.) and a heterocyclic group (for example, a 1,3,5-triazinyl group, an isocyanuryl group, etc.). When these organic groups have a substituent, such a substituent may include, for example, a halogen atom (for example, fluorine, chlorine, bromine, etc.), a hydroxyl group, a nitro group, a cyano group, an amino group, an alkyl group (for example, a methyl group, an ethyl group, an i-propyl group, a t-butyl group, a t-amyl group, etc.), an aryl group (for example, a phenyl group, a tolyl group, etc.), an alkenyl group (for example, an allyl group), an alkylcarbonyloxy group (for example, a methylcarbonyloxy group, an ethylcarbonyloxy group, a benzylcarbonyloxy group, etc.), an arylcarbonyloxy group (for example, a benzoyloxy group, etc.), etc.

In this invention, the compound represented by Formula (a) includes preferably the compound represented by Formula (a') shown below:

Formula (a'):

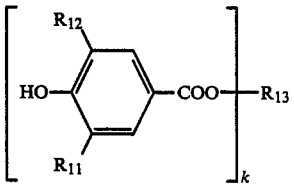

In the formula, $R^{11}$ and $R^{12}$ each represent a straight chain or branched alkyl group having 3 to 8 carbon atoms, and particularly represent a t-butyl group or a t-pentyl group. $R^{13}$ represents an organic group of valence k. The k represents an integer of 1 to 6.

The organic group of valence k represented by $R^{13}$ may include, for example, alkyl groups such as a methyl group, an ethyl group, a propyl group, a butyl group, a pentyl group, an octyl group, a hexadecyl group, a methoxyethyl group, a chloromethyl group, a 1,2-dibromoethyl group, a 2-chloroethyl group, a benzyl group and a phenethyl group; alkenyl groups such as an allyl group, a propenyl group and a butenyl group; polyvalent unsaturated hydrocarbon groups such as ethylene, trimethylene, propylene, hexamethylene and 2-chlorotrimethylene; unsaturated hydrocarbon groups such as glyceryl, diglyceryl, pentaerythrityl and dipentaerythrityl; alicyclic hydrocarbon groups such as cyclopropyl, cyclohexyl and cyclohexenyl; aryl groups such as a phenyl group, a p-octylphenyl group, a 2,4-dimethylphenyl group, a 2,4-di-t-butylphenyl group, a 2,4-di-t-pentylphenyl group, a p-chlorophenyl group, a 2,4-dibromophenyl group and a naphthyl group; arylene groups such as a 1,2-, 1,3- or 1,4-phenylene group, a 3,5-dimethyl-1,4-phenylene group, a 2-t-butyl-1,4-phenylene group, a 2-chloro-1,4-phenylene group and a naphthalene group; 1,3,5-trisubstituted benzene groups; etc.

Besides the groups mentioned above, $R^{13}$ includes an organic group having valence k and being bonded with any optional group of the above groups through a group of —O—, —S— or —$SO_2$—.

More preferably, $R^{13}$ includes a 2,4-di-t-butylphenyl group, a 2,4-di-t-pentylphenyl group, a p-octylphenyl group, a p-dodecylphenyl group, a 3,5-di-t-butyl-4-hydroxyphenyl group and a 3,5-di-t-pentyl-4-hydroxyphenyl group.

The k is preferably an integer of 1 to 4.

Specific compounds of the compound represented by Formula (a) are shown below, to which, however, this invention is not limited.

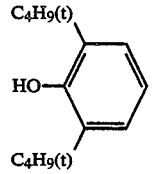

(1)

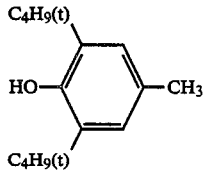

(2)

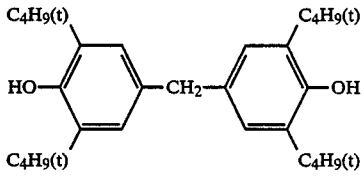

(3)

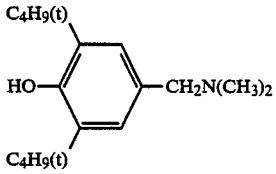

(4)

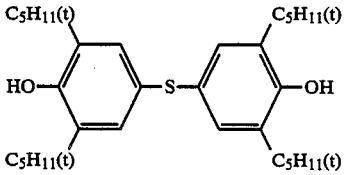

(5)

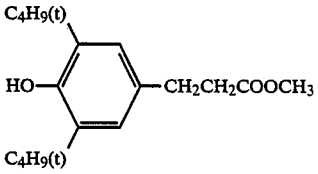

(6)

-continued
(7)
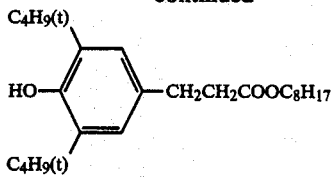
(8)
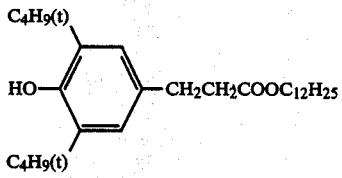
(9)
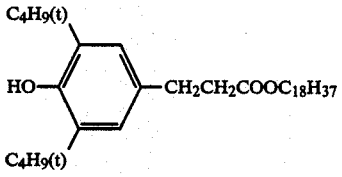
(10)
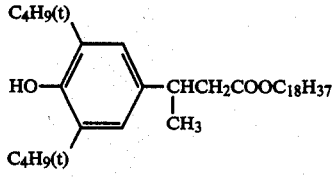
(11)
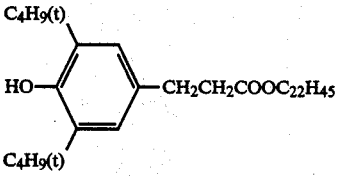
(12)
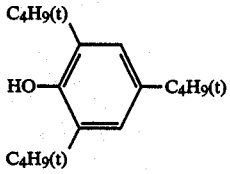
(13)
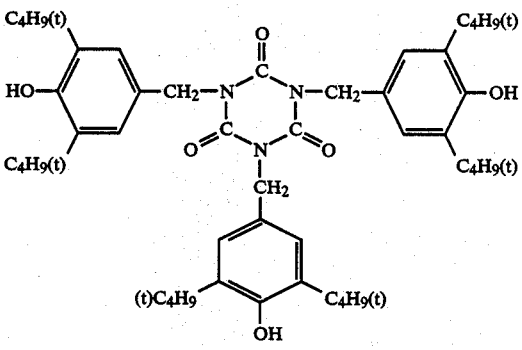
(14)
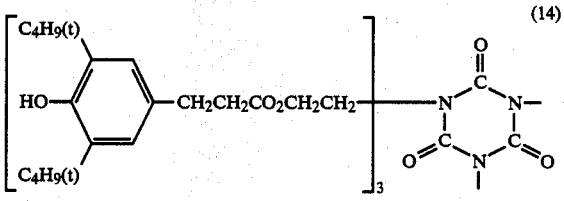
-continued
(15)
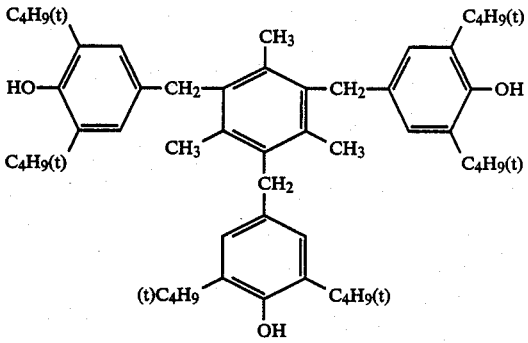
(16)
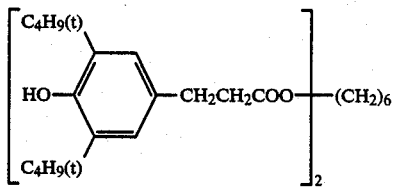
(17)
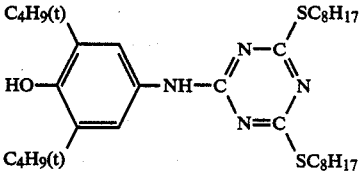
(18)
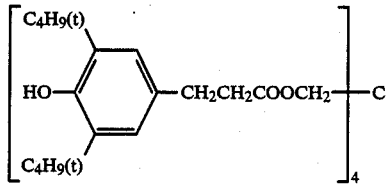
(19)
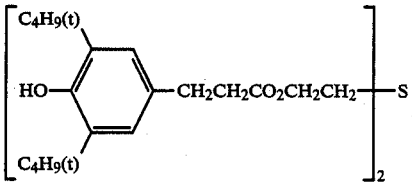
(20)
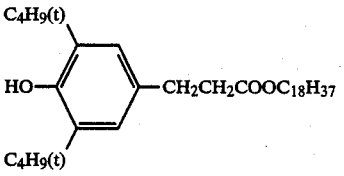
(21)
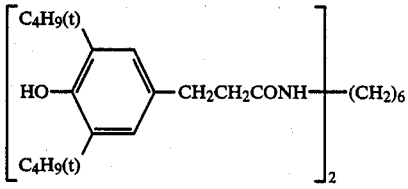

-continued
(22)
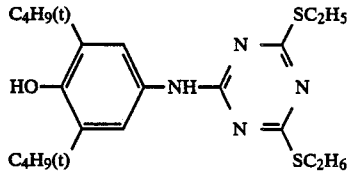
(23)
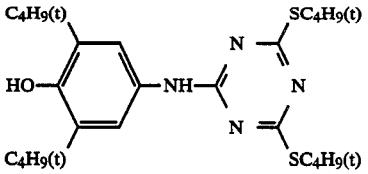
(24)
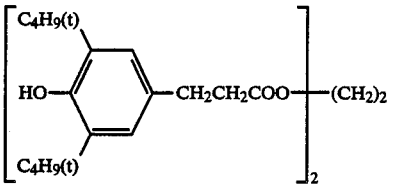
(25)
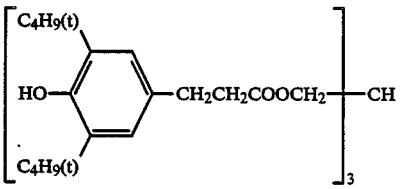
(26)
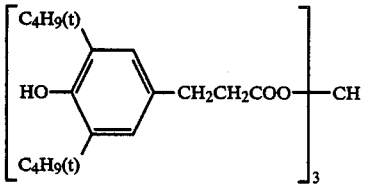
(27)
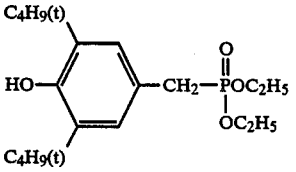
(28)
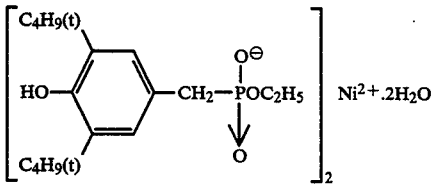
(29)
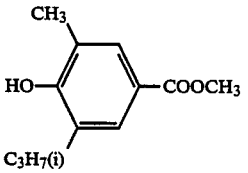
-continued
(30)
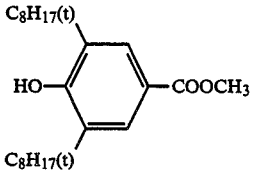
(31)
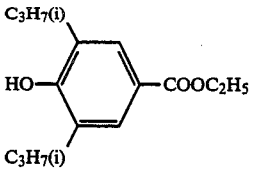
(32)
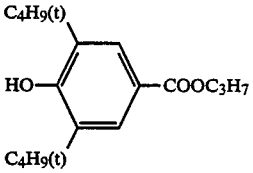
(33)
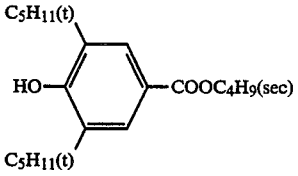
(34)
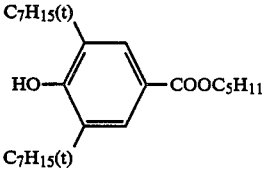
(35)
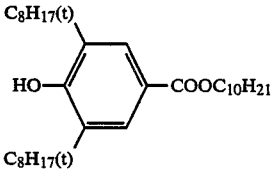
(36)
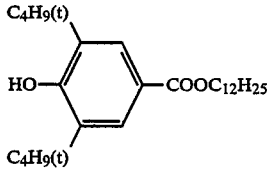
(37)
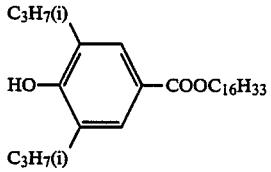
(38)
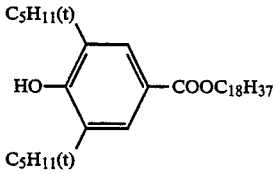

-continued
(39)
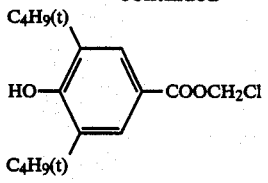
(40)
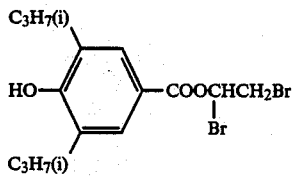
(41)
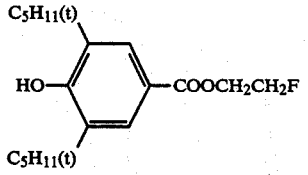
(42)
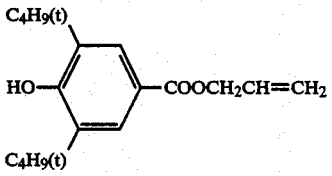
(43)
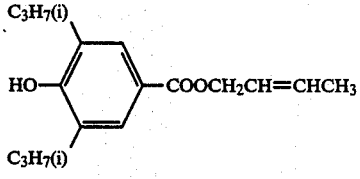
(44)
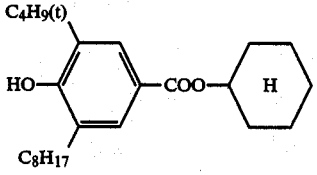
(45)
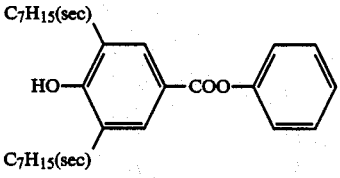
(46)
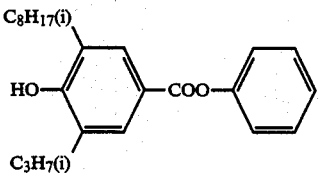
(47)
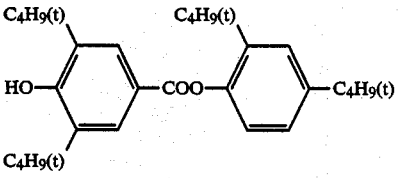
-continued
(48)
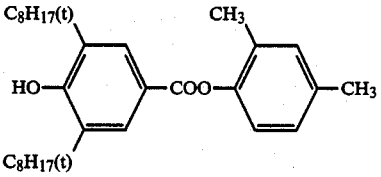
(49)
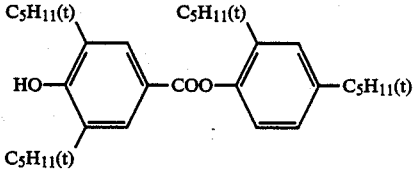
(50)
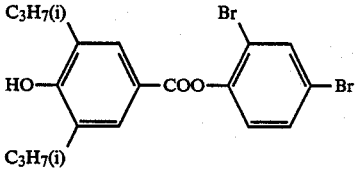
(51)
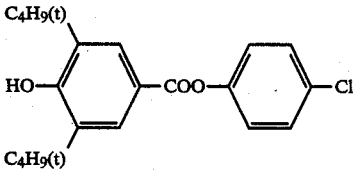
(52)
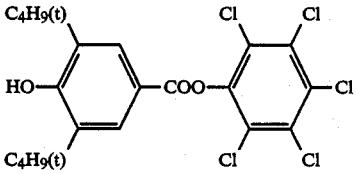
(53)
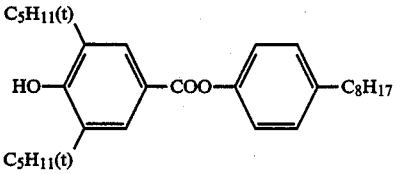
(54)
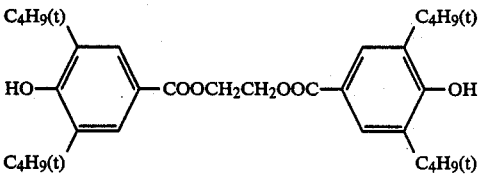
(55)
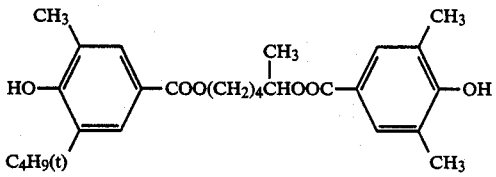
(56)
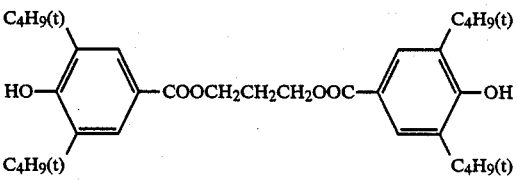

-continued
(57)
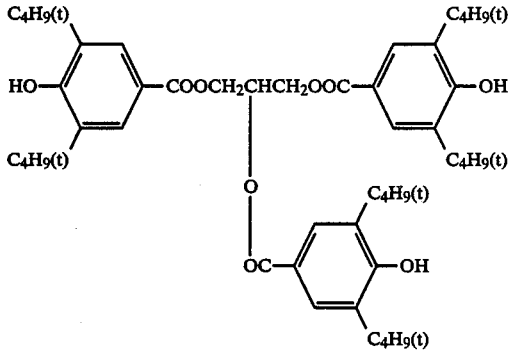
(58)
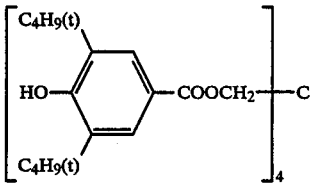
(59)
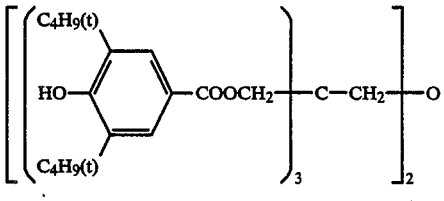
(60)
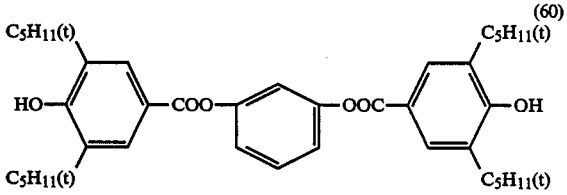
(61)
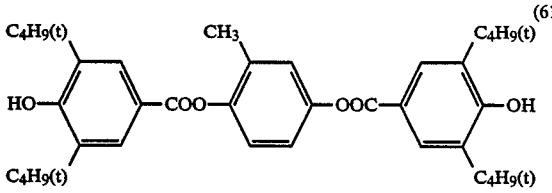
(62)
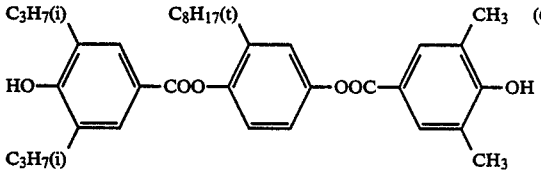
(63)
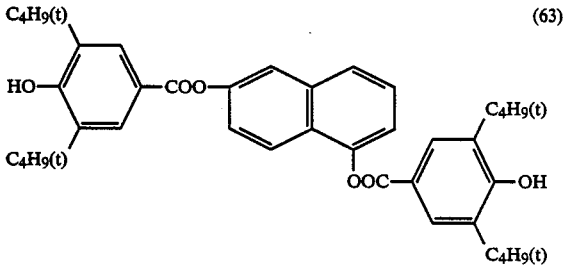
-continued
(64)
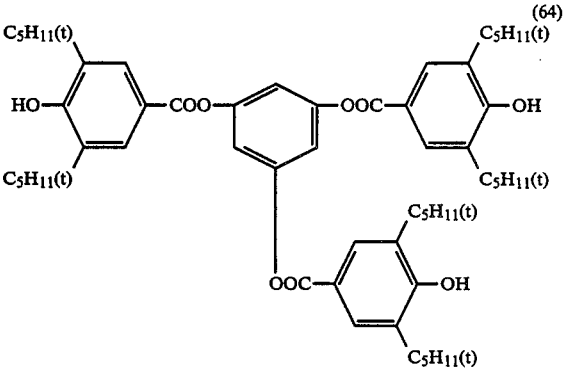
(65)
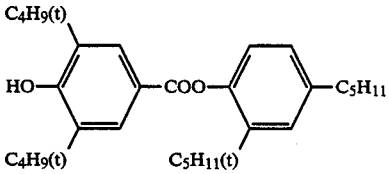
(66)
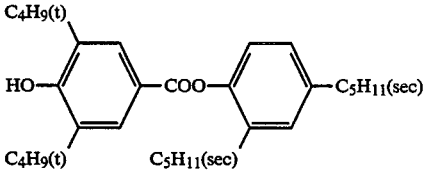
(67)
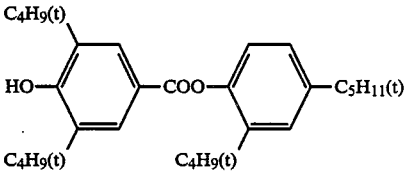
(68)
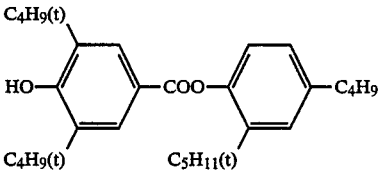
(69)
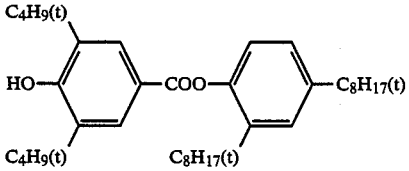
(70)
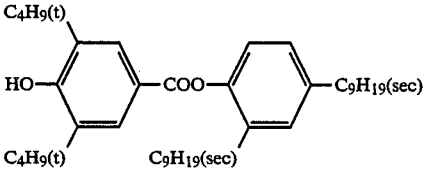
(71)
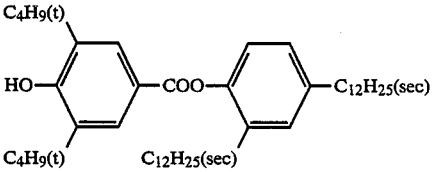

-continued
(72)
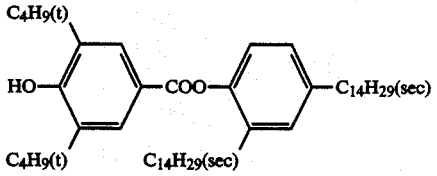
(73)
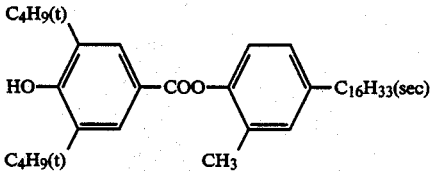
(74)
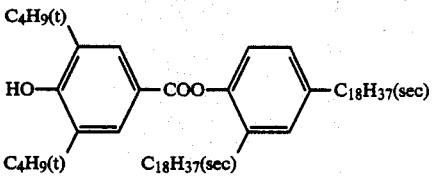
(75)
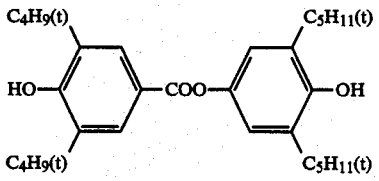
(76)
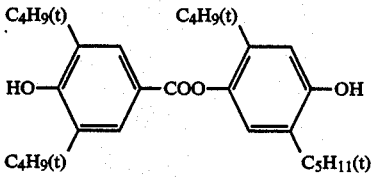
(77)
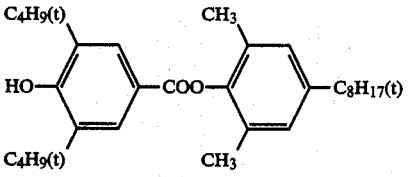
(78)
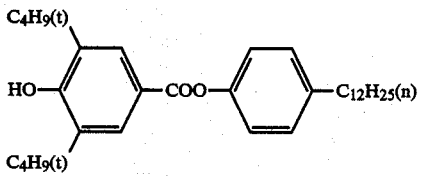
(79)
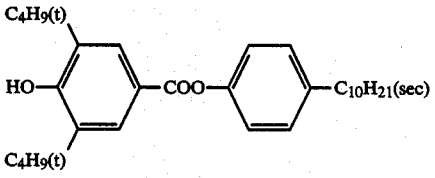
(80)
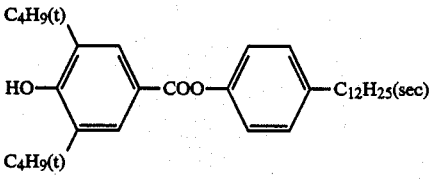
-continued
(81)
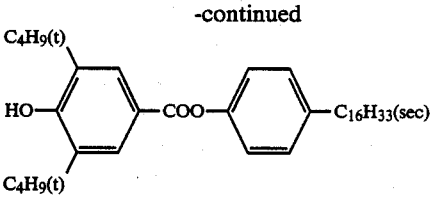
(82)
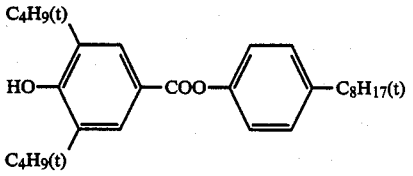
(83)
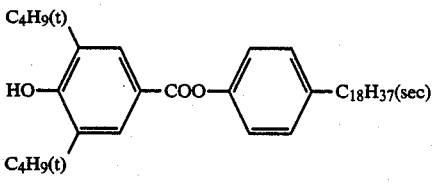
(84)
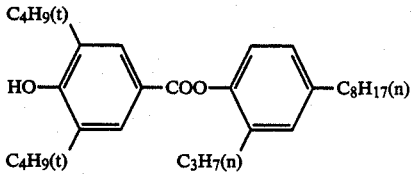
(85)
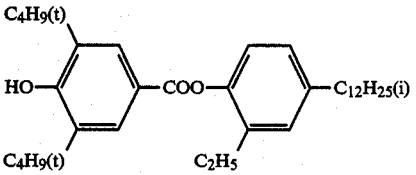
(86)
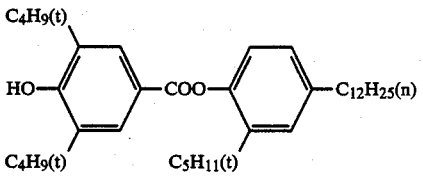
(87)
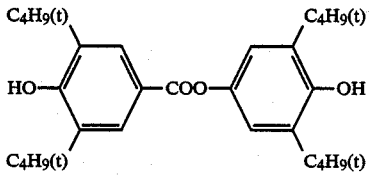
(88)
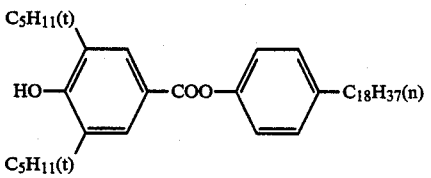
(89)
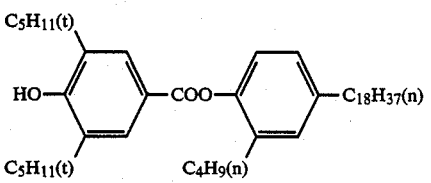

-continued

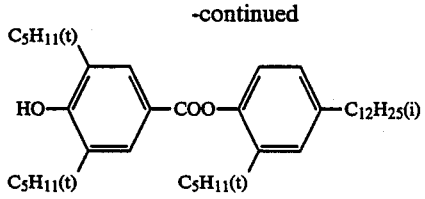

(90)

In this invention, the alkyl group represented by $R^4$ in Formula (b) may have 1 to 12 carbon atoms, the alkenyl group or the alkynyl group may have 2 to 4 carbon atoms, and the monovalent organic group represented by R' and R" may include, for example, an alkyl group, an alkenyl group, an alkynyl group, an aryl group, etc. Preferable groups represented by $R^4$ may include a hydrogen atom, an alkyl group (for example, a methyl group, an ethyl group, a propyl group, a butyl group, a chloromethyl group, a hydroxymethyl group, a benzyl group, etc.), an alkenyl group (for example, a vinyl group, an allyl group, an isopropenyl group, etc.), an alkynyl group (for example, an ethynyl group, a propynyl group, etc.) or a —COR"— group, wherein R" represents, for example, an alkyl group (for example, a methyl group, an ethyl group, a propyl group, a butyl group, a benzyl group, etc.), an alkenyl group (for example, a vinyl group, an allyl group, an isopropenyl group, etc.), an alkynyl group (for example, an ethynyl group, a propynyl group, etc.) or an aryl group (for example, a phenyl group, a tolyl group, etc.).

The alkyl group represented by $R^5$, $R^6$, $R^{5'}$, $R^{6'}$ and $R^9$ includes preferably a straight-chain or branched alkyl group having 1 to 5 carbon atoms, and particularly preferably a methyl group.

The monovalent organic group represented by $R^{10}$ in $R^7$ and $R^8$ may include, for example, an alkyl group (for example, a methyl group, an ethyl group, a propyl group, a butyl group, a pentyl group, an octyl group, a dodecyl group, an octadecyl group, etc.), an alkenyl group (for example, a vinyl group, etc.), an alkynyl group (for example, an ethynyl group, etc.), an aryl group (for example, a phenyl group, a naphthyl group, etc.), an alkylamino group (for example, an ethylamino group, etc.), an arylamino group (for example, an anilino group), etc.

The heterocyclic group formed by association of $R^7$ and $R^8$ may include the following:

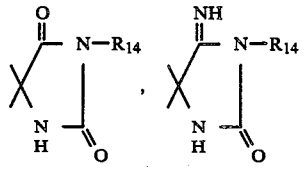

wherein $R^{14}$ represents a hydrogen atom, an alkyl group, a cycloalkyl group or a phenyl group.

In this invention, the compound represented by Formula (b) includes preferably the compound represented by Formula (b') shown below:

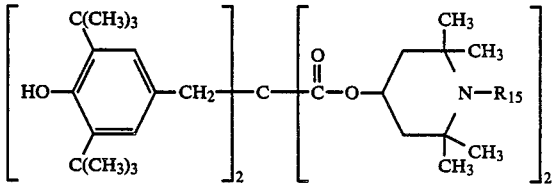

In the formula, $R^{15}$ represents an alkyl group (for example, a methyl group, an ethyl group, a propyl group, a butyl group, a pentyl group, a benzyl group, etc.), an alkenyl group (for example, a vinyl group, an allyl group, an isopropenyl group, etc.), an alkynyl group (for example, an ethynyl group, a propenyl group, etc.), an acyl group (for example, a formyl group, an acetyl group, a propionyl group, a butynyl group, an acryloyl group, a propioloyl group, a methacryloyl group and a crotonoyl group, etc.).

More preferably, the groups represented by $R^{15}$ include a methyl group, an ethyl group, a vinyl group, an allyl group, a propynyl group, a benzyl group, an acetyl group, a propionyl group, an acryloyl group, a methacryloyl group and a crotonoyl group.

Specific compounds of the compound represented by Formula (b) are shown below, to which, however, this invention is not limited.

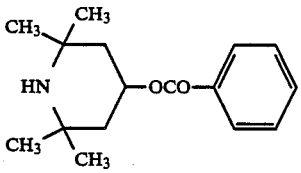

(91)

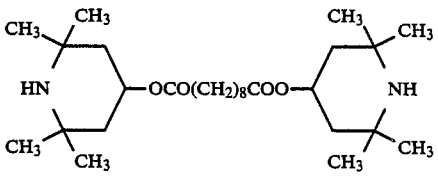

(92)

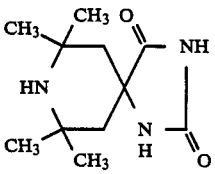

(93)

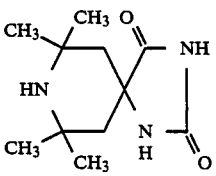

(94)

-continued
(95)
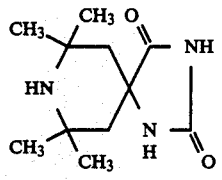
(96)
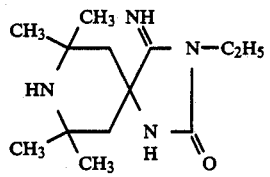
(97)
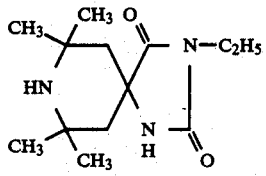
(98)
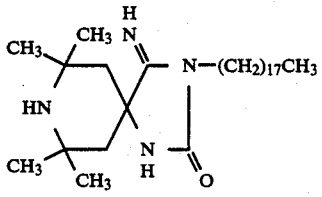
(99)
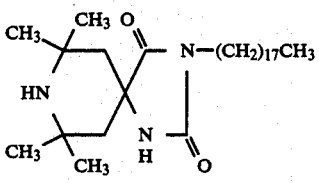
(100)
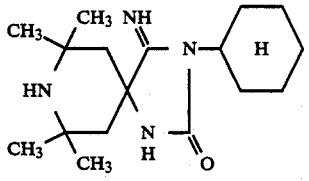
(101)
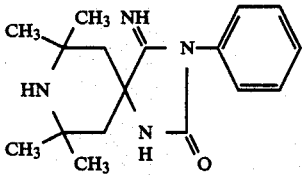
(102)
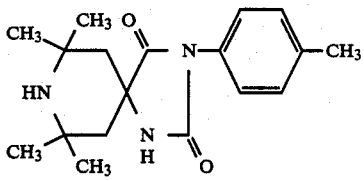
(103)
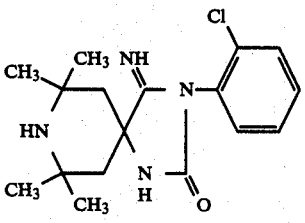
(104)
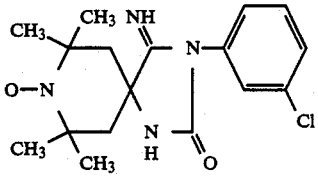
(105)
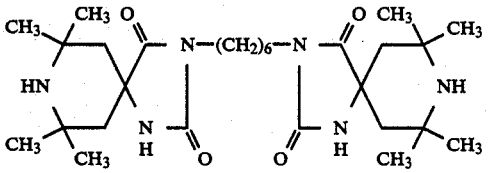
(106)
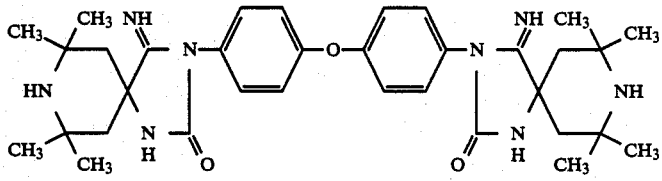
(107)
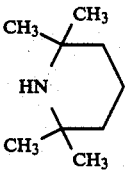
(108)
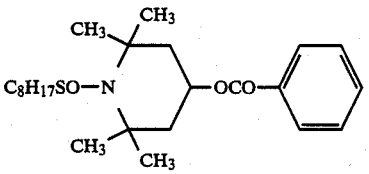

-continued
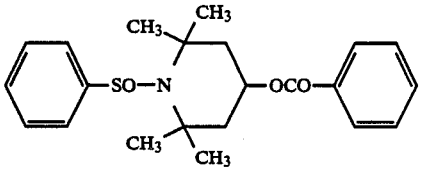
(109)
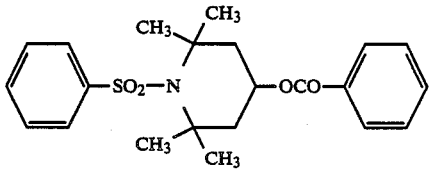
(110)
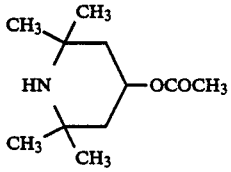
(111)
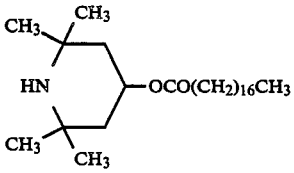
(112)
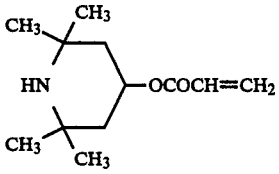
(113)
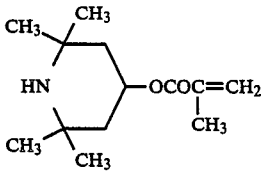
(114)
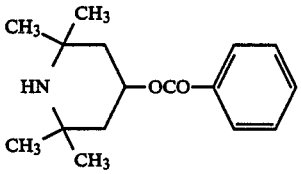
(115)
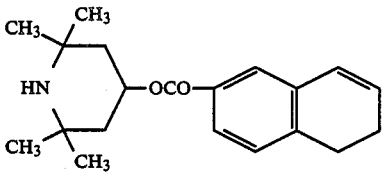
(116)
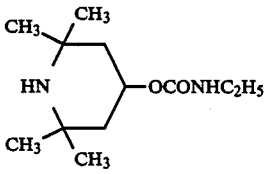
(117)
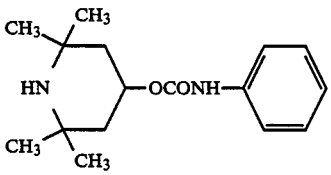
(118)
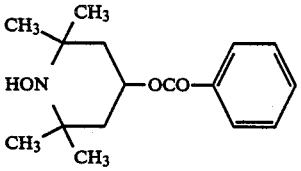
(119)
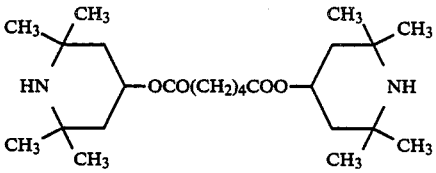
(120)
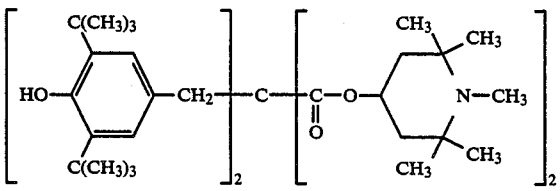
(121)
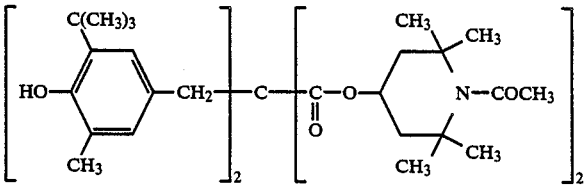
(122)

-continued
(123)
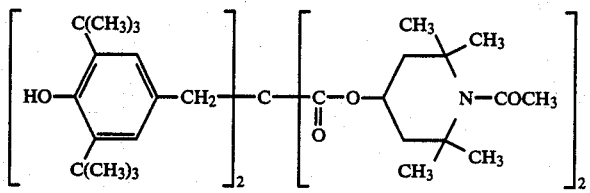
(124)
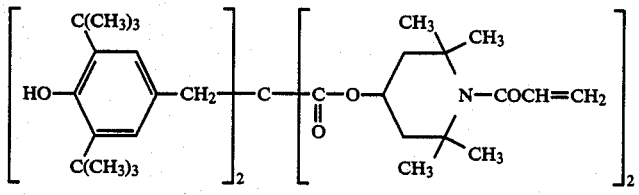
(125)
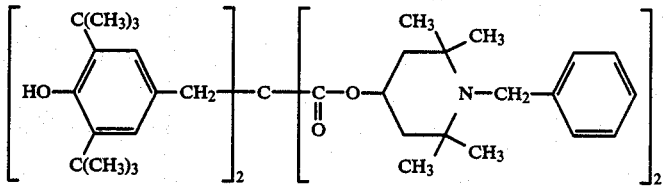
(126)
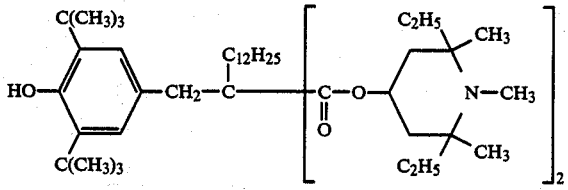
(127)
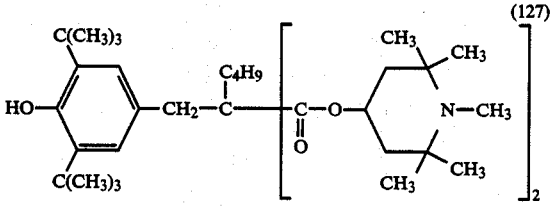
(128)
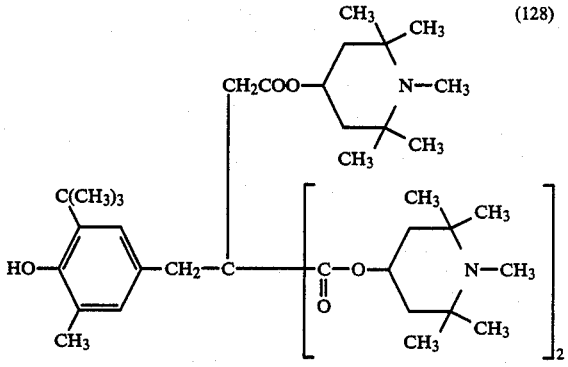
(129)
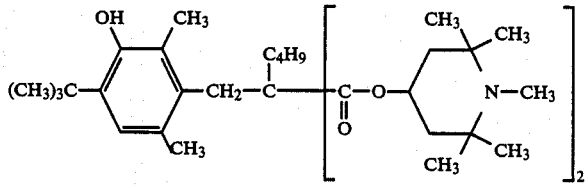

-continued
(130)
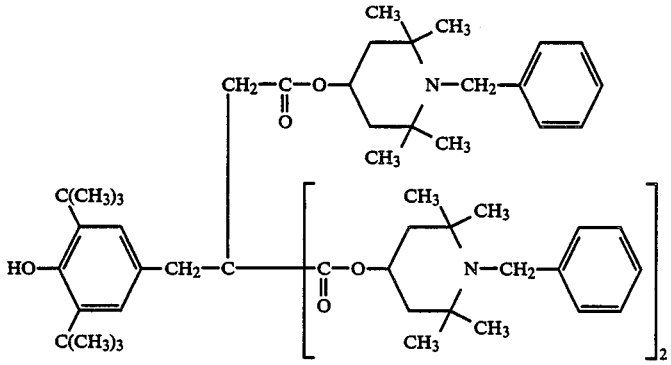
(131)
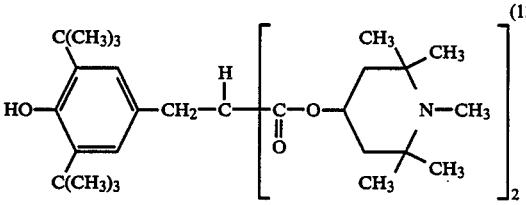
(132)
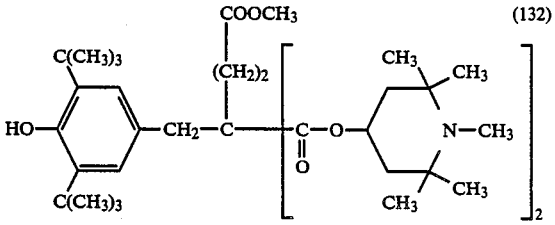
(133)
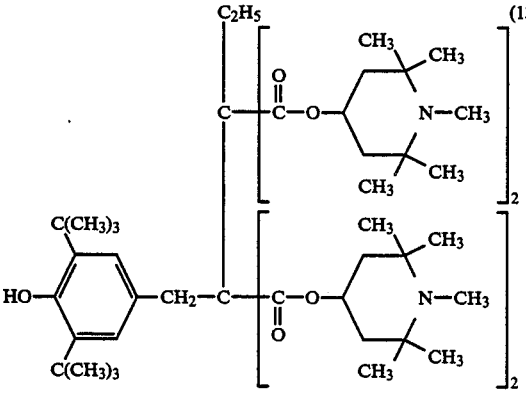
(134)
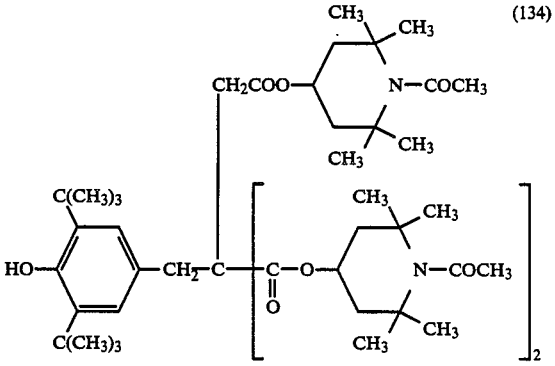
(135)
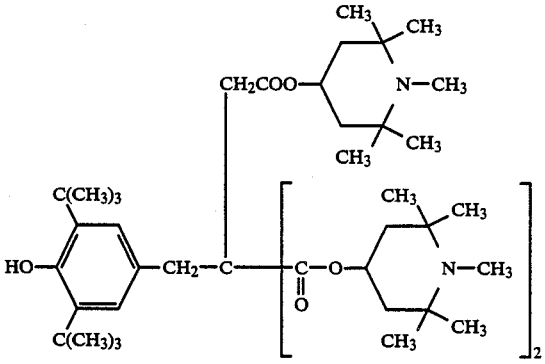
(136)
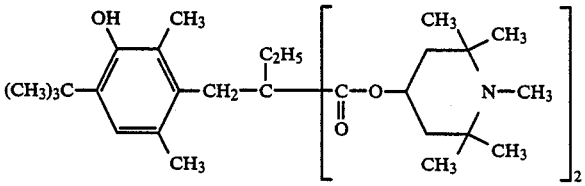

-continued
(137)
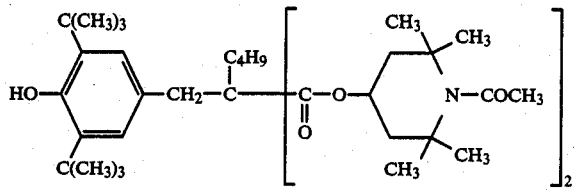
(138)
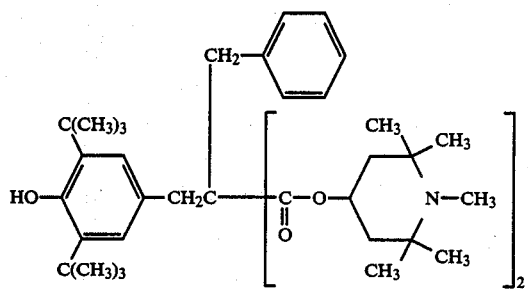
(139)
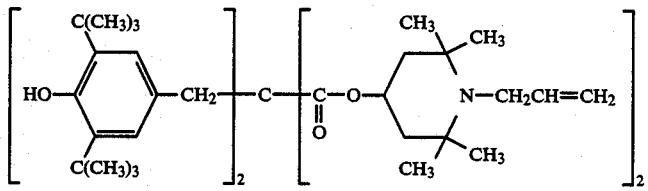
(140)
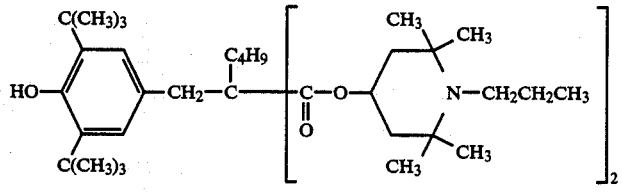
(141)
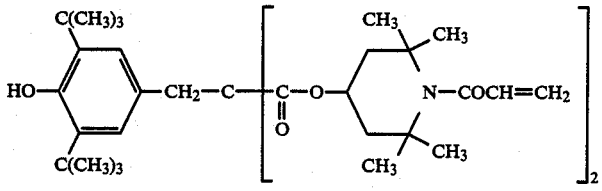
(142)
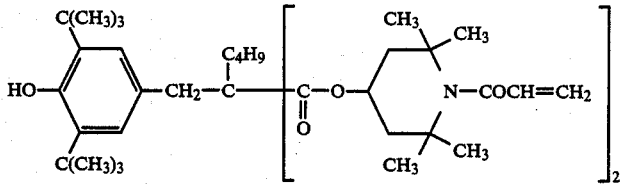
(143)
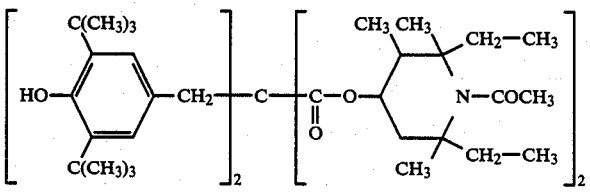

-continued (144)

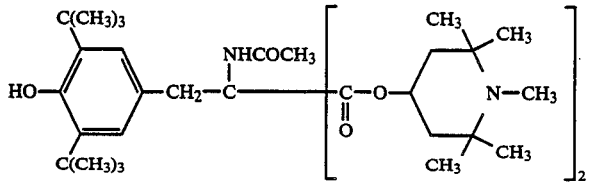

(145)

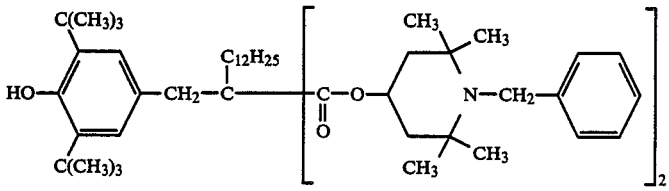

(146)

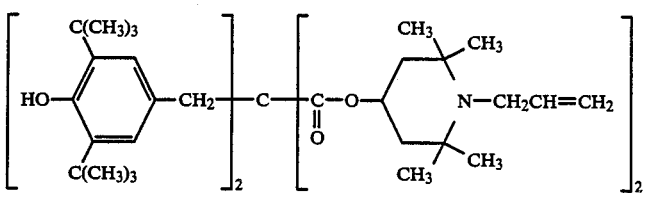

(147)

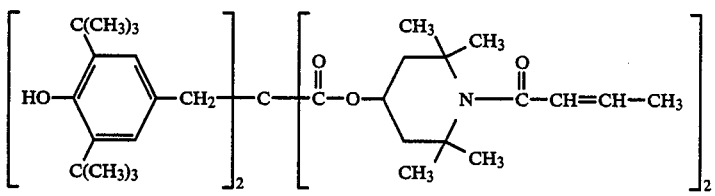

(148)

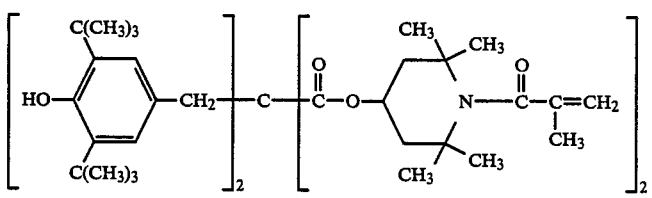

(149)

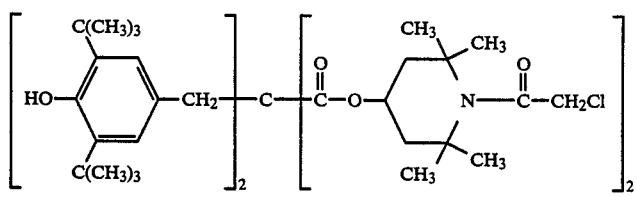

When at least one of the compounds of this invention represented by Formulas (a) and (b) is contained in a photographic layer, it is preferably used in a proportion of 5 to 300 parts by weight, more preferably 10 to 100 parts by weight, based on 100 parts by weight of the coating weight of the magenta coupler of this invention represented by Formula (I).

The photographic layer to which the above compound or compounds are added is not limited if it is at least one of the photographic constituent layers excluding the silver halide emulsion layer containing at least the magenta coupler of this invention, but it is preferably a layer or layers containing a coupler other than the magenta coupler of this invention and provided at a position more distant from a support than that of the silver halide emulsion layer containing the magenta coupler.

Of course, if the above condition is fulfilled, the above compound or compounds may be contained in the silver halide emulsion layer containing the magenta coupler of this invention.

An ultraviolet absorbent may be used in a protective layer, an intermediate layer and a silver halide emulsion layer of the light-sensitive material according to this invention, for the purpose of stabilization of dye images. An ultraviolet absorbent which can be advantageously used may include preferably a 2-(2'-hydroxyphenyl)-benzotriazole series compound, in particular, the compound represented by Formula (c) shown below:

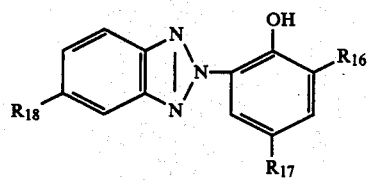

In the above Formula (c), $R^{16}$, $R^{17}$ and $R^{18}$ each represent a hydrogen atom, a halogen atom, an alkyl group, an aryl group, an alkoxy group, an aryloxy group, an alkenyl group, a nitro group or a hydroxyl group.

The halogen atom represented by $R^{16}$, $R^{17}$ and $R^{18}$ may include, for example, a fluorine atom, a chlorine atom, a bromine atom, etc., and particularly preferably, a chlorine atom.

The alkyl group and the alkoxy group represented by $R^{16}$, $R^{17}$ and $R^{18}$ may include preferably those having 1 to 20 carbon atoms, and the alkenyl group, those having 2 to 20 carbon atoms, which may be of straight-chain or branched structure.

Also, these alkyl group, alkenyl group and alkoxy group may further have a substituent. Such a substituent may include, for example, an aryl group, a cyano group, a halogen atom, a heterocyclic group, a cycloalkyl group, a cycloalkenyl group, a spiro compound residual group, a bridged hydrocarbon compound residual group, and further, those which are substituted through an carbonyl group, including an acyl group, a carboxyl group, a carbamoyl group, an alkoxycarbonyl group and an aryloxycarbonyl group, and still further, those which are substituted through a hetero atom {including specifically those which are substituted through an oxygen atom, including a hydroxyl group, an alkoxy group, an aryloxy group, a hetero ring oxy group, an siloxy group, an acyloxy group, a carbamoyloxy group, etc.; those which are substituted through a nitrogen atom, including a nitro group, an amino group (including a dialkylamino group, etc.), a sulfamoylamino group, an alkoxycarbonylamino group, an aryloxycarbonylamino group, an acylamino group, a sulfonamide group, an imido group, an ureido group, etc.; those which are substituted through a sulfur atom, including an alkylthio group, an arylthio group, a hetero ring thio group, a sulfonyl group, a sulfinyl group, a sulfamoyl group, etc.; and those which are substituted through a phosphorus atom, including a phosphonyl group, etc.}.

More specifically, it may include, for example, a methyl group, an ethyl group, an isopropyl group, a t-butyl group, a sec-butyl group, an n-butyl group, an n-amyl group, a sec-amyl group, a t-amyl group, an α,α-dimethylbenzyl group, an octyloxycarbonylethyl group, a methoxy group, an ethoxy group, an octyloxy group, an allyl group, etc.

The aryl group and the aryloxy group represented by $R^{16}$, $R^{17}$ and $R^{18}$ may include particularly preferably, for example a phenyl group and a phenyloxy group, and may have a substituent (for example, an alkyl group, an alkoxy group, etc.). Specifically, it may include, for example, a phenyl group, a 4-t-butylphenyl group, a 2,4-di-t-amylphenyl group, etc.

Of the groups represented by $R^{16}$ and $R^{17}$, a preferable are a hydrogen atom, an alkyl group, an alkoxy group and an aryl group, and particularly preferably a hydrogen atom, an alkyl group and an alkoxy group.

Of the groups represented by $R^{18}$, particularly preferable are a hydrogen atom, a halogen atom, an alkyl group and an alkoxy group.

Further, of the compounds represented by Formula (c), the compound which is liquid at room temperature can be used advantageously from the viewpoint of the capability of lowering the proportion of oil in a coated layer and the viewpoint of the precipitatability, since it can be used as a high boiling organic solvent for hydrophobic compounds such as the coupler and discoloration preventive agent according to this invention.

Here, what is meant by "liquid at room temperature" is that the compound may be liquid at the temperature condition during the step of having the compound represented by Formula (c) contained in the light-sensitive silver halide photographic material of this invention. Particularly preferable is a compound having a melting point of 30° C. or lower. More preferable is a compound having a melting point of 15° C. or lower.

Also, in this occasion, if the compound is liquid under the above condition, any of those of the 2-(2'-hydroxyphenyl)benzotriazole series compounds may be used, which may be in the form of a single compound or in the form of a mixture. As the mixture, those which are constituted of structural isomers may be preferably used.

Typical compounds of the compound represented by the above Formula (c) are shown below, to which, however, this invention is not limited.

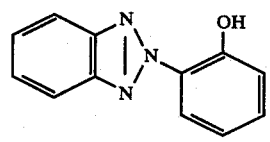

(UV-1)

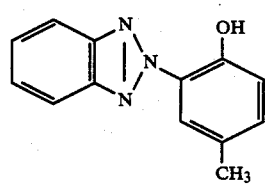

(UV-2)

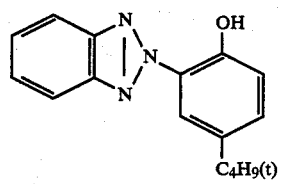

(UV-3)

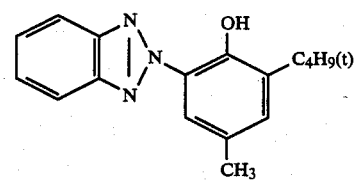

(UV-4)

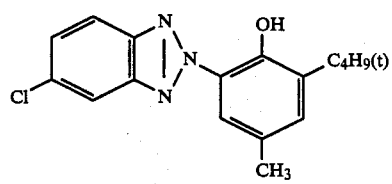

(UV-5)

-continued
(UV-6)
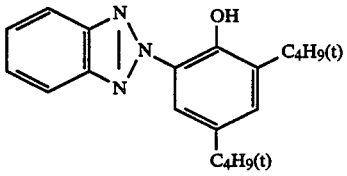
(UV-7)
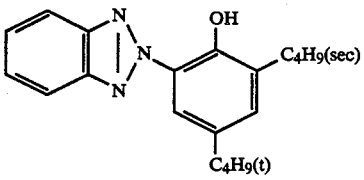
(UV-8)
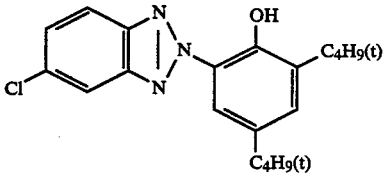
(UV-9)
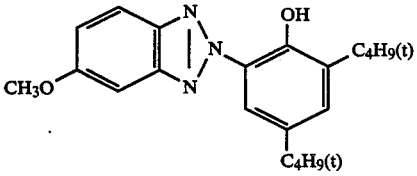
(UV-10)
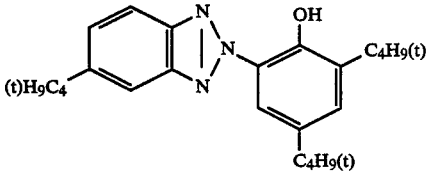
(UV-11)
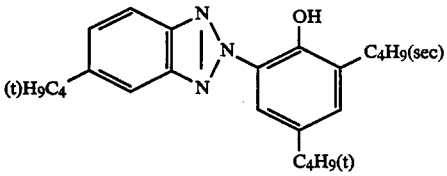
(UV-12)
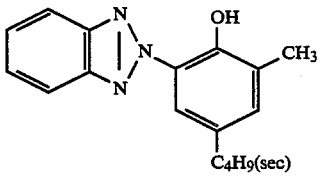
(UV-13)
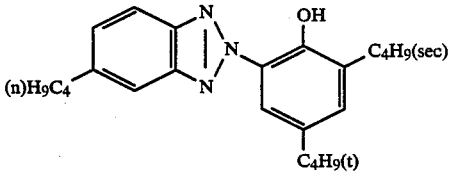
-continued
(UV-14)
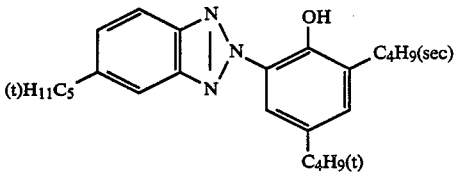
(UV-15)
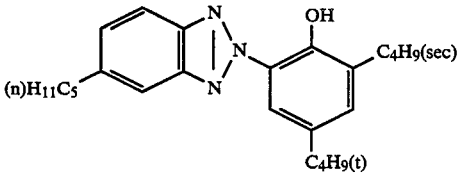
(UV-16)
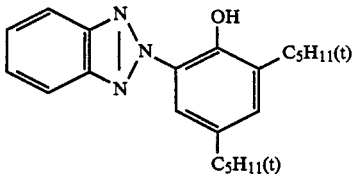
(UV-17)
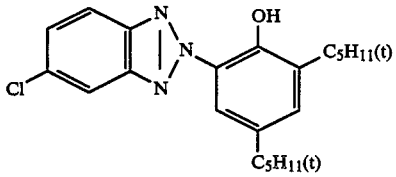
(UV-18)
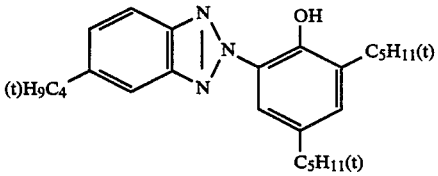
(UV-19)
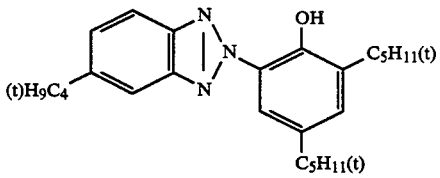
(UV-20)
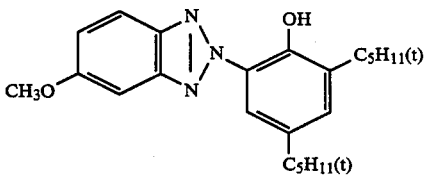
(UV-21)
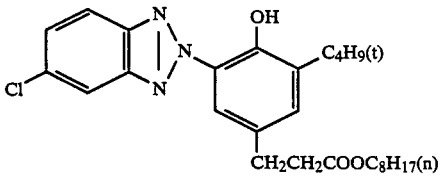

-continued (UV-22)

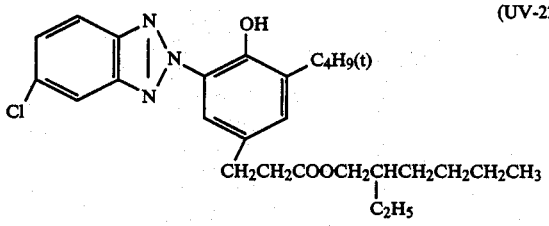

(UV-23)

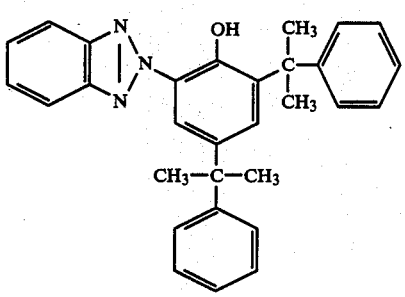

(UV-24)

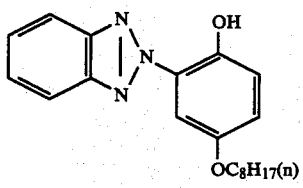

The 2-(2'-hydroxyphenyl)benzotriazole series compounds may be added in any amount, but preferably in a proportion of 1 to 50 mg/dm$^2$, particularly preferably 2 to 30 mg/dm$^2$.

As a method of adding to the light-sensitive silver halide photographic material the magenta coupler, discoloration preventive agent and compounds represented by Formulas (a), (b) and (c) according to this invention, there may be used, similar to the method generally used for the addition of hydrophobic compounds, a variety of methods such as a solid dispersion method, a latex dispersion method and an oil-in-water type emulsification dispersion method, which may be optionally selected depending on the chemical structure of the hydrophobic compounds such as coupler.

According to the oil-in-water type emulsion dispersion method, a conventional method of dispersing a hydrophobic compound such as a coupler may be applied, which method may usually comprise dissolving in a high boiling organic solvent boiling at about 150° C. or higher a low boiling organic solvent and/or a water soluble organic solvent which may be optionally used in combination, and carrying out emulsification dispersion by using a surface active agent in a hydrophilic binder such as a gelatin solution and by using a dispersion means such as a stirrer, a homogenizer, a colloid mill, a flow jet mixer, an ultrasonic device, etc., followed by adding a resultant dispersion to the aimed hydrophilic colloid layer. After dispersion or at the time of the dispersion, a step to remove the low boiling organic solvent may be included.

As the high boiling organic solvent, an organic solvent boiling at 150° C. or higher may be used, comprising a phenol derivative, a phthalate, a phosphate, a citrate, a benzoate, an alkylamide, an aliphatic acid ester, a trimesic acid ester, etc. which do not react with the oxidized product of a developing agent.

In this invention, the high boiling organic solvent which can be preferably used when the magenta coupler according to this invention is dispersed includes a compound having the dielectric constant of 6.0 or less, for example, esters such as phthalates and phosphates, organic amides, ketones, hydrocarbon compounds, etc., which have the dielectric constant of 1.9 to 6.0. Preferably, it includes high boiling organic solvents having the dielectric constant of 6.0 or less and the vapor pressure at 100° C. of 0.5 mmHg or less. Of these high boiling organic solvents, more preferable ones are phthalates or phosphates. Further, the high boiling organic solvent may comprise a mixture of two or more kinds.

The dielectric constant in this invention refers to the dielectric constant at 30° C.

The phthalate which can be advantageously used in this invention may include the compound represented by Formula (d) shown below:

Formula (d)

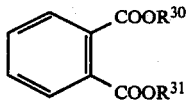

In the formula, $R^{30}$ and $R^{31}$ each represent an alkyl group, an alkenyl group or an aryl group, provided that the sum of carbon number of the groups represented by $R^{30}$ and $R^{31}$ ranges between 8 and 32. More preferably, the sum of the carbon number ranges between 16 and 24.

In this invention, the alkyl group represented by $R^{30}$ and $R^{31}$ in the above Formula (d) may be of straight-chain or branched one, and may include, for example, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, etc. The aryl group represented by $R^{30}$ and $R^{31}$ may include, for example, a phenyl group, a naphtyl group, etc.; the alkenyl group may include, for example, a hexenyl group, a heptenyl group, an octadecenyl group, etc. These alkyl group, alkenyl group and aryl group each may have a single or plural substituents, and the substituent for the alkyl group and the alkenyl group may include, for example, a halogen atom, an alkoxy group, an aryl group, an aryloxy group, an alkenyl group, an alkoxycarbonyl group, etc.; the substituent for the aryl group may include, for example, a halogen atom, an alkyl group, an alkoxy group, an aryl group, an aryloxy group, an alkenyl group, an alkoxycarbonyl group, etc.

The phosphate which can be advantageously used in this invention may include the compound represented by Formula (e) shown below:

Formula (e)

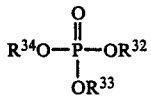

In the formula, $R^{32}$, $R^{33}$ and $R^{34}$ each represents an alkyl group, an alkenyl group or an aryl group, provided that the sum of carbon number of the groups represented by $R^{32}$, $R^{33}$ and $R^{34}$ ranges between 24 and 54.

The alkyl group represented by $R^{32}$, $R^{33}$ and $R^{34}$ in Formula (e) may include, for example, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, etc; the aryl group may include, for example, a phenyl group, a naphtyl group, etc.; the alkenyl group may include, for example, a hexenyl group, a heptenyl group, an octadecenyl group, etc.

These alkyl group, alkenyl group and aryl group each may have a single or plural substituents. Preferably, $R^{32}$, $R^{33}$ and $R^{34}$ each are an alkyl group, including, for example, a 2-ethylhexyl group, an n-octyl group, a 3,5,5-trimethylhexyl group, an n-nonyl group, an n-decyl group, a sec-decyl group, a sec-dodecyl group, a t-octyl group, etc.

Typical examples of the organic solvent used in this invention are shown below, to which, however, this invention is not limited.

Exemplary organic solvents:

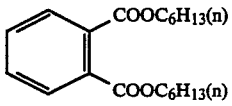

S-1

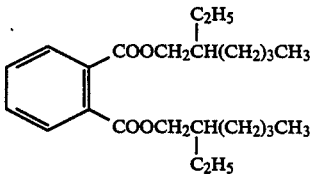

S-2

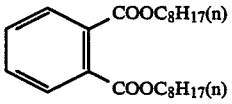

S-3

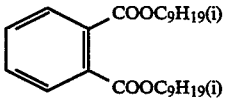

S-4

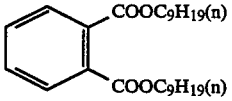

S-5

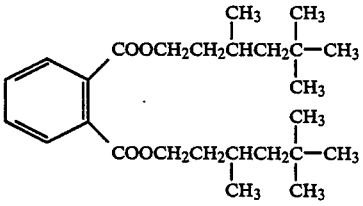

S-6

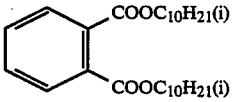

S-7

-continued

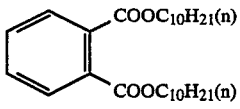

S-8

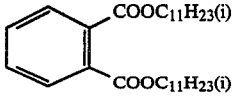

S-9

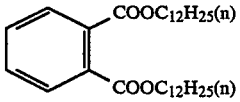

S-10

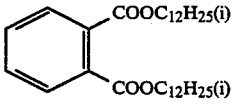

S-11

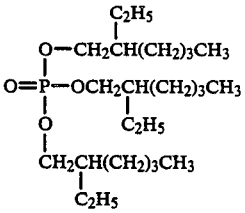

S-12

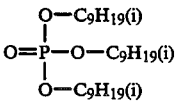

S-13

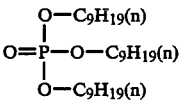

S-14

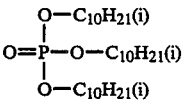

S-15

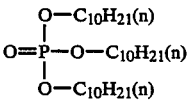

S-16

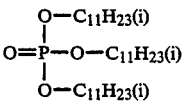

S-17

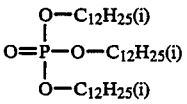

S-18

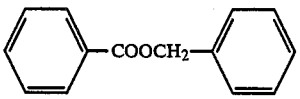

S-19

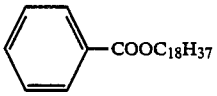

S-20

-continued

S-21

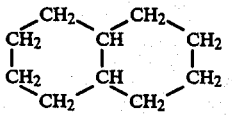

S-22

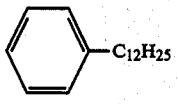

These organic solvents may be used generally in a proportion of 10 to 150% by weight based on the magenta coupler of this invention; preferably, 20 to 100% by weight based on the coupler.

As a dispersing aid to be used when the hydrophobic compound such as a coupler is dissolved in the solvent employing a high boiling solvent alone or in combination with the low boiling solvent to carry out the dispersion by use of a mechanical means or an ultrasonic wave, there may be used an anionic surface active agent, a nonionic surface active agent and cationic surface active agent.

The light-sensitive silver halide photographic material according to this invention may be applied, for instance, to negative and positive films for color photographs and color photographic papers, etc., and, in particular, the effect of this invention is effectively exhibited when it is applied to color photographic papers which are placed on direct appreciation.

The light-sensitive silver halide photographic material of this invention, including the above color photographic paper, may be those for either monochromes or polychromes. In the case of a light-sensitive silver halide photographic material for polychromes, in order to carry out the color reproduction by the subtractive color process, it is generally constructed in such a way that silver halide emulsion layers containing respectively magenta, yellow and cyan couplers as couplers for photography and non-sensitive layers are laminated on a support in a suitable layer number and layer sequence, wherein the layer number and the layer sequence may be varied depending on the importance of a performance or the object of use.

In the silver halide emulsion layer used in the light-sensitive silver halide photographic material of this invention, it is possible to optionally use the silver halides used in ordinary silver halide emulsions, including silver bromide, silver iodobromide, silver iodochloride, silver chlorobromide and silver chloride, etc.

The silver halide grains used in the silver halide emulsion may be those obtained by any of an acidic method, a neutral method and an ammonium method. The grains may be allowed to grow at a time, or may be allowed to grow after formation of seed grains. The method of preparing seed grains and the method for growth may be the same or different.

The silver halide emulsion may be obtained by simultaneously mixing halide ions and silver ions, or, alternatively, by first preparing an emulsion in which either one is present, followed by mixing the other one in it. Also, the silver halide grains may be formed by successively and simultaneously adding halide ions and silver ions under control of pH and pAg in a mixing furnace, taking into consideration the critical growth rate of silver halide crystals. After growth of the grains, the compositional arrangement of halogens in the grains may be varied by use of a conversion method.

When the silver halide emulsion is prepared, it is possible to control grain size of silver halide grains, shape of the grains, grain size distribution and grain growth rate by optionally using a silver halide solvent.

To the silver halide grains used in the silver halide emulsion, metal ions may be added by using a cadmium salt, a zinc salt, a lead salt, a thallium salt, an iridium salt or a complex salt thereof, a rhodium salt or a complex salt thereof, an iron salt or a complex salt thereof, etc. during the course of the formation and/or growth of grains to have them included in the inside and/or the surface of a grain, and also, reduction sensitization nuclei may be imparted to the inside and/or the surface of a grain by placing grains in an appropriate reducible atmosphere.

The silver halide emulsion may be those from which unnecessary soluble salts have been removed after completion of the growth of silver halide grains, or those containing them as they are. When the salts are to be removed, the method disclosed in Research Disclosure No. 17643 may be used.

The silver halide grains used in the silver haldie emulsion may be those whose inside and surface side are comprised of a uniform layer or different layers.

The silver halide grains used in the silver halide emulsion may be either the grains such that latent images are mainly formed on the surface thereof, or the grains such that they are mainly formed in the inner side of the grains.

The silver halide grains used in the silver halide emulsion may be those having a regular crystal shape or those having an irregular crystal shape such as spherical and plate-like. Of these grains, those having {100} face and {111} face in an optional proportion may be used. Also, those having a composite shape of the above crystal shapes may be used, or the grains having a variety of crystal shapes may be mixed.

The silver halide emulsion may be used by mixing two or more of silver halide emulsions having been prepared separately.

The silver halide grains according to this invention may be chemically sensitized by a conventional method. Namely, the sulfur sensitization using a compound containing sulfur capable of reacting with silver ion, or an active gelatin, the selenium sensitization using a selenium compound, the reduction sensitization using a reducible substance, the noble metal sensitization using noble metal compound such as gold, etc. may be employed singularly or in combination.

The silver halide emulsion may be optically sensitized to a desired wavelength region by using a dye known in the photographic field as a sensitizing dye. The sensitizing dye may be used singularly or may be used in combination of two or more kinds. Together with such sensitizing dye(s), a supersensitizer which is a dye having no photosensitizing action by itself or a compound not substantially absorbing any visible light, and which strengthens the sensitizing action in a sensitizing dye.

To the silver halide emulsion, a compound known in the photographic field as a antifoggant or a stabilizer may be added during the course of chemical ripening and/or at the time of completion of chemical ripening and/or after completion of chemical ripening, but before coating of a silver halide emulsion, for the purpose of preventing fogs and/or keeping stable photographic performances during the course of the preparation of photographic materials, during storage thereof or during the course of photographic processing.

As for a binder (or a protective colloid) in the silver halide emulsions, it is advantageous to use gelatin. Besides it, there may be also used hydrophilic colloids such as a gelatin derivative, a graft polymer of gelatin with other polymers, a protein, a sugar derivative, a cellulose derivative, a syntheic hydrophilic polymer of homopolymer or copolymer, etc.

In the light-sensitive silver halide color photographic material of this invention, the photographic emulsion layer and other hydrophilic colloid layer may be hardened by using singularly or in combination a hardening agent or agents which bridge binder (or protective colloid) molecules to enhance the membrane strength. The hardening agent is preferably added in an amount that can harden a light-sensitive material to such a degree that may not necessitate adding another hardening agent in a processing solution, but it is also possible to add the hardening agent in the processing solution.

A plasticizer may be added for the purpose of enhancing the flexibility of the silver halide emulsion layer and/or other hydrophilic colloid layer in the light-sensitive material of the invention.

In the photographic emulsion layer and other hydrophilic colloid layer of the light-sensitive material of this invention, a dispersion of water-soluble or insoluble synthetic polymer (a latex) may be contained for the purpose of improving, for example, the dimentional stability, etc.

In the emulsion layer of the light-sensitive silver halide photographic material of this invention, when carrying out color developing, a dye forming coupler is used, which may form a dye by a coupling reaction with an oxidated product of an aromatic primary amine developing agent (for example, a p-phenylenediamine derivative, an aminophenol derivative, etc.). Usually, the dye forming coupler is selected so that there may be formed dyes which absorb light-sensitive spectral light of emulsion layer with respect to the respective emulsion layers, and thus a yellow dye forming coupler, a magenta dye forming coupler and a cyan dye forming coupler are used in a blue light-sensitive emulsion layer, a green light-sensitive emulsion layer and a red light-sensitive emulsion layer, respectively. However, depending on an object, they may be also used in a different manner from the above combination to prepare the light-sensitive silver halide photographic material.

The yellow dye image forming coupler typically includes an acylacetoamide type benzoylmethane couplers of four equivalents or of two equivalents, which are disclosed, for example, in the specifications of U.S. Pat. No. 2,186,849, No. 2,322,027, No. 2,728,658, No. 2,875,057, No. 3,265,506, No. 3,277,155, No. 3,408,194, No. 3,415,652, No. 3,447,928, No. 3,664,841, No. 3,770,446, No. 3,778,277, No. 3,489,140 and No. 3,894,875, British Pat. No. 778,089, No. 808,276, No. 875,476, No. 1,402,511, No. 1,421,126 and No. 1,513,832; the publications of Japanese Patent Publication No. 13576/1974, Japanese Unexamined Patent Publications No. 29432/1973, No. 66834/1973, No. 10736/1974, No. 122335/1974, No. 28834/1975, No. 132926/1975, No. 138832/1975, No. 3631/1976, No. 17438/1976, No. 26038/1976, No. 26039/1976, No. 50734/1976, No. 53825/1976, No. 75521/1976, No. 89728/1976, No. 102636/1976, No. 107137/1976, No. 117031/1976, No. 122439/1976, No. 143319/1976, No. 9529/1978, No. 82332/1978, No. 135625/1978, No. 145619/1978, No. 23528/1979, No. 48541/1979, No. 65035/1979, No. 133329/1979, and No. 598/1980; etc.

The cyan dye image forming coupler typically includes phenol series or naphthol series four equivalent or two equivalent type cyan dye image forming couplers, which are disclosed in the respective specifications of U.S. Pat. No. 2,306,410, No. 2,356,475, No. 2,362,598, No. 2,637,531, No. 2,369,929, No. 2,423,730, No. 2,474,293, No. 2,476,008, No. 2,498,466, No. 2,545,687, No. 2,728,660, No. 2,772,162, No. 2,895,826, No. 2,976,146, No. 3,002,836, No. 3,419,390, No. 3,446,622, No. 3,476,563, No. 3,737,316, No. 3,758,308 and No. 3,839,044, British Pat. No. 478,991, No. 945,542, No. 1,084,480, No. 1,377,233, No. 1,388,024 and No. 1,543,040; and the publications of Japanese Unexamined Patent Publications No. 37425/1972, No. 10135/1975, No. 25228/1975, No. 112038/1975, No. 117422/1975, No. 130441/1975, No. 6551/1976, No. 37647/1976, No. 52828/1976, No. 108841/1976, No. 109630/1978, No. 48237/1979, No. 66129/1979, No. 131931/1979 and No. 32071/1980; etc.

Colored couplers which may be used in this invention include, for example, those disclosed in British Pat. No. 937,621, No. 1,035,959 and No. 1,255,111, Japanese Unexamined Patent Publications No. 22028/1973 and No. 42121/1977, Japanese Patent Publications No. 22335/1963, No. 2015/1969 and No. 15754/1969, U.S. Pat. No. 2,449,966, No. 2,521,908, No. 2,543,691, No. 2,801,171, No. 2,983,608, No. 3,005,712, No. 3,034,892, No. 3,061,432, No. 3,419,391, No. 3,476,560, No. 3,476,563, No. 3,481,741, No. 3,519,429, No. 3,583,971, No. 3,622,328, No. 3,684,514, No. 4,004,929, No. 4,070,191, No. 4,138,258, No. 4,138,264, No. 4,163,670, No. 4,292,400 and No. 4,369,248, etc.

DIR couplers which may be preferably used in this invention include, for example those disclosed in British Pat. No. 953,454, U.S. Pat. No. 3,227,554, No. 3,615,506, No. 3,617,291, No. 3,701,783, No. 3,933,500, No. 4,095,984, No. 4,149,886, No. 4,286,054, No. 4,359,521, Japanese Unexamined Patent Publications No. 90932/1977, No. 116029/1981 and No. 151944/1982, etc., and timing DIR couplers disclosed in U.S. Pat. No. 4,248,962 and No. 4,409,323, Japanese Unexamined Patent Publications No. 154234/1982, No. 162949/1983, No. 205150/1983, No. 195643/1984, No. 206834/1984, No. 206836/1984, No. 210440/1984 and 7429/1985, etc.

It may occur that an oxidized product of developing agent or an electron-transferring agent is transferred between the emulsion layers (between layers having same color sensitivity and/or between layers having different color sensitivity) of the light-sensitive silver halide photographic material of this invention, to cause color turbidity or make conspicuous the deterioration in sharpness and the graininess. In order to prevent these, a color fog preventive agent is be used.

The color fog preventive agent may be used in the emulsion layer itself, or an intermediate layer may be provided between contiguous layers to use it in the intermediate layer.

The layer constitution in the light-sensitive silver halide photographic material according to this invention may assume any layer number and layer sequence, but preferably such that layers constituted of (1) a yellow coupler-containing silver halide emulsion layer, (2) a magenta coupler-containing silver halide emulsion layer, (3) a cyan coupler-containing silver halide emulsion layer, are provided in the order of (1)-(2)-(3) from a support; intermediate layers are provided between (1) and (2) and (2) and (3), respectively; a non-light-sensitive layer is provided at a side more distant to (3) viewed from the support; and ultraviolet absorbents are contained in the intermediate layer between (2) and (3) and in the non-light-sensitive layer contiguous to (3). When the ultraviolet absorbent is contained in the non-light-sensitive layer contiguous to (3), it is preferable to further provide a protective layer in contiguity to said layer.

In the light-sensitive silver halide photographic material of this invention, it is possible to provide an auxiliary layer such as a filter layer, antihalation layer and/or an antiiradiation layer. In these layers and/or emulsion layers, a dyestuff may also be contained, which is either flow out of a light-sensitive color material or bleached, during the course of developing processing.

To the silver halide emulsion layer and/or other hydrophilic colloid layer of the light-sensitive silver halide photographic material of this invention, a matte agent may be added in order to decrease gloss of the light-sensitive material, enhance inscribability on the light-sensitive material, prevent light-sensitive materials from sticking to each other, and so on.

A lubricant may be added to decrease sliding friction of the light-sensitive silver halide photographic material of this invention.

For the purpose of preventing the light-sensitive silver halide photographic material from electrostatically charged, an antistatic agent may be added thereto. The antistatic agent may sometimes be used in an antistatic layer which is on the side of a support which is not provided with emulsion layers, or may be used also in a protective colloid layer other than the emulsion layers or in emulsion layers which are on the side provided with emulsion layers.

In the photographic emulsion layers and/or the other hydrophilic colloid layers of the light-sensitive silver halide photographic material of this invention, various surface active agents may be used for the purpose of improvement in coating property, prevention of electrostatic discharge, improvement in lubricity, emulsification dispersion, prevention of sticking and improvement in other photographic properties (such as development acceleration, achievement of high contrast, and sensitization).

A support on which the photographic emulsion layers and the other layers of the light-sensitive silver halide photographic material of this invention includes a flexible reflective support such as baryta paper, a paper laminated with α-olefin polymer or the like, a synthetic paper; a film comprised of a semi-synthetic or synthetic polymer such as cellulose acetate, cellulose nitrate, polystyrene, polyvinyl chloride, polyethylene terephthalate, polycarbonate and polyamide; a hard material such as glass, metal and ceramic, etc.

The light-sensitive silver halide photographic material of this invention may be coated on the surface of a support directly or through interposition of one or two or more of subbing layer(s) (for improving adhesion property of the support surface, antistatic property, dimentional stability, wear resistance, hardness, antihalation property, friction characteristics and/or the other characteristics), optionally after application of corona discharge, ultraviolet irradiation, flame treatment, etc.

When the light-sensitive silver halide photographic material of this invention is coated, a thickening agent may be used to improve the coating property. As the coating method, extrusion coating and curtain coating are particularly useful, which are feasible of coating two or more layers simultaneously.

The light-sensitive silver halide photographic material of this invention may be exposed by use of electromagnetic waves in the spectral region to which the emulsion layers constituting the light-sensitive silver halide photographic material of this invention has sensitivity. As a light source, there may be used any of known light sources such as natural light (sunlight), a tungsten lamp, a fluorescent lamp, a mercury lamp, a xenon arc lamp, a carbon arc lamp, a xenon flash lamp, a cathode ray tube flying spot, every kind of laser beams, light from light emitting diode, light emitted from a fluorescent substance energized by electron rays, X-rays, gamma-rays, alpha-rays, etc.

As for the exposure time, it is possible to make exposure, not to speak of exposure of 1 millisecond to 1 second usually used in cameras, of not more than 1 microsecond, for example, 100 microseconds to 1 microsecond by use of a cathode ray tube or a xenon arc lamp, and it is also possible to make exposure longer than 1 second. Such exposure may be carried out continuously or may be carried out intermittently.

The light-sensitive silver halide photographic material of this invention can form color images by carrying out color development known in the art.

The aromatic primary amine series color developing agent used for a color developing solution in this invention includes known ones widely used in the various color photographic processes. These developing agents include aminophenol series and p-phenylenediamine series derivatives. These compounds, which are more stable than in a free state, are used generally in the form of a salt, for example, in the form of a hydrochloride or a sulfate. Also, these compounds are used generally in concentration of about 0.1 g to about 30 g per liter of the color developing agent, preferably in concentration of about 1 g to about 15 g per liter of the color developing agent.

The aminophenol series developing agent may include, for example, o-aminophenol, p-aminophenol, 5-amino-2-oxytoluen, 2-amino-3-oxytoluen, 2-oxy-3-amino-1,4-dimethylbenzene, etc.

Particularly useful aromatic primary amine series color developing agents include N,N'-dialkyl-p-phenylenediamine series compounds, wherein an alkyl group and a phenyl group may be substituted with an optional substituent. Of these, particularly preferable compounds may include, for example, N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluen, N-ethyl-N-β-methanesulfonamideethyl-3-methyl-4aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate, etc.

Also, in addition to the above aromatic primary amine series color developing agents, the color developing solution used in this invention may optionally further contain various components usually added in the color developing solution, for example, an alkali agent such as sodium hydroxide, sodium carbonate and potassium carbonate, a sulfite of alkali metals, a bisulfite of alkali metals, a thiocyanate of alkali metals, a halogen compound of alkali metals, benzyl alcohol, a water softening agent, a thickening agent, etc. This color developing solution has generally the pH value of 7 or more, most generally about 10 to about 13.

In this invention, after color developing processing, processing by use of a processing solution having fixing ability is carried out. When the processing solution having fixing ability is a fixing solution, a bleaching is carried out beforehand. As a bleaching agent used in the bleaching step, there may be used a metal complex salt of an organic acid. The metal complex salt has an action to oxidize a metal silver formed by development to allow it to revert to silver halide, and, at the same time, color develop an undeveloped portion of a coupler. It has the structure in which a metal ion such as iron ion, cobalt ion, cupper ion, etc. is coordinated with an organic acid such as an aminopolycarboxylic acid or oxalic acid, citric acid, etc. The organic acid most preferably used for formation of the metal complex salt of such an organic acid may include polycarboxylic acid or aminopolycarboxylic acid. The polycarboxylic acid or aminopolycarboxylic acid may be in the form of an alkali metal salt, an ammonium salt or a water soluble amine salt.

Typical examples of these may include the following:

(1) Ethylenediaminetetraacetic acid
(2) Nitrilotriacetic acid
(3) Iminodiacetic acid
(4) Disodium ethylenediaminetetraacetate
(5) Tetra(trimethylammonium)ethylenediaminetetraacetate
(6) Tetrasodium ethylenediaminetetraacetate
(7) Sodium nitrilotriacetate A bleaching solution to be used may contain as the bleaching agent the above metal complex salt of the organic acid, and also contain various additives. Preferably, the additives to be contained may include in particular a re-halogenating agent such as an alkali halide or an ammonium halide, for example, potassium bromide, sodium bromide, sodium chloride, ammonium bromide, etc., a metal salt and a chelating agent. Also, there may be optionally added those which are known to be usually added to a bleaching solution, including a pH buffering agent such as borate, oxalate, acetate, carbonate and phosphate, an alkylamine, a polyethyleneoxide, etc.

Further, the fixing solution and bleach-fixing solution may contain a pH buffering agent including sulfites such as ammonium sulfite, potassium sulfite, ammonium bisulfite, potassium bisulfite, sodium bisulfite, ammonium metabisulfite, potassium metabisulfite and sodium metabisulfite, and boric acid, borax, sodium hydroxide, potassium hydroxide, sodium carbonate, potassium carbonate, sodium bicarbonate, potassium bicarbonate, acetic acid, sodium acetate, ammonium hydroxide, etc., which may be added singularly or in combination of two or more.

When the processing of the light-sensitive silver halide photographic material according to this invention is carried out while replenishing a bleach-fixing replenishing agent in a bleach-fixing solution (or bath), the bleach-fixing solution (or bath) may contain a thiosulfate, a thiocyanate or a sulfite, etc., or these salts may be contained in a bleach-fixing replenishing solution which is replenished to the processing bath.

In this invention, if desired, blowing of air or blowing of oxygen may be carried out in the bleach-fixing bath and in a storage tank for the bleach-fixing replenishing solution in order to enhance the activity in the bleach-fixing solution, or a suitable oxidizing agent including, for example, hydrogen peroxide, bromate, persulfate, etc. may be added.

This invention will be described specifically by referring to the following Examples, by which, however, embodiments of this invention are not limited.

EXAMPLE 1

The following respective layers were provided by coating on a support made of a polyethylene-coated paper in the manner successive from the support, to prepare a polychrome light-sensitive silver halide photographic material.

First layer: Blue-sensitive silver halide emulsion layer

As yellow coupler, α-pivaryl-α-(1-benzyl-2,4-dioxoimidazolidin-3-yl)-2-chloro-5-[γ-(2-4-di-t-amylphenoxy)butylamido]-acetonilide in 8 mg/dm$^2$, a blue-sensitive silver bromide emulsion in 3 mg/dm$^2$ calculated as silver, S-6 in 3 mg/dm$^2$ and gelatin in 16 mg/dm$^2$ were coated to have the prescribed coating weight, respectively.

Second layer: Intermediate layer

Gelatin was coated to have the coating weight of 4 mg/dm$^2$.

Third layer: Green-sensitive silver chlorobromide emulsion layer

Exemplary magenta coupler 59 in 4 mg/dm$^2$, green-sensitive silver chlorobromide emulsion in 2 mg/dm$^2$ calculated as silver, Compound S-2 in 4 mg/dm$^2$ and gelatin in 16 mg/dm$^2$ were coated to have the prescribed coating weight, respectively.

Fourth layer: Intermediate layer

Ultraviolet absorbents (UV-16) in 3 mg/dm$^2$ and (UV-6) in 3 mg/dm$^2$, S-2 in 4 mg/dm$^2$ and gelatin in 14 mg/dm$^2$ were coated to have the prescribed coating weight, respectively.

Fifth layer: Red-sensitive silver chlorobromide emulsion layer

As cyan coupler, 2,4-dichloro-3-methyl-6-[α-(2,4-di-t-amylphenoxy)butylamido]-phenol in 1 mg/dm$^2$, 2-(2,3,4,5,6-pentafluorophenyl)acylamino-4-chloro-5-[α-(2,4-di-t-amylphenoxy)pentyl amide] in 3 mg/dm$^2$, S-2 in 2 mg/dm$^2$ and red-sensitive silver chlorobromide emulsion in 3 mg/dm$^2$ calculated as silver were coated to have the prescribed coating weight, respectively.

Sixth layer: Intermediate layer

As ultraviolet absorbents, UV-16 in 2 mg/dm$^2$ and UV-6 in 2 mg/dm$^2$, S-2 in 2 mg/dm$^2$ and gelatin in 6 mg/dm$^2$ were coated to have the prescribed coating weight, respectively.

Seventh layer: Protective layer

Gelatin was coated to have the coating weight of 9 mg/dm$^2$.

The sample thus prepared was designated as Sample 1 (Comparative).

Next, Samples 2 to 17 were prepared in the same manner as for Sample 1, except that in the third layer the magenta coupler, the high boiling organic solvent and the compounds represented by Formulas (a) and (b) used in the layers other than the third layer were used in such combinations as shown in Table 1.

In Table 1, Comparative magenta coupler 1 refers to the following:

[Comparative magenta coupler, XC-1]

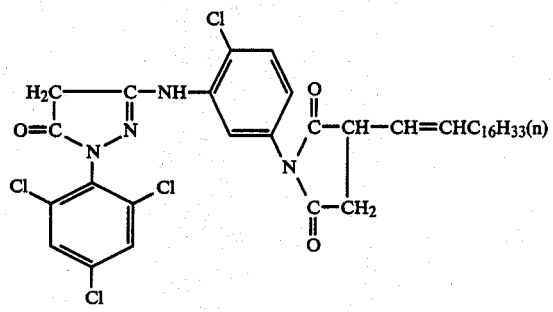

[Comparative compound 1]

(Compound disclosed in Japanese Unexamined Patent Publication No. 48538/1979)

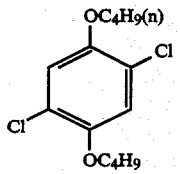

These samples 1 to 7 were subjected to optical wedge exposure to green light by use of a sensitometer (KS-7 type, manufactured by Konishiroku Photo Industry Co., Ltd.), and thereafter subjected to the following processing:

Standard processing steps (processing temperature and processing time):

| | | |
|---|---|---|
| [1] Color developing | 38° C. | 3 min. 30 sec. |
| [2] Bleach-fixing | 33° C. | 1 min. 30 sec. |
| [3] Water-washing | 25 to 30° C. | 3 min. |
| [4] Drying | 75 to 80° C. | about 2 min. |

Composition of processing solutions:
(color developing solution)

| | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphorous acid (TPPS) | 2.5 g |
| 3-Methyl-4-amino-N—ethyl-N—(ethyl-β-methanesulfonamide)-aniline sulfate | 5.5 g |
| Brightening agent (a 4,4'-diaminostylbenzsulfonic acid derivative) | 1.0 g |
| Potassium hydroxide | 2.0 g |

Made up to one liter in total amount by adding water, and adjusted to pH 10.20.

(Bleach-fixing solution)

| | |
|---|---|
| Ferric ammonium ethylenediaminetetraacetate bihydrate | 60 g |
| Ethylenediaminetetraacetic acid | 3 g |
| ammonium thiosulfate (70% solution) | 100 ml |
| Ammonium sulfite (40% solution) | 27.5 ml |

Adjusted to pH 7.1 by use of potassium carbonate or glacial acetic acid, and made up to one liter in total amount by adding water.

After the processing, the fastness to light and the spectral absorption characteristics of magenta dye images obtained were tested by the following method:

(Fastness-to-light test)

Using an under glass wethering stand, the samples were irradiated by sunlight, and the fastness to light was indicated as residual rate of an initial density $D_0=1.0$ after being irradiated by sunlight for 30 days.

$$\text{Residual rate} = \frac{D}{D_0} \times 100$$

(Spectral absorption characteristics test)

Spectral reflectance of obtained magenta colored samples was measured by use of a color analizer (607 type, manufactured by Hitachi, Ltd.). Here, the maximum density of the absorption spectrum at the visible portion of each sample was standardized as 1.0 to carry out the measurement. As the secondary absorption, the reflection density at 420 nm of each sample was used as an index of the color purity. Results are shown in Table 1.

TABLE 1

| Sample No. | Exemplary magenta coupler No. | High boiling organic solvent | Compound of Formulas (a),(b) Coating amount (mg/dm²) | Compound of Formulas (a),(b) Added layer | Fastness to light (%) | Secondary absorption density |
|---|---|---|---|---|---|---|
| | | | Comparative sample: | | | |
| 1 | 59 | S-2 | — | — | 52 | 0.20 |
| | | | Present invention: | | | |
| 2 | 59 | S-2 | (65)3.0 | 1st layer | 57 | 0.20 |
| 3 | 59 | S-2 | (65)3.0 | 5th layer | 66 | 0.20 |
| 4 | 59 | S-2 | (141)3.0 | 5th layer | 67 | 0.20 |
| 5 | 59 | DBP | (141)3.0 | 5th layer | 65 | 0.20 |
| 6 | 59 | S-13 | (141)3.0 | 5th layer | 67 | 0.20 |
| | | | Comparative samples: | | | |
| 7 | 130 | S-2 | — | — | 52 | 0.21 |
| 8 | 130 | S-2 | (Compar. comp. 1) 3.0 | 3rd layer | 53 | 0.21 |
| 9 | 130 | S-2 | (47)3.0 | 3rd layer | 53 | 0.21 |
| | | | Present invention: | | | |
| 10 | 130 | S-2 | (47)3.0 | 5th layer | 64 | 0.21 |
| | | | Comparative sample: | | | |
| 11 | 18 | S-2 | — | — | 50 | 0.20 |
| | | | Present invention | | | |
| 12 | 18 | S-2 | (65)3.0 | 5th layer | 63 | 0.20 |
| | | | Comparative example: | | | |
| 13 | 44 | S-2 | — | — | 53 | 0.20 |
| | | | Present invention: | | | |
| 14 | 44 | S-2 | (19)3.0 | 5th layer | 68 | 0.20 |
| 15 | 44 | S-2 | (65)3.0 | 5th layer | 69 | 0.20 |
| 16 | 44 | S-2 | (123)3.0 | 5th layer | 68 | 0.20 |
| | | | Comparative samples: | | | |
| 17 | XC-1 | S-2 | — | — | 59 | 0.38 |
| 18 | XC-1 | S-2 | (65)3.0 | 5th layer | 59 | 0.38 |

Dielectric constant of the high boiling organic solvent used:

(S-2): 5.3, (S-13): 4.5, DBP (Dibutyl phthalate): 6.4.

From Table 1, it is seen that the fastness to light has been improved to a great extent in Samples 2 to 6 to which the compound represented by Formulas (a) and (b) was added in the layer other than the third layer. In particular, it is seen that such an effect is large when the compound is added to the fifth layer which is provided at the side more distant from the third layer viewed from a support and is a layer containing a coupler other than the magenta coupler. Similar results were obtained also in Samples 7 to 16. However, the effect was hardly obtained in respect of Sample 9 in which the compound was added to the third layer and Sample 8 in which Comparative compound 1 was used. Further, when Comparative coupler was used, the secondary absorption density was found to be high, and also no improvement in the fastness to light was observed even when the compound represented by Formulas (a) and (b) was used in a layer other than the third layer.

EXAMPLE 2

Polychrome light-sensitive silver halide photographic materials were obtained in the same manner as in Example 1, but with constitution as shown in Table 2. Samples obtained were subjected to exposure and processing and also to the characteristics tests in the same manner as in Example 1 to obtain the results shown in Table 2.

TABLE 2

| Sample No. | Exemplary magenta coupler No. | High boiling organic solvent | Compound of Formulas (a),(b) Coating amount (mg/dm²) | Compound of Formulas (a),(b) Added layer | Fastness to light (%) | Secondary absorption density |
|---|---|---|---|---|---|---|
| | | | Present invention: | | | |
| 19 | 44 | S-2 | (47)3.0 | 5th layer | 67 | 0.20 |
| 20 | " | " | (49)3.0 | " | 68 | " |
| 21 | " | " | (65)3.0 | " | 68 | " |
| 22 | " | " | (65)3.0 | 1st layer 5th layer | 69 | " |
| 23 | " | " | (80)3.0 | " | 68 | " |
| 24 | " | " | (92)3.0 | 5th layer | 67 | " |
| 25 | " | " | (112)3.0 | " | 68 | " |
| 26 | " | " | (121)3.0 | " | 68 | " |
| 27 | " | " | (123)3.0 | " | 67 | " |
| 28 | " | " | (141)3.0 | " | 67 | " |
| | | | Comparative sample: | | | |
| 29 | XC-2 | " | (141)3.0 | " | 53 | 0.38 |

[Comparative coupler XC-2]

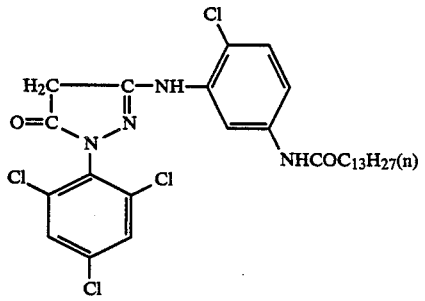

From the results shown in Table 2, it is seen that the samples according to this invention show remarkable improvement in both the fastness to light and the color reproducibility.

EXAMPLE 3

Example 1 was repeated to obtain Sample 1 (Comparative sample).

Samples 30 to 59 were prepared in the same manner as for Sample 1, except that in the third layer the magenta coupler, the high boiling organic solvent, the compounds represented by Formulas (A) to (H) and (J) to (N), and the compounds represented by Formulas (a) and (b) used in the layers other than the third layer were used in such combinations as shown in Table 3, provided that the discoloration preventive agents represented by Formulas (A) to (N), and the compounds represented by Formulas (a) and (b) used in the layers other than the third layer had the coating weight of 3 mg/dm², respectively.

[Comparative magenta coupler, XC-1]

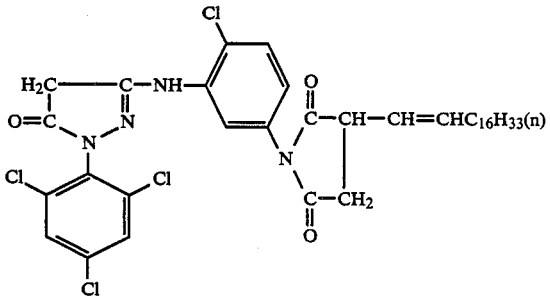

These samples were subjected to optical wedge exposure to green light by use of a sensitometer (KS-7 type, manufactured by Konishiroku Photo Industry Co., Ltd.), and thereafter subjected to the following processing:

Standard processing steps:

| | | |
|---|---|---|
| Color developing | 38° C. | 3 min. 30 sec. |
| Bleach-fixing | 33° C. | 1 min. 30 sec. |
| Water-washing | 25 to 30° C. | 3 min. |
| Drying | 75 to 80° C. | about 2 min. |

Composition of processing solutions:
(color developing solution)

| | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphorous acid (TPPS) | 2.5 g |
| 3-Methyl-4-amino-N—ethyl-N—(ethyl-β-methanesulfonamide)-aniline sulfate | 5.5 g |
| Brightening agent (4,4'-diaminostylbenzsulfonic acid derivative) | 1.0 g |
| Potassium hydroxide | 2.0 g |

Made up to one liter in total amount by adding water, and adjusted to pH 10.20.

(Bleach-fixing solution)

| | |
|---|---|
| Ferric ammonium ethylenediaminetetraacetate bihydrate | 60 g |
| Ethylenediaminetetraacetic acid | 3 g |
| Ammonium thiosulfate (70% solution) | 100 ml |
| Ammonium sulfite (40% solution) | 27.5 ml |

Adjusted to pH 7.1 by use of potassium carbonate or glacial acetic acid, and made up to one liter in total amount by adding water.

After the processing, the fastness to light and the resistance to light stain of magenta dye images obtained were tested by the following method:

(Fastness-to-light test)

Using an under glass wethering stand, the fastness to light was indicated as residual rate of an initial density $D_0 = 1.0$ after being irradiated by sunlight for 30 days.

($D$ = density after discoloration)

$$\text{Residual rate} = \frac{D}{D_0} \times 100$$

(Resistance-to-light stain test)

Using an under glass wethering stand, this was indicated as light stain $= D_{B'} - D_B$ when the blue color densities at an unexposed portion before and after the wethering under sunlight for 30 days were assumed to be $D_B$ and $D_{B'}$, respectively.

Results of these are shown in Table 3.

TABLE 3

| Sample No. | Magenta coupler | Discoloration prevt. agent | High boiling org. solvent | Compound of Formulas (a),(b) Kind | Compound of Formulas (a),(b) Added layer | Fastness to light | Light stain |
|---|---|---|---|---|---|---|---|
| | | | Comparative samples: | | | | |
| 1 | 59 | — | S-2 | — | — | 27 | 0.14 |
| 30 | " | — | " | (65) | 5th layer | 42 | 0.14 |
| 31 | " | J-1 | " | — | — | 50 | 0.15 |
| | | | Present invention: | | | | |
| 32 | " | " | " | (65) | 1st layer | 60 | 0.12 |
| 33 | " | " | " | " | 5th layer | 74 | 0.09 |
| 34 | " | J-2 | " | " | " | 73 | 0.10 |
| 35 | " | A-8 | " | " | " | 73 | 0.09 |
| 36 | " | A-13 | " | " | " | 72 | 0.10 |
| 37 | " | J-53 | " | " | " | 72 | 0.10 |
| 38 | " | C-2 | " | " | " | 73 | 0.10 |
| 39 | " | G-25 | " | " | " | 72 | 0.10 |
| 40 | " | B-35 | " | " | " | 74 | 0.09 |
| 41 | " | L-15 | " | " | " | 75 | 0.10 |
| 42 | " | M-1 | " | " | " | 74 | 0.10 |
| 43 | " | N-27 | " | " | " | 74 | 0.10 |
| 44 | 44 | B-35 | " | " | " | 74 | 0.10 |
| 45 | " | " | S-13 | " | " | 73 | 0.10 |
| 46 | " | " | TCP | " | " | 70 | 0.12 |
| 47 | " | " | UV-22 | " | " | 74 | 0.09 |
| 48 | " | " | S-2 | (47) | " | 73 | 0.10 |
| 49 | " | " | " | (123) | " | 73 | 0.10 |
| 50 | 45 | A-8 | " | (141) | " | 74 | 0.09 |
| 51 | 60 | " | " | (65) | " | 74 | 0.09 |
| 52 | 5 | B-35 | " | " | " | 68 | 0.11 |
| 53 | 18 | " | " | " | " | 69 | 0.11 |
| 54 | 99 | J-1 | " | " | " | 70 | 0.11 |
| 55 | 104 | " | " | (141) | " | 70 | 0.10 |
| 56 | 127 | L-15 | " | " | " | 70 | 0.11 |
| 57 | 130 | L-18 | " | " | " | 71 | 0.10 |
| | | | Comparative samples: | | | | |
| 58 | XC-1 | A-8 | " | — | — | 64 | 0.17 |
| 59 | " | A-8 | " | (65) | 5th layer | 65 | 0.17 |

Dielectric constant of the high boiling organic solvent used:

(S-2): 5.1, (S-13): 4.5, TCP (Tricresyl phosphate): 7.2.

From the results shown in Table 3, it is seen that, with respect to the fastness to light in particular, even Sample 30 to which the compound (65) was added in the third layer and Sample 31 to which the discoloration preventive agent was added in the third layer show certain improvement in the fastness to light as compared with Sample 1, but in a lower grae, and moreover with no effect with respect to improvement in the resistance to light stain. On the other hand, it is seen that, in Samples 32 to 57 in which the measures taken in Sample 30 and Sample 31 were combined, multiplying improvement effects are exhibited in such a grade that can not be expected individually from the measures.

Also, little improvement effect was obtained in Sample 59 which was prepared by adding the compound (65) to the fifth layer corresponding to that of Sample 58 where a comparative coupler was used.

When comparing the fastness to light in respect of Samples 40, 44, 52 and 53 which are in accordance with this invention, more desirable results were obtained in Samples 44 and 40 wherein the magenta couplers 44 and 59 were used respectively, than in Samples 52 and 53 wherein the magenta couplers 5 and 18 were used respectively.

Moreover, Samples 32 to 57 according to this invention had lower secondary absorption density than that of Comparative Samples 58 and 59, and showed desired color reproducibility for a color photographic paper.

As explained above, Samples 32 to 57 according to this invention show excellent color reproducibility and remarkably improved fastness to light and resistance to light stain, thereby obtaining an excellent light-sensitive material for color photographic paper.

EXAMPLE 4

Polychrome light-sensitive silver halide photographic materials were obtained in the same manner as in Example 3, but with constitution as shown in Table 4. Samples obtained were subjected to exposure and processing and also to the characteristics tests in the same manner as in Example 3 to obtain the results shown in Table 4.

TABLE 4

| Sample No. | Magenta coupler | Discoloration prevt. agent | High boiling org. solvent | Compound of Formulas (a)&(b) Kind | Compound of Formulas (a)&(b) Added layer | Fastness to light | Light stain |
|---|---|---|---|---|---|---|---|
| | | | Present invention: | | | | |
| 60 | 44 | J-1 | S-2 | (47) | 5th layer | 74 | 0.09 |
| 61 | " | " | " | (49) | 5th layer | 73 | 0.10 |
| 62 | " | " | " | (65) | 5th layer | 74 | 0.09 |
| 63 | " | " | " | (65) | 1st layer 5th layer | 76 | 0.08 |
| 64 | " | " | " | (80) | 1st layer 5th layer | 75 | 0.09 |
| 65 | " | " | " | (92) | 5th layer | 75 | 0.10 |
| 66 | " | " | " | (112) | " | 74 | 0.10 |
| 67 | " | " | " | (121) | " | 74 | 0.09 |
| 68 | " | " | " | (123) | " | 74 | 0.10 |
| 69 | " | " | " | (141) | " | 75 | 0.09 |
| | | | Comparative sample: | | | | |
| 70 | XC-2 | " | " | (141) | " | 59 | 0.18 |

[Comparative magenta coupler, XC-2]

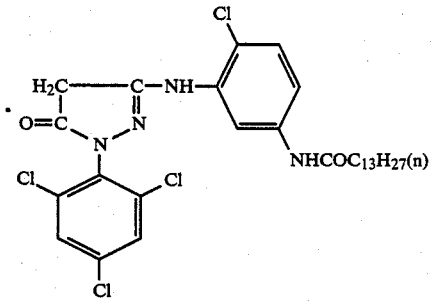

From the results shown in Table 2, it is seen that the samples according to this invention show remarkable improvement in the fastness to light and the resistance to light stain. Moreover, in the samples according to this invention, color purity was high and images of excellent color reproducibility were obtained.

We claim:

1. A light-sensitive silver halide photographic material, comprising a plural number of photographic constituent layers on a support, wherein at least one of said layers is a silver halide emulsion layer containing a magenta coupler represented by Formula (I) shown below, and at least one of the photographic constituent layers excludinb at least the above silver halide emulsion layer being provided at a position more distant from the support than that of the silver halide emulsion layer containing the magenta coupler and containing at least one of the compounds represented by Formula (a) and Formula (b) shown below:

Formula (I):

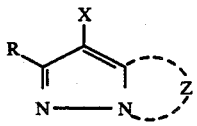

wherein Z represents a group of nonmetal atoms necessary for formation of a nitrogen-containing heterocyclic ring; said ring formed by Z may have a substituent; X represents a hydrogen atom or a substituent eluminable through the reaction with an oxidized product of a color developing agent; and R represents a hydrogen atom or a substituent.

Formula (a)

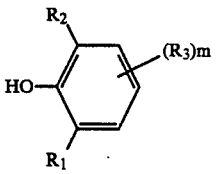

wherein $R^1$ and $R^2$ each represent an alkyl group; $R^3$ represents an alkyl group, an —NR'R" group, an —SR' group (R' represents a monovalent organic group), or a —COOR" group (R" represents a hydrogen atom or a monovalent organic group); and m represents an integer of 0 to 3.

Formula (b)

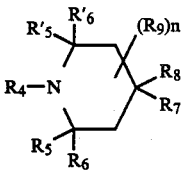

wherein $R^4$ represents a hydrogen atom, a hydroxyl group, an oxyradical group, an —SOR' group, an —$SO_2$R' group (R' represents a monovalent organic group), an alkyl group, an alkenyl group, an alkynyl group or a —COR" group (R" represents a hydrogen atom or a monovalent organic group); $R^5$, $R^6$, $R'^5$, $R'^6$, and $R^9$ each represent an alkyl group; $R^7$ and $R^8$ each represent an hydrogen atom or an —$OCOR^{10}$ group ($R^{10}$ represents a monovalent organic group), or $R^7$ and $R^8$ may be associated to form a heterocyclic group; and n represents an integer of 0 to 4.

2. The light-sensitive silver halide photographic material according to claim 1, wherein said silver halide emulsion layer containing the magenta coupler represented by Formula (I) further contains at least one kind of a discoloration preventive agent.

3. The light-sensitive silver halide photographic material according to claim 1, wherein the magenta coupler represented by Formula (I) is a coupler selected from the couplers represented by Formulas (II) to (VII) shown below:

Formula (II)

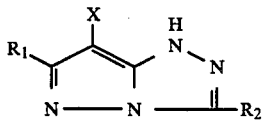

Formula (III)

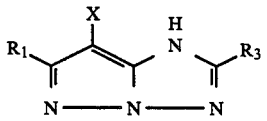

Formula (IV)

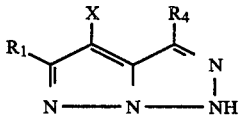

Formula (V)

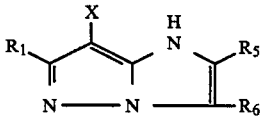

Formula (VI)

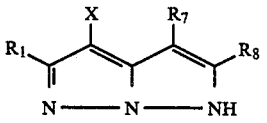

Formula (VII)

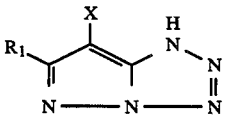

wherein $R^1$ to $R^8$ and X each have the same meaning as R and X in Formula (I).

4. The light-sensitive silver halide photographic material according to claim 1, wherein the magenta coupler represented by Formula (I) is a coupler represented by Formula (VIII) shown below:

Formula (VIII)

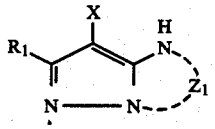

wherein $R^1$, X and $Z^1$ each have the same meaning as R, X and Z in Formula (I).

5. The light-sensitive silver halide photographic material according to claim 1, wherein the substituent represented by R in Formula (I) is a substituent represented by Formula (IX) shown below:

Formula (IX)

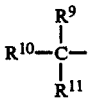

wherein $R^9$, $R^{10}$ and $R^{11}$ each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide grup, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclic thio group; and at least two of $R^9$, $R^{10}$ and $R^{11}$ are not hydrogen atoms.

6. The light-sensitive silver halide photographic material according to claim 5, wherein two of $R^9$ to $R^{11}$ are each an alkyl group.

7. The light-sensitive silver halide photographic material according to claim 5, wherein one of $R^9$ to $R^{11}$ is a hydrogen atom, and the other two are bonded to form a cycloalkyl together with the root carbon atom.

8. The light-sensitive silver halide photographic material according to claim 3, wherein the magenta coupler represented by Formula (I) is the coupler represented by Formula (II).

9. The light-sensitive silver halide photographic material according to claim 1, wherein the substituent possessed by the ring to be formed by Z in Formula (I) is a substituent represented by Formula (X) shown below:

Formula (X)

$$-R^1-SO_2-R^2$$

wherein $R^1$ represents an alkylene group, $R^2$ represents an alkyl group, a cycloalkyl group or an aryl group.

10. The light-sensitive silver halide photographic material according to claim 1, wherein the magenta coupler represented by Formula (I) is a coupler represented by Formula (XI) shown below:

Formula (XI)

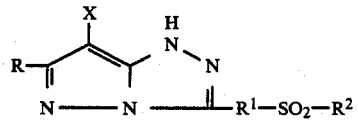

wherein R and X each have the same meaning as R and X in Formula (I), $R^1$ represents an alkylene group, and $R^2$ represents an alkyl group, a cycloalkyl group or an aryl group.

11. The light-sensitive silver halide photographic material according to claim 1, wherein the magenta coupler of Formula (I) is used in an amount ranging between $1\times10^{-3}$ mole and 1 mole per mole of silver halide.

12. The light-sensitive silver halide photographic material according to claim 2, wherein said discoloration preventive agent is selected from the compounds reresented by Formulas (A) to (H), and (J) to (N) shown below:

Formula (A)

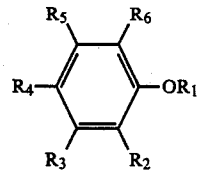

wherein $R^1$ represents a hydrogen atom, an alkyl group, an alkenyl group, an aryl group or a heterocyclic group; $R^2$, $R^3$, $R^5$ and $R^6$ each represent a hydrogen atom, a halogen atom, a hydroxyl group, an alkyl group, an alkenyl group, an ary group, an alkoxy group or an acylamino group; $R^4$ represents an alkyl group, a hydroxyl group, an aryl group or an alkoxy group;

Formula (B)

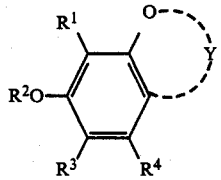

wherein, $R^1$ and $R^4$ each represent a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group, or an alkoxycarbonyl group; $R^2$ represents a hydrogen atom, an alkyl group, an alkenyl group, an aryl group an acyl group, a cycloalkyl group or a heterocyclic group; $R_3$ represents a hydrogen atom, a halogen atom, an alkyl group, an alkenyl group, an aryl group, an aryloxy group, an acyl group, an acyloxy group, a sulfonamide group, a cycloalkyl group or an alkoxycarbonyl group; and Y represents a group of atoms necessary for formation of a chroman or coumaram ring;

Formula (C)

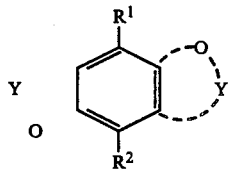

Formula (D)

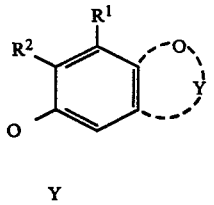

wherein $R^1$ and $R^2$ each represent a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group; and Y represents a group of atoms necessary for forming a dichroman or dicoumaran ring together with a benzene ring;

Formula (E)

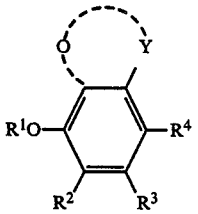

wherein, $R^1$ represents a hydrogen atom, an alkyl group, an alkeny group, an aryl group, an acyl group, a cycloalkyl group or a heterocyclic group; $R_3$ represents a hydrogen atom, a halogen atom, an alkyl group, an alkenyl group, an aryl group, an aryloxy group, an acyl group, an acylamino an acyloxy group, a sulfonamide group, a cycloalkyl group or an alkoxycarbonyl group; $R^2$ and $R^4$ each represent a hydrogen atom, a halogen atom, an alkyl group, an alkenyl group, an aryl group, an acyl group, an acylamino group, a sulfonamide group, a cycloalkyl group or an alkoxycarbonyl group; and Y represents a group of atoms necessary for formation of a chroman or coumaran ring;

Formula (F)

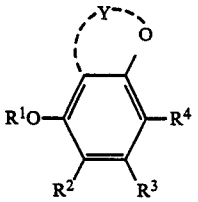

wherein $R^1$ represents a hydrogen atom, an alkyl group, an alkenyl group, an aryl group, an acyl group, a cycloalkyl group or a heterocyclic group; $R^2$ represents a hydrogen atom, a halogen atom, an alkyl group, an alkenyl group, an aryl group, aryloxy group, an acyl group, an acylamino group, an acyloxy group, a sulfonamide group, a cycloalkyl group or an alkoxycarbonyl group; $R^3$ represents a hydrogen atom, a halogen atom, an alkyl group, an alkenyl group, an aryl group, an acyl group, an acylamino group, a sulfonamide group, a cycloalkyl group or an alkoxycarbonyl group; $R^4$ represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group; and Y represents a group of atoms necessary for formation of a chroman or coumaran ring;

Formula (G)

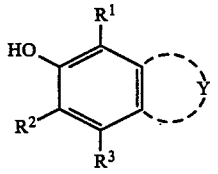

wherein $R^1$ and $R^3$ each represent a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group; $R^2$ represents a hydrogen atom, a halogen atom, an alkyl group, an alkenyl group, a hydroxyl group, an aryl group, an acyl group, an acylamino group, an acyloxy group, a sulfonamide group, a cycloalkyl group or an alkoxycarbonyl group; and Y represents a group of atoms necessary for formation of an indane ring;

Formula (H)

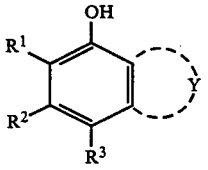

wherein, $R^1$ and $R^2$ each represent a hydrogen atom, a halogen atom, an alkyl group, an alkenyl group, an aryl group, an acyl group, an acylamino group, an acyloxy group, a sulfonamide group, a cycloalkyl group or an alkoxycarbonyl group; $R^3$ represents a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group; and Y represents a group of atoms necessary for formation of an indane ring;

Formula (J)

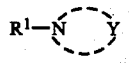

wherein $R^1$ represents an aliphatic group, a cycloalkyl group or an aryl group; and Y represents a group of nonmetal atoms necessary for forming a heterocyclic ring of 5 to 7 members together with a nitrogen atom; provided that, when two or more hetero atoms are present in the nonmetal atom containing a nitrogen atom for forming the heterocyclic ring, at least two hetero atoms are hetero atoms which are not contiguous to each other;

Formula (K)

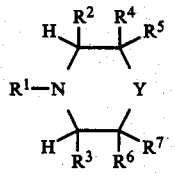

wherein $R^1$ represents an aliphatic group, a cycloalkyl group or an aryl group; Y represents a simple bond arm or a divalent hydrocarbon group necessary for forming a heterocyclic ring of 5 to 7 members together with a nitrogen atom; and $R^2$, $R^3$, $R^4$, $R^5$, $R^6$ and $R^7$ each represent a hydrogen atom, an aliphatic group, a cycloalkyl group or an aryl group;

Formula (L)

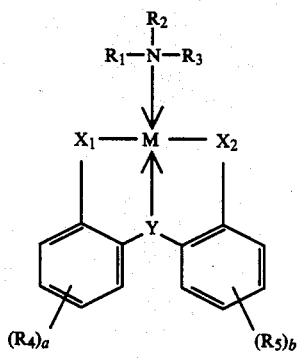

Formula (M)

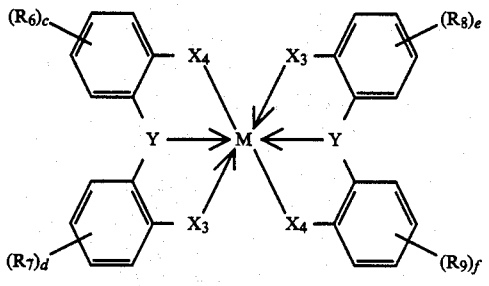

wherein, $X^1$, $X^2$ and $X^4$ each represent an oxygen atom, a sulfur atom or an —$NR^{10}$— group ($R^{10}$ represents a hydrogen atom, an alkyl group, an aryl group or a hydroxyl group); $X^3$ represents a hydroxy group or a mercapto group; Y represents an oxygen atom or a sulfur atom; $R^1$, $R^2$ and $R^3$ each represent a hydrogen atom, an alkyl group or an aryl group, provided that at least one of $R^1$, $R^2$ and $R^3$ represents an alkyl group or an aryl group; $R^4$, $R^5$, $R^6$, $R^7$, $R^8$ and $R^9$ each represent an alkyl group, an aryl group, an alkoxy group, an aryloxy group, an alkoxycarbonyl group, an aryloxycarbonyl group, an acyl group, an acylamino group, an alkylamino group, a carbamoyl group, a sulfamoyl group, a sulfonamide group, a sulfonyl group or a cycloalkyl group; M represents a metal atom; and a, b, c, d, e and f each represent an integer of 0 to 4; and Formula (N)

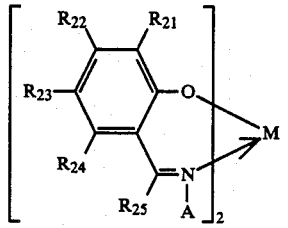

wherein, $R^{21}$, $R^{22}$, $R^{23}$ and $R^{24}$ each represent a hydrogen atom, a halogen atom, a hydroxyl group, a cyano group, or an alkyl group, an aryl group, a cycloalkyl group or a heterocyclic group which is bonded to a carbon atom on a benzene ring directly or indirectly through a divalent linking group; $R^{25}$ represents a hydrogen atom, an alkyl group or an aryl group; A represents a hydrogen atom, an alkyl group, an aryl group or a hydroxyl group; and M represents a metal atom.

13. The light-sensitive silver halide photographic material according to claim 12, wherein said discoloration preventive agent is contained in an amount ranging between 0.05 and 3 mole per mole of the magenta coupler represented by Formula (I) when the discoloration preventive agent is selected from Formulas (A) to (H), (J) and (K), or in an amount ranging between 0.01 and 3 mole per mole of the magenta coupler represented by Formula (I) when the discoloration preventive agent is selected from Formulas (L) to (N).

14. The light-sensitive silver halide photographic material according to claim 1, wherein said compound represented by Formula (a) is a compound represented by Formula (a'):

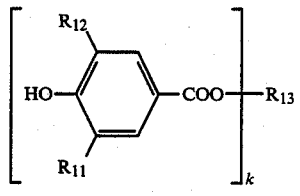

wherein, $R^{11}$ and $R^{12}$ each represent a straight chain or branched alkyl group having 3 to 8 carbon atoms, $R^{13}$ represents an organic group of valence k, and k represents an integer of 1 to 6.

15. The light-sensitive silver halide photographic material according to claim 1, wherein said compound represented by Formula (b) is a compound represented by Formula (b'):

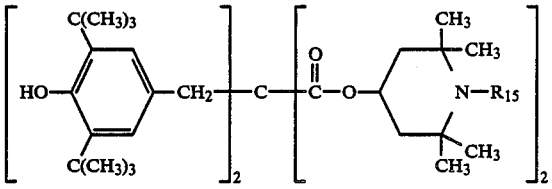

wherein, $R^{15}$ represents an alkyl group, an alkenyl group, an alkynyl group, an acyl group.

16. The light-sensitive silver halide photographic material according to claim 1, wherein at least one of the compounds represented by Formulas (a) and (b) is contained in the proportion of 5 to 300 parts by weight based on 100 parts by weight of the magenta coupler.

17. The light-sensitive silver halide photographic material according to claim 1, wherein it further comprises an ultraviolet absorbent in a protective layer, an intermediate layer and a silver halide emulsion layer of the light-sensitive silver halide photographic material.

18. The light-sensitive silver halide photographic material according to claim 17, wherein said ultraviolet absorbent is a compound represented by Formula (c):

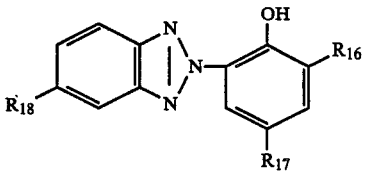

wherein $R^{16}$, $R^{17}$ and $R^{18}$ each represent a hydrogen atom, a halogen atom, an alkyl group, an aryl group, an alkoxy group, an aryloxy group, an alkenyl group, a nitro group or a hydroxyl group.

19. The light-sensitive silver halide photographic material according to claim 17, wherein said ultraviolet absorbent is contained in an amount ranging between 1 to 50 mg/dm$^2$.

20. The light-sensitive silver halide photographic material according to claim 1, wherein said magenta coupler represents by Formula (I) and said at least one of compounds represented by Formulas (a) and (b) are added by using a high boiling organic solvent having boiling point more than about 150° C.

21. The light-sensitive silver halide photographic material according to claim 20, wherein said high boiling organic solvent is selected from phthalate represented by Formula (d) and phosphate represented by Formula (e) shown below:

Formula (d)

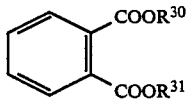

wherein, $R^{30}$ and $R^{31}$ each represent an alkyl group, an alkenyl group or an aryl group, provided that the sum of carbon number of the groups represented by $R^{30}$ and $R^{31}$ ranges between 8 and 32, Formula (e)

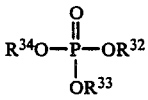

wherein, $R^{32}$, $R^{33}$ and $R^{34}$ each represents an alkyl group, an alkenyl group or an aryl group, provided that the sum of carbon number of the groups represented by $R^{32}$, $R^{33}$ and $R^{34}$ ranges between 24 and 54.

22. The light-sensitive silver halide photographic material according to claim 21, wherein said high boiling organic solvent is used in a proportion of 0.1 to 1.5 mole per mole of the magenta coupler represented by Formula (I).

* * * * *